US005164748A

United States Patent [19]

Katayanagi et al.

[11] Patent Number: 5,164,748

[45] Date of Patent: Nov. 17, 1992

[54] SUCTION RECOVERY DEVICE WITH A CAP HAVING A COMMUNICATING MEMBER TO AID SUCTION

[75] Inventors: Jun Katayanagi, Musashino; Masasumi Nagashima, Tokyo; Kazuya Iwata, Kawasaki, all of Japan

[73] Assignee: Canon Kabushiki Kaisha, Tokyo, Japan

[21] Appl. No.: 653,703

[22] Filed: Feb. 11, 1991

[30] Foreign Application Priority Data

Feb. 13, 1990 [JP] Japan ..... 2-29409
Apr. 18, 1990 [JP] Japan ..... 2-102648

[51] Int. Cl.[5] ..... B41J 2/165
[52] U.S. Cl. ..... 346/140 R
[58] Field of Search ..... 346/140

[56] References Cited

U.S. PATENT DOCUMENTS 4,313,124 1/1982 Hara .
4,345,262 8/1982 Shirato et al. .
4,459,600 7/1984 Sato et al. .
4,463,359 7/1984 Ayata et al. .
4,506,277 3/1985 Terasawa ..... 346/140 R
4,558,333 12/1985 Sugitani et al. .
4,586,058 4/1986 Yamazaki ..... 346/140
4,600,931 7/1986 Terasawa ..... 346/140
4,723,129 2/1988 Endo et al. .
4,740,796 4/1988 Endo et al. .
4,819,012 4/1989 Kiyohara et al. ..... 346/140 R
5,055,856 10/1991 Tomii ..... 346/140 X

FOREIGN PATENT DOCUMENTS 0358487 3/1990 European Pat. Off. .
59-055757 3/1984 Japan .
123670 7/1984 Japan .
138461 8/1984 Japan .
59-159017 9/1984 Japan .
60-141564 7/1985 Japan .
2202800 10/1988 United Kingdom .

*Primary Examiner*—Joseph W. Hartary
*Attorney, Agent, or Firm*—Fitzpatrick, Cella, Harper & Scinto

[57] ABSTRACT

A suction recovery device comprises a cap for covering a discharge port face of a recording head for discharging ink onto a recording medium. The cap has an ink suction port and an ink exhaust path communicating with the ink suction port. A cap direct contact member carries said cap and has a guide path communicating with the exhaust path for guiding the ink in an exhaust direction. A communicating member for communicating the guide path and exhaust path is provided on a direct contact portion where the exhaust path and guide path contact with each other. The communicating member is carried with the elasticity exhibited by at least one of the exhaust path and guide path and suction means exerts suction power on the inside of the cap through the communicating member.

56 Claims, 48 Drawing Sheets

SUCTION RECOVERY DEVICE WITH A CAP HAVING A COMMUNICATING MEMBER TO AID SUCTION

DESCRIPTION OF THE INVENTION

1. Field of the Invention

The present invention relates to a suction recovery device applicable to an ink jet recording apparatus or the like, and an ink jet recording apparatus using the device.

2. Related Background Art

Conventionally, there is typically disclosed in U.S. Pat. No. 4,600,931 a configuration in which a recording head is capped with a capping member. This patent discloses that a cap face is formed so as to come into close contact with a discharge port formation face of a head in capping the recording head with the cap.

The discharge port formation face for the conventional recording head was formed on a surface parallel to a record face of a recording medium. The cap face of the capping member was formed parallel to the discharge port formation face. This capping member was constructed of at least an elastic body abutting on or directly supported by a support member for suction recovery, with an ink exhaust path of the elastic capping member communicating with an ink guide path of the support member corresponding thereto.

Such a capping member is required to effectively exhaust the ink contained within it by using suction means. The capping member is also required to exhibit tightness in capping the recording head, but there exists a technical problem as described below.

Recently, a new recording head has appeared, in which the discharge port formation face as indicated above is inclined against the record face by a predetermined angle and is provided with a slight step near discharging ports. This creates a manufacturing and technical problem in that even if such a cap with a capping face corresponding to such a discharge port formation face were fabricated, it was practically difficult to position the cap completely due to a relationship with the positional precision between the head and the cap, resulting in a problem that it might not be tightly enclosed due to a clearance between the head and the cap caused by a misregistration therebetween.

Furthermore, there occurs a phenomenon that when the capping member is closed resulting in deformation of the cap owing to a biasing force in capping, the volume within the cap decreases to cause an increased pressure within the cap. A communicating port has been provided to avoid the meniscus regression in the discharge ports caused by this phenomenon yet it led to an additional problem that a mechanism for controlling the opening or closing of the communicating port is needed.

It was a possibility that since the recording head and the capping member are repeatedly attached to or detached from each other, in each time the capping member is repeatedly deformed elastically, with a result that the elastic characteristic is especially lowered at a direct contact portion, an escape of ink might occur at that direct contact area as above indicated, when used for a long time. Further, it has been found that the above mentioned tendency is especially high with such a configuration that the capping member is equalized so as to come into stable and direct contact with the recording head.

SUMMARY OF THE INVENTION

It is a main object of the present invention to provide a suction recovery device and an ink jet recording apparatus using the device which can resolve the above mentioned problems by simply adding a new construction to a cap and a cap direct contact member.

Another object of the present invention is to provide a suction recovery device and an ink jet recording apparatus with said device, which enables tight capping of a recording head with a discharge port formation face that is inclined and has a minute step near its discharge ports.

Another object of the present invention is to provide a suction recovery device and an ink jet recording apparatus using the device which can prevent the ink meniscus regression that occurs while capping a recording head with a cap.

Another object of the present invention is to provide a suction recovery device and an ink jet recording apparatus using the device in which an escape of ink does not occur at a direct contact area between a capping member and a cap direct contact member during repeated uses.

Another object of the present invention is to provide a suction recovery device and an ink jet recording apparatus using the device which can increase the effect of preventing an escape of ink for a long term, with a construction consisting of a cap having an exhaust path defined by an elastic member and a communicating member having an end portion not abutting the capping member and positioned within the cap downwardly in the gravitational direction, in which the ink reaching to a direct contact area is introduced to a side of the communicating member to be collected at the end portion with a great degree of freedom.

Another object of the present invention is to provide a suction recovery device and an ink jet recording apparatus using the device, which can significantly increase durability, with a construction in which the direct contact portion in a direct contact state forms a stronger pressure than that in a supporting state with a communicating member due to the elastic deformation of the direct contact portion, so that a seal acting portion in a cap acting state of the ink jet recording apparatus can be separated from the seal acting portion in a non-cap acting state.

Another object of the present invention is to provide a suction recovery device and an ink jet recording apparatus using the device which can much increase suction.

Another object of the present invention is to provide a suction recovery device and an ink jet recording apparatus using the device which can prevent the drying and attachment of dust by capping hermetically on a discharge port formation face which is inclined and provided with a step, and in which a sufficient amount of ink can be sucked by maintaining a negative pressure developed within the cap.

Another, object of the present invention is to provide a suction recovery device and an ink jet recording apparatus using the device in which as an edge portion of an elastic member Of the cap is not parallel to a discharge port formation face and the entire, edge portion does not make or lose contact with the discharge port formation face simultaneously in capping or detaching, but gradually makes or loses contact therewith, so that a large variation of pressure does not occur at the discharge port formation face.

Another object of the present invention is to provide a suction recovery device and an ink ]el recording apparatus using the device having a supporting mechanism for a capping member which can maintain an elastic characteristic for a long term.

BRIEF DESCRIPTION OF DRAWINGS

FIGS. 21, 21A-1 and 21A-2 are flowcharts showing one example of the recording procedure according to this example.

DETAILED DESCRIPTION OF PREFERRED EMBODIMENTS

Example 1

An example of the present invention will be described in detail with reference to the drawings.

Figure 1:
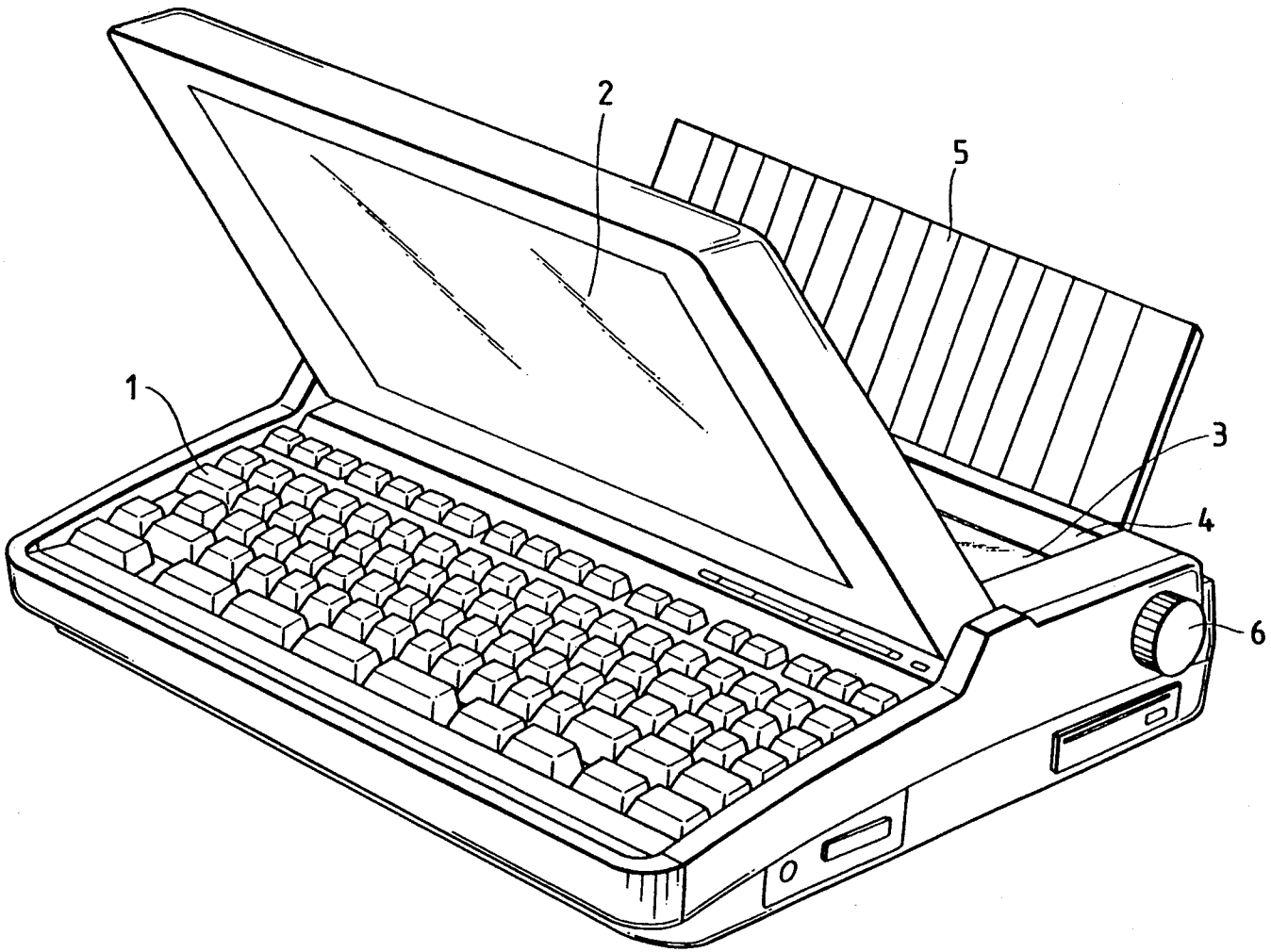
FIG. 1 is a perspective view showing a configuration of a word processor as one example of a device to which the present invention is applied.

FIG. 1 shows an external perspective view of a configuration for a document making apparatus (hereafter referred to as a word processor) to which the present invention is applicable.

Here, 1 is a keyboard portion which is an input device. 2 is a display portion for displaying an input document or the like, which is held rotatably and lapped over the keyboard portion ]when not used.

3 is a protection cover openable/closable provided on a visual opening to assure an operating state of the recording head, which is transparent or translucent. 4 is a spur cover for carrying a spur. The protection cover 3 and the spur cover 4 will be described later in connection with 6 to 8.

5 is a paper supporter against which a record paper is supported for feeding or exhausting, and 6 is a knob for feeding and exhausting the record paper manually.

Figure 2:
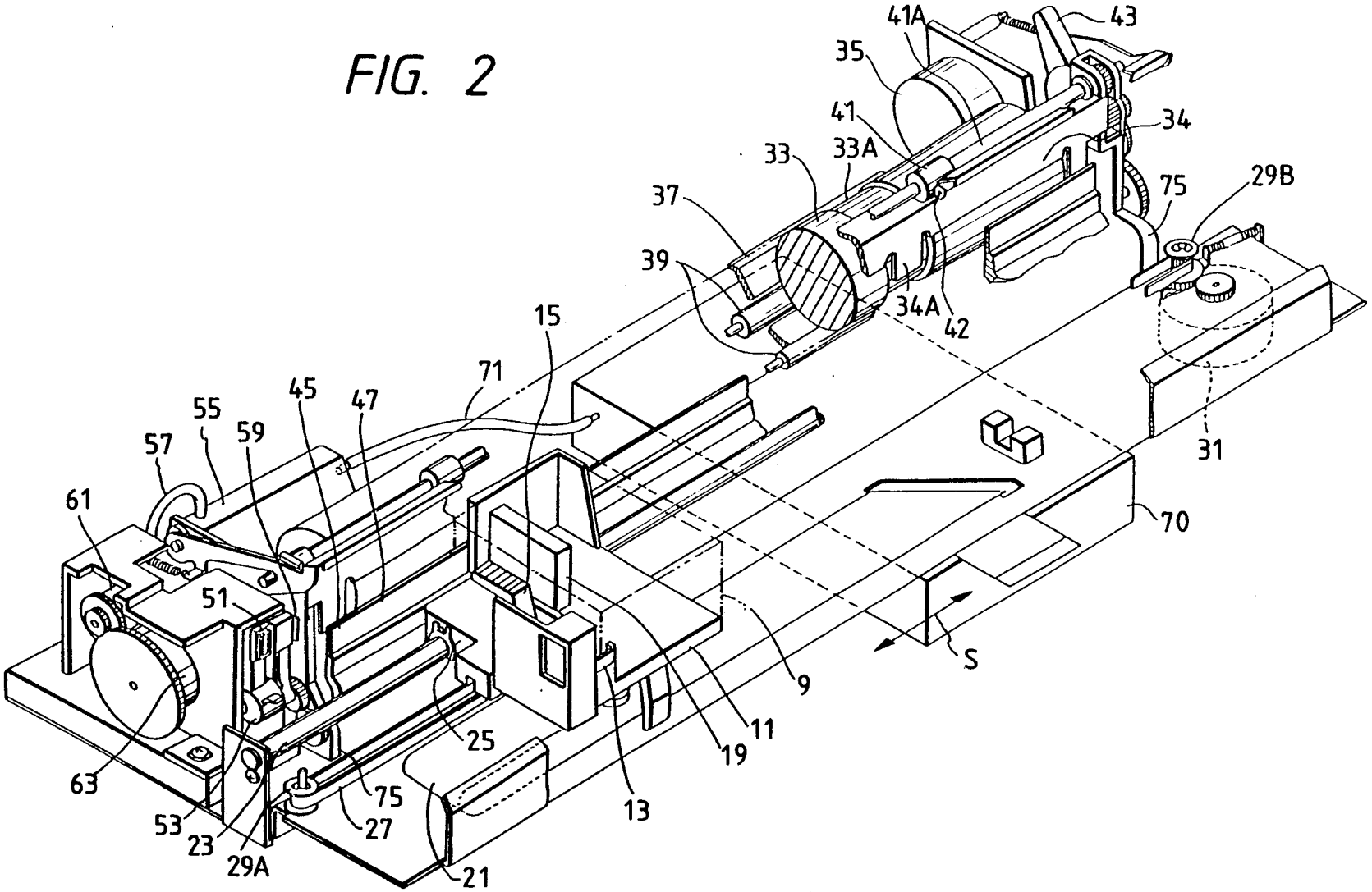
FIG. 2 is a perspective view showing one example of an ink jet recording apparatus as a printer portion thereof.

FIG. 2 shows a configuration example of a printer portion in the form of an ink jet recording apparatus according to this example.

Figure 3:
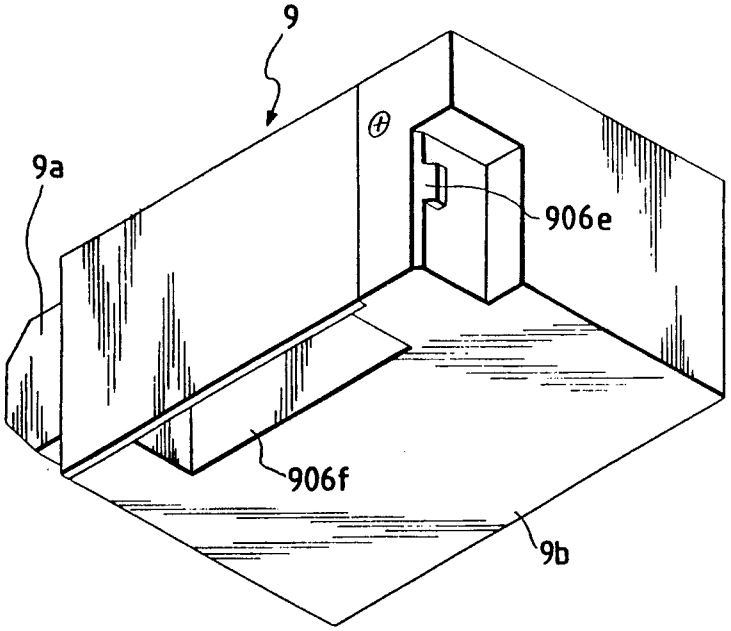
FIG. 3 is an external perspective view of a head cartridge as shown in FIG. 2.
Figure 10:
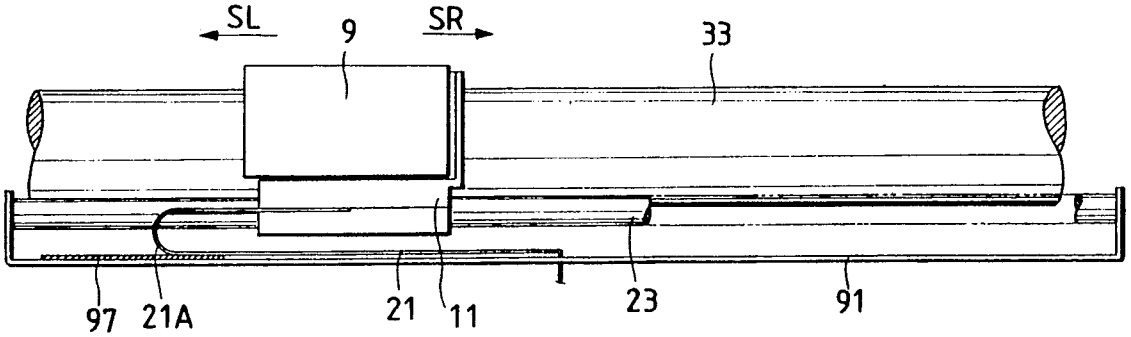
Figure 11:
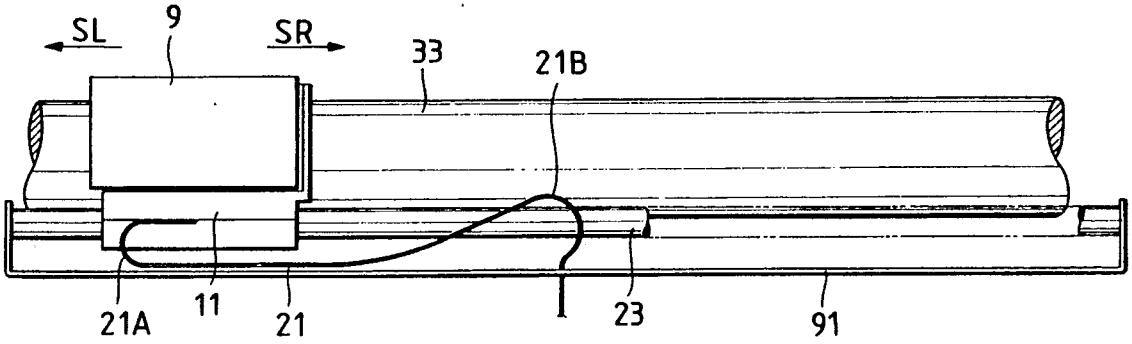
FIG. 11 is a front view of a printer portion for explanation of a FPC insert according to a conventional configuration.

9 is a head cartridge having an ink jet recording head, as will be described in detail with reference to FIG. 3 and 4, and 11 is a carriage for mounting the head cartridge 9 and scanning in the S direction in the figure. 13 is a hook for attaching the head cartridge 9 onto the carriage 11, and 15 is a lever for operating the hook 13. 19 is a support plate for supporting an electrical connection to the head cartridge 9. 21 is an FPC for connecting between the electrical connection and a control section of main body. A configuration associated with the FPC will be described with reference to FIGS. 9 to 11.

23 is a guide shaft for guiding the carriage 11 in the S direction, which is inserted through bearings 25 of the carriage 11. 27 is a timing belt for transmitting a power to move the carriage 11 fixed thereto in the S direction, passing under tension about pulleys 29A, 29B arranged on both sides of the apparatus. One pulley 29B is supplied with a driving force transmitted via a transmission, e.g. a gear, from a carriage motor 31.

33 is a conveying roller for conveying a recording medium, e.g. a paper (hereafter referred to as a recording paper) on recording, as well as regulating a record face of the recording medium, and it is driven by a conveying motor 35. 37 is a paper pan for guiding the recording medium from the paper supporter 5 to a recording position, and 39 is a feed roller, disposed on a way of feed path for the recording medium, for biasing the recording medium toward the conveying roller 33 to convey it. 34 is a platen for regulating the record face of the recording medium, which is opposed to discharge ports of the head cartridge 9. 41 is a paper exhausting roller for exhausting the recording medium to a paper exhausting port, not shown, which is disposed downstream from the recording position in the direction of conveying the recording medium. 42 is a spur provided correspondingly to the paper exhausting roller 41, for pressing the roller 41 Via the recording medium, and developing a force for conveying the recording medium with the paper exhausting roller 41. 43 is a release lever for releasing the energizing state for each of feed roller 39, presser bar 45, and spur 42, when setting a recording medium.

A platen 34 has both ends rotatably supported on an axis of the paper exhausting roller 41, energized from a stop position of left and right plates 75, 75 toward a front portion 45 of the paper pan 37, with a portion 33A of the platen roller 33 rendered smaller than the most external periphery and 34A provided on a plurality of locations in the portion 33A abutting on the inside of the front portion 45 of the paper pan, when there is no recording paper.

51 is a cap made of an elastic material, e.g. rubber, which is placed opposite to an ink discharge port formation face of the recording head in a home position, and supported therein to be able to attach to or detach from the recording head. The cap 51 is used for protecting the recording head when it is not used, or in a discharge recovery processing for the recording head. The discharge recovery process is such a processing that the cap 51 is placed opposed to the discharge port formation face, and the ink is discharged from the whole discharge ports by driving energy generation elements provided inwardly of the ink discharge ports and used for the ink discharge, to remove discharge faulty factors, such as bubbles, dusts, or thickened ink not suitable for recording (predischarge), or otherwise, to remove discharge faulty factors by forcedly discharging the ink from the discharge ports on the discharge port formation face covered with the cap 51.

53 is a pump used to suck the ink received within the cap 51 in the suction recovery process for the forced discharge or predischarge, or to exert a suction force for the forced discharge of ink. 55 is a first waste ink tank for reserving waste ink sucked by the pump 53, and 57 is a tube communicating between the pump 53 and the waste ink tank 55. 70 is a second waste ink tank, which is connected to the first waste ink tank 55 via a tube 71.

59 is a blade for wiping the discharge port formation face of the recording head, which is movably held between a position where it projects toward the recording head for wiping during the movement of head and a retracted position where it does not engage the discharge port formation face. 61 is a motor, and 63 is a cam mechanism for driving the pump 53 and moving the cap 51 and the blade 59, with the power transmitted from the motor 61.

Next, the above mentioned head cartridge 9 will be described in detail.

FIG. 3 shows a perspective view of the head cartridge 9 integral with a discharge unit 9*a* that is an ink jet recording head body and an ink tank 9*b*, where 906*e* is a click engaged by a hook 13 on the carriage 11 in attaching the head cartridge 9. As clearly shown, the click 906*e* is disposed within a whole extension of the recording head. Near the discharge unit 9*a* in front of the head cartridge 9 is provided an abutting portion for positioning, not shown. 906*f* is a head opening section into which a support plate stood on the carriage 11 for supporting a flexible substrate (electrical connection portion) and rubber pad is inserted.

Figure 4B:
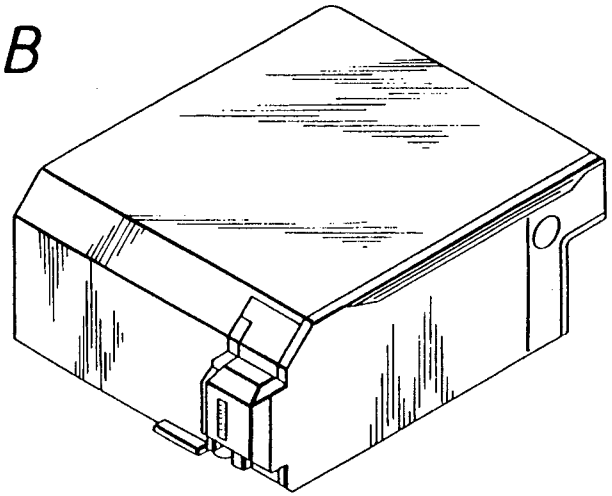
FIGS. 4A and 4B are an exploded perspective view and an external perspective view of the head cartridge as shown in FIG. 3, respectively.
Figure 4C:
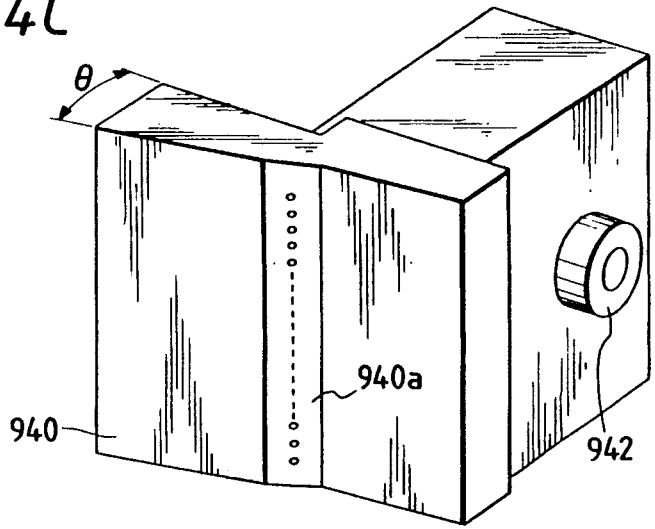
FIG. 4C is a perspective view showing a configuration example of a recording head roof plate as shown in FIG. 4A.
Figure 4A:
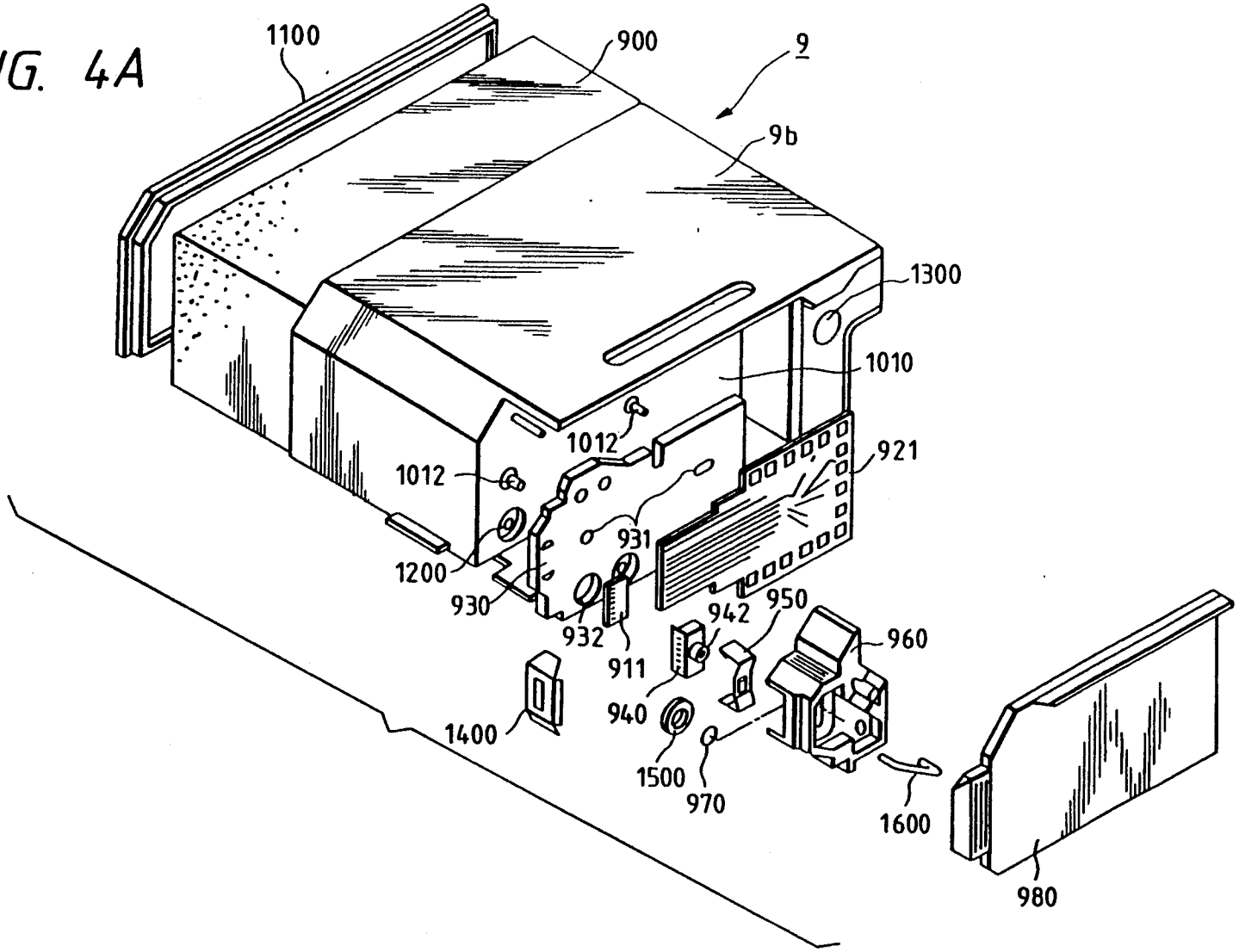

FIGS. 4A and 4B respectively show an exploded perspective view and an external perspective view cartridge as shown in FIG. 3, which is of a disposable type integrated with an ink storage section which is a supply source of ink, as described above.

In FIG. 4A 911 is a heater board comprising an electricity heat conversion element (discharge heater) and a wiring made of Al or the like for supplying the electric power to it which are formed on a silicone substrate with the film technique. 921 is a wiring substrate for the heater board, the corresponding wirings being connected in a wire bonding method, for example.

940 is a roof plate provided with a diaphragm for restricting an ink flow path and a common liquid chamber, made of a resin material integrated with an orifice plate section in this embodiment. As shown in FIG. 4C, the discharge port formation face is inclined by a predetermined angle $\theta$ with respect to a plane parallel to a record face of recording paper, and has a step 940*a* in the vicinity of discharge ports. This was made corresponding to a predetermined angle between a flow path within an orifice plate portion- and a back flow path therefrom, due to the machining of the discharge ports which are radiated with the laser beam from the flow path provided on the roof plate.

930 is a carrier made of, for example, metal, and 950 is a presser spring, between which are engagingly carried the heater board 911 and the roof plate 940, to thereby tightly fix them with an energizing force of the presser spring 950. It should be noted that the carrier 930 is pasted with the wiring substrate 921, and has a positioning reference to the carriage 11 for scanning with the head. The carrier 930 also functions as a cooling member for radiating the heat on the heater board 911 generated by driving.

960 is a supply tank, which functions as a subtank for receiving ink from an ink storage 9*b* which is an ink supply source and for conducting ink into the common liquid chamber formed by the joint of the heater board 911 and the roof plate 940. 970 is a filter disposed in a position within the supply tank 960 near an ink supply port into the common liquid chamber, and 980 is a lid member for the supply tank 960.

900 is an absorbing member for impregnating the ink, disposed within the ink tank body 9*b*. 1200 is a supply port for supplying the ink to a discharge unit 9*a* comprising each of portions 911–980 as above indicated, for allowing the impregnation of ink into the absorbing member 900 by injecting the ink through the supply port 1200, in a process before this unit is placed on a portion 1010 of the ink tank body 9*b*.

1100 is a lid member for the cartridge body, and 1300 is an atmosphere communicating port provided on the lid member for communicating the inside of the cartridge to the atmosphere.

After the ink has been filled via the supply port 1200 into the ink tank 9*b*, the discharge unit 9*a* consisting of each of the portions 911–980 is positioned and disposed on the portion 1010. The positioning or fixing at this time can be performed, for example, by fitting a projection 1012 on the ink tank body 9*b* into a corresponding hole 931 on the carrier 930, thereby resulting in the complete head cartridge, 9 as shown in FIG. 4B.

The ink is supplied from the inside of the cartridge through a supply port 1200, a hole 932 on the carrier 930 and an inlet port on the back side of the supply tank 960 as shown in FIG. 4A into the supply tank 960, and after passing through the inside of the supply tank 960, flows out of an outlet port through an appropriate supply tube and an inlet port 942 on the roof plate 940 into the common liquid chamber. At the connections for communicating ink as indicated above, packings such as silicone rubber or butyl rubber are disposed, thereby sealing those connections to secure the ink supply path.

Figure 5:
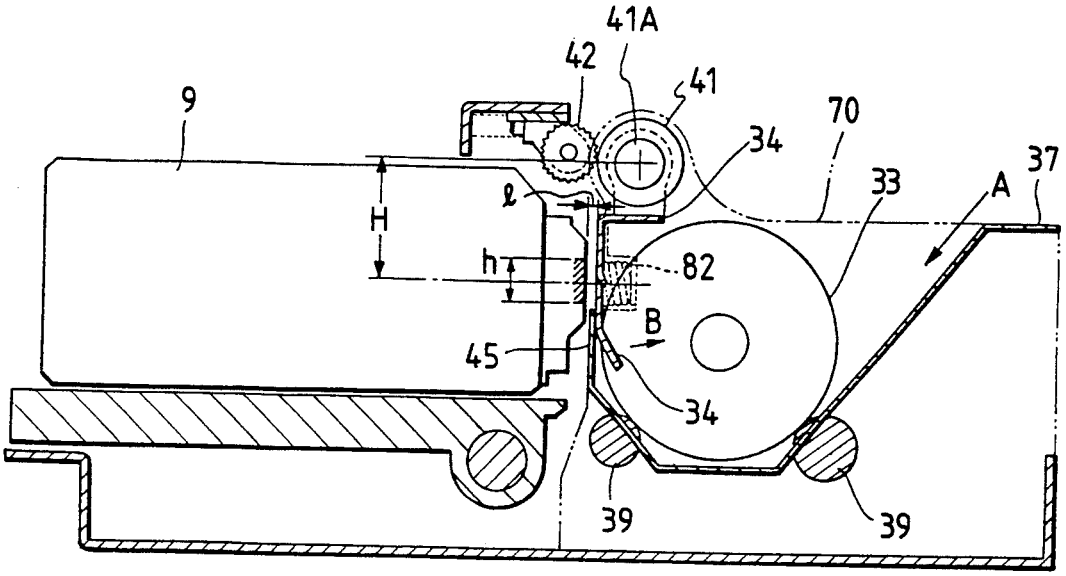
FIG. 5 is a cross-sectional side view of a printer portion for explanation of head gap adjustment means involved in this example.

FIG. 5 is a cross-sectional view of FIG. 2, which shows in more detail the configuration and action of the platen 34 and the paper pan front portion 45.

A distance 1 (head gap) between discharge ports of the head cartridge 9 and a front face of the platen 34 is adjusted to be optimal for printing.

With such a configuration, a recording paper inserted from the A direction is forced toward a roller 33 by the feed roller 39, and fed with the friction force thereon. A leading end of the recording paper is entered between a rake portion 34A of the platen 34 and an inside of the paper pan front portion 45 by rotating the platen 34 about a shaft 41A as a central rotational axis in the B direction against a force of springs 82 (provided on both sides). Note that the front portion 45 has a properly adjusted and fixed clearance with the discharge port formation face.

Accordingly, a recording paper on the platen 34 can maintain an optimal head gap with the discharge ports of the head cartridge 9 because the platen 34 retracts in the B direction depending on the thickness of paper.

On an extension line from a front face of the platen 34 is located a contact point between an exhausting paper roller 41 and a spur 42 even when the platen 34 retracts in the B direction depending on the thickness of a recording paper, whereby a leading end of the recording paper can be easily entered between the exhausting paper roller and the spur 42. A difference between the head gaps above and below a recording portion h due to the inclination of the platen 34 is negligible because of a large distance H between a rotational center of the platen and a print center.

Note that the platen 34 is not necessarily on the same axis as for the roller 41. The front portion 45 does not have to be integrally shaped with the paper pan 37, but may be one that is fixed by an adhesive or a screw. It may also be constructed separately and fixed to the other portion of apparatus.

Figure 6:
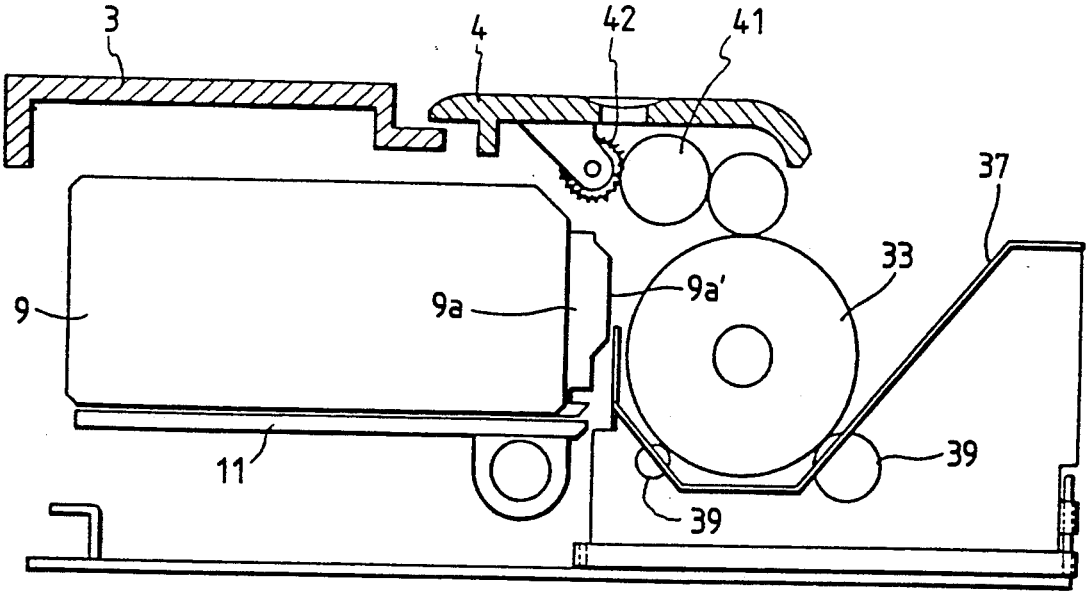
FIG. 6 is a cross-sectional side view of a printer portion for explanation of a spur cover and a visual window involved in this example.

FIG. 6 is a schematic cross-sectional view of a printer portion with a head cartridge 9 mounted and comprising a spur 42, a spur cover 4 and a protect cover 3 containing a visual opening. As seen in this figure, the spur cover 4 is overhung over an upper portion of the head cartridge 9 to form a spur fixing portion.

Accordingly, if the cover 3 is transparent or translucent, the operation of the head cartridge 9 can be visualized with the cover attached, and it is strongly desirable to ensure visually an ink discharge portion 9*a*′ of discharge unit 9*a* in a capping position.

Figure 7:
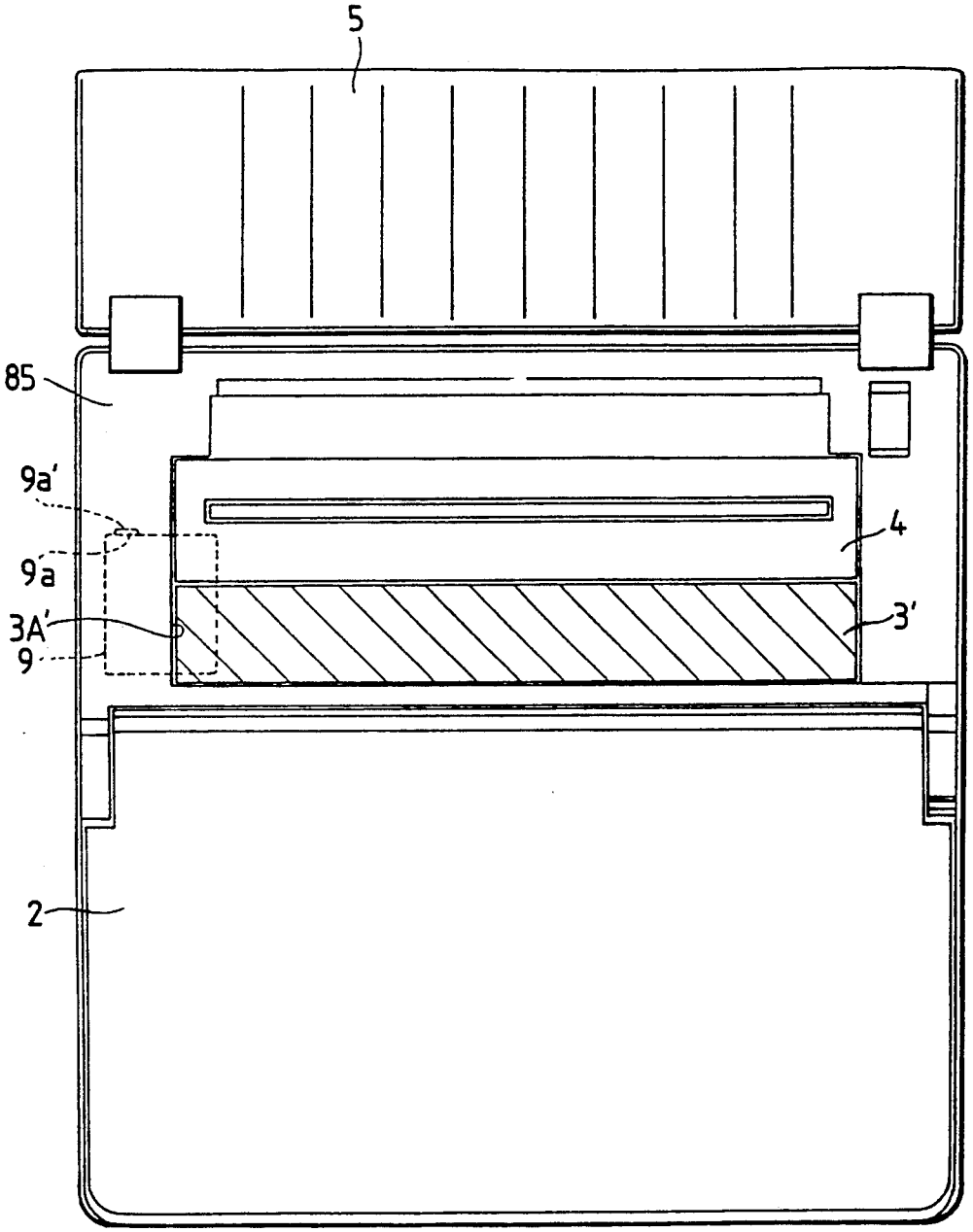
FIG. 7 and FIG. 8 are upper views of a printer portion for explanation of a spur cover and a visual window involved in a comparative example and this example, respectively.

However, in a configuration as shown in FIG. 7, it is impossible to ensure visually that unit 9*a* is in a capping position. That is, in the same figure, a broken line portion shows a waiting position for the head cartridge 9 in the capping state, in which it is off a paper passing position for a recording medium. As an outer facing member 85 except for an ordinary visual opening 3A′ is constructed of an opaque mold material, it is impossible to ensure visually a position of the head cartridge 9 or the discharge unit 9*a* and the ink discharge portion 9*a*′ in the capping state. It is also impossible to ensure visually the ink discharge portion 9*a*′ and so on by simply widening the visual opening 3A′ in the direction of width.

Figure 8:
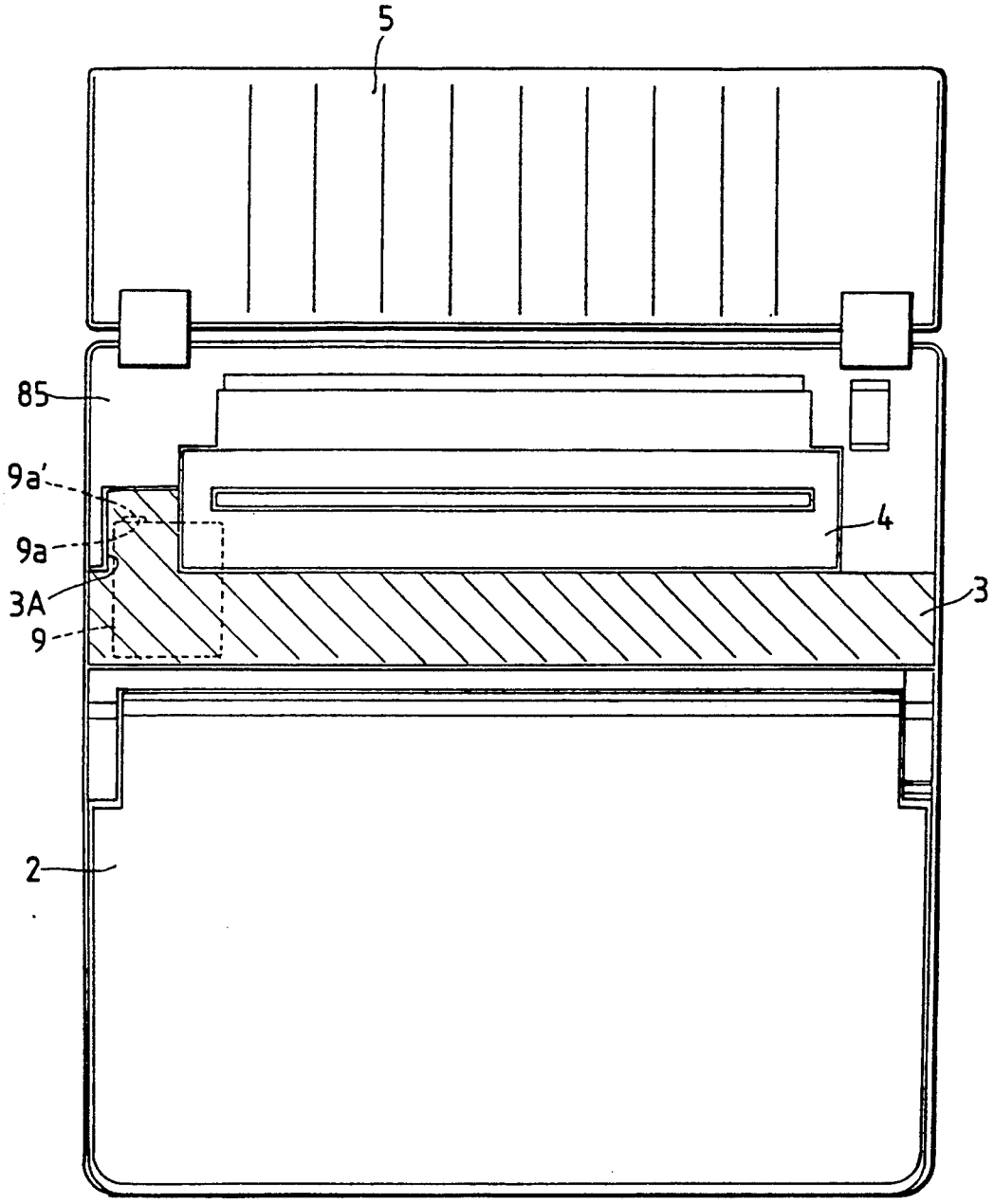

On the contrary, in a configuration of FIG. 8 that was adapted in this example, the ink discharge portion 9*a*′ can be also ensured visually, by forming the visual opening 3A in a L-shaped form covering an upper portion of the ink discharge portion 9*a*′, as well as widening the visual opening 3A in the direction of width.

In this example, a cover member 3 is provided on the visual opening 3A, to protect the inside of the device such as the head cartridge 9. This cover member 3 may be made of various materials, and by making it transparent or translucent, it is possible to make a visual observation of the capping in the capping state.

However, if the opening 3A can be opened immediately as required, with a configuration where the cover member 3 can be opened or closed or easily attached or detached, it does not necessarily have to be transparent or translucent.

Next, a configuration associated with FPC21 as above shown will be more specifically described in the following.

Figure 9:
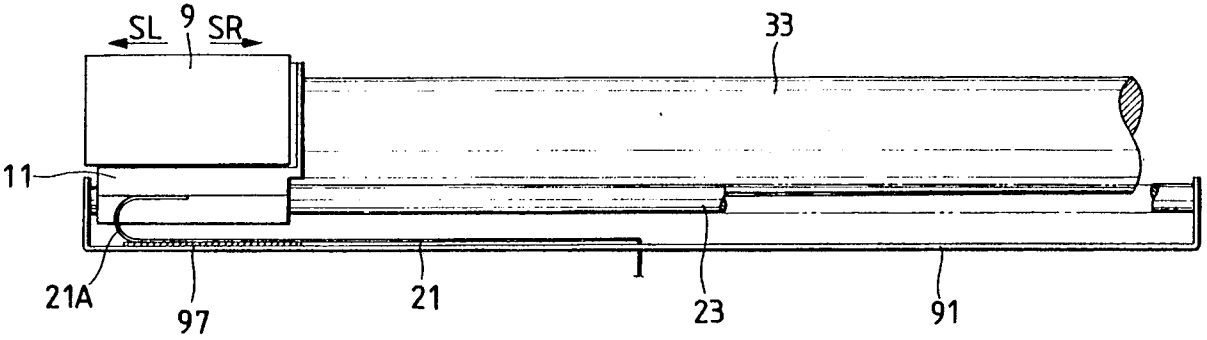
FIG. 9 and FIG. 10 are front views of a printer portion for explanation of FPC insert protecting means involved in this example.

FIG. 9 and FIG. 10 are schematic front views of a recording apparatus involved in this example, and FIG. 11 is a schematic front view of a recording apparatus of the comparative example.

In FIG. 9, left and right frames 75 (not shown in FIG. 9) stood from a frame 91 of the recording apparatus is provided with a roller 33 extending left and right, and in front of the roller 33 is also fixed a guide shaft 23, over which a carriage 11 is provided in a state of slidably moving left and right, and a head cartridge 9 is mounted on the carriage 11, as previously described.

The carriage 11 is provided with FPC21 fixed for connecting electrically a control circuit not shown and the head cartridge 9 via a connector portion provided thereon. FPC21 has the other end fixed to the frame 91.

Furthermore, a friction sheet 97 is provided between FPC21 over the frame 91 and the frame 91 and near a location at which FPC21 forms a minimum radius. The friction sheet 97 has adhesives applied on one side, with which it is joined to the frame 91.

With such a configuration, the carriage 11 moves on a conveying roller 33 in the SR direction as indicated by an arrow SR by driving means such as a motor 31 or the like. Then a recording signal is transmitted from the control portion via FPC21 to the discharge unit 9*a* of the head cartridge 5 mounted on the carriage 11. And the discharge unit 9*a* discharges the ink onto a recording paper in accordance with that signal, to carry out the recording. After One line of record has been completed, the carriage 11 stops, and the roller 33 is driven and rotated by driving means such as motor 35, which causes the recording paper to be subscanned.

Thereafter, the carriage 11 moves in the SL direction as indicated by an arrow SL, to accomplish the next recording.

FIG. 10 shows the movement as above indicated, in which as in this example, the friction sheet 97 is provided on the frame 91, a friction force will occur between FPC21 and the friction sheet 97, so that an arc portion 21A of FPC21 moves correctly without sliding with the frame 91, and hence is not rolled into a bottom portion of the carriage 11.

On the contrary, with a configuration without a friction sheet, a sliding will occur between FPC21 on a bottom portion of the carriage 11 and the frame 1, which results in a slack 21B on a portion over FPC21, and if the carriage 11 further moves in the right direction (SR direction) in this state, there occurs a fear that FPC21 may be rolled into the carriage 11.

As described above, according to this example, by making a simple configuration of providing a high friction coefficient member (friction sheet 97) on the frame 91 of recording apparatus, the running of FPC21 can be stabilized, thereby the height of FPC running portion can be reduced, and so a compact and light weight recording apparatus can be provided.

It should be noted that the friction sheet 97 is made of, for example, a sheet material of silicone.

In the above explanation, the connection between the head cartridge 9 and the control circuit was made with FPC, but it is not limited to FPC, and it can be of course accomplished by all electrical connection members such as a flat cable or bundle wire.

Figure 12:
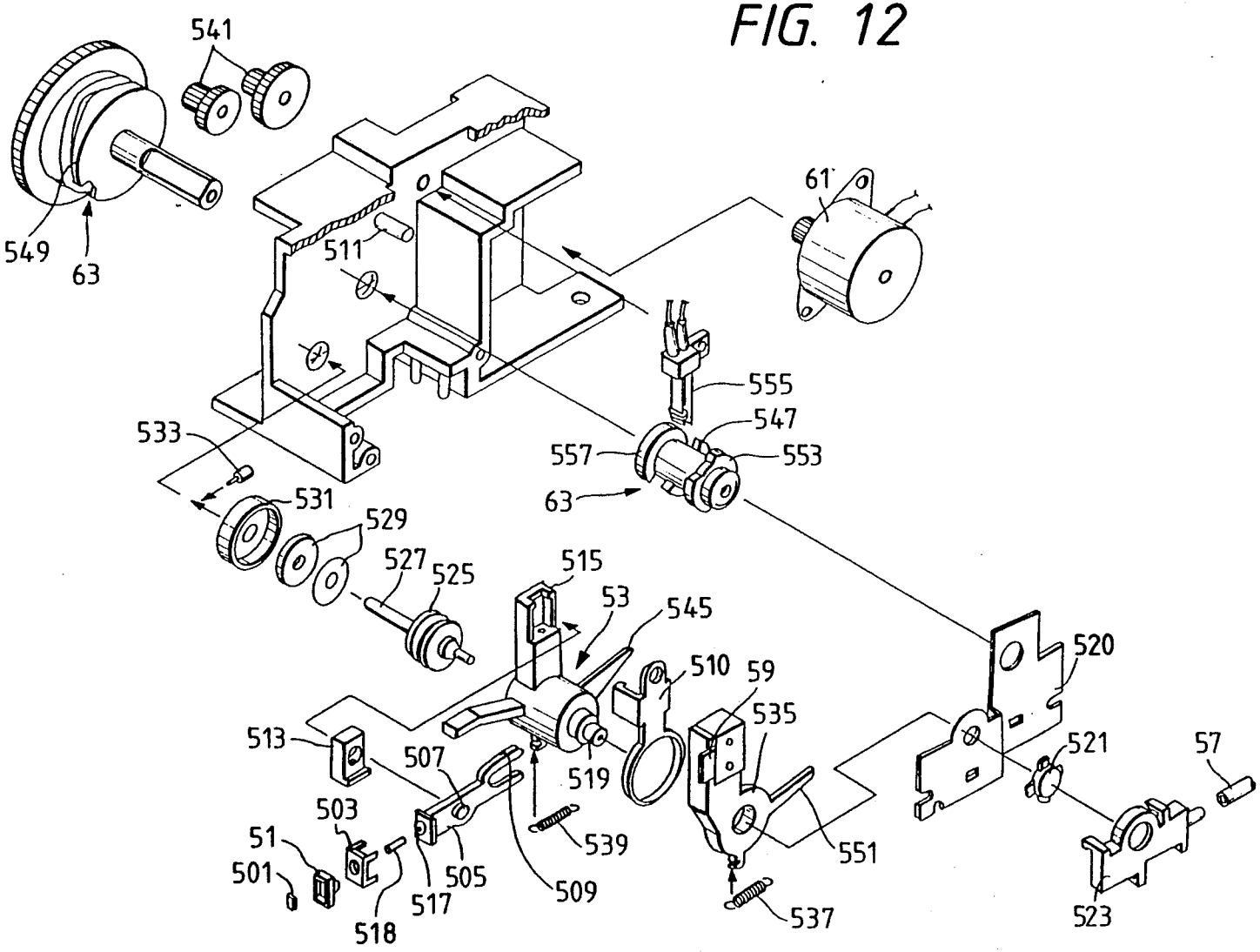
FIG. 12 is an exploded perspective view of a suction recovery device as shown in FIG. 2.

FIG. 12 is an exploded perspective view showing a main portion of the recovery device comprising a cap 51, a pump 53, a blade 59, a motor 61 and a cam mechanism 63 as shown in FIG. 2.

501 is an ink absorbing member disposed in the inside of the cap 51, 503 is a holding member for holding the cap 51, and 505 is a cap lever rotatably mounted around a pin 507, for attaching the cap 51 to or detaching it from a discharge port formation face of the discharge unit 9*a* with a force applied to the pin 507. 511 is a pin for regulating the range of rotation for the cap lever 505, by being engaged with an end portion 509 of the cap lever 505.

513 is a jig having a hole, into which the pin 507 of the cap lever 505 is fitted, which is used to attach the cap lever 505 onto a support 515 on the pump 53. 516 is a stop member for securing the attached state. 517 is a working section for exerting on the cap the force for bringing the cap 51 into direct contact with the discharge port formation face, which is engaged almost centrally in a back side portion of the cap 51. The working section is provided with an inlet port 517C for sucked ink, and ink flow paths are formed inside the cap lever 505, the pin 507, the jib 513, and the carrier 515.

The cap 51 is supported on a cap holder 503, with the working portion with the cap lever 505 being configured to be spherical and to be rotatable in all directions. When abutting on the recording head, it follows the shape thereof. If the pump 53 exerts the suction force, the ink is passed through these flow paths into the pump 53 as indicated by an arrow in the figure.

518 is a tube made of an elastic material such as silicone rubber, which is attached to communicate between a hole portion (ink flow path) provided on the working section 517 of cap lever 505 onto the cap 51 and the ink flow path within the cap 51.

519 is a shaft projecting from a center of end face of the pump 53 and internally formed with an ink flow path, and is rotatably attached on the side wall 520. The rotation force of the pump 53 itself is thereby applied via the support 515 onto the cap lever 505, so that the cap 51 moves outward or inward. 521 is a flow path formation member connected to the pump shaft 519, and 523 is an attachment member for a tube 57. That is, ink flow paths are formed in the inside of the shaft 519, the flow path formation member 521 and the attachment member 523, in which the ink sucked by the pump 53 is introduced through those flow paths via the tube 57 into a waste ink tank 55, as indicated by an arrow in the figure.

525 is a piston for the pump 53, 527 is a piston shaft, 529 is a packing, and 532 is a cap of the pump 53. 533 is a pin attached to the piston shaft 527 and for receiving the transmitted force activating the piston 525.

535 is a blade lever to which the blade 59 is attached, rotatably supported around an axis projecting from the end face of the pump 53, and it projects or retracts the blade 59 toward or from the recording head side, respectively, along with the rotation. 537 is a spring for affording a rotational force to the blade lever 535 in the direction of projecting the blade 59. And 539 is a spring for affording a tendency to rotate the pump 53 itself in the direction in which the cap 51 moves toward the recording head.

541 is a gear train for transmitting the rotation of the motor 61 to the cam mechanism 63, which comprises a cam 547 for engaging and rotating an engaging portion 545 on the pump 53, a cam 549 for engaging a pin 533 on the piston shaft 527 of the pump 53 and activating the pump, a cam 553 for engaging and rotating an engaging portion 551 on the blade lever 535, and a cam 557 for engaging a switch 555 for detecting a home position of the cam mechanism 63. The operations of those cams will be described later.

Figure 13B:
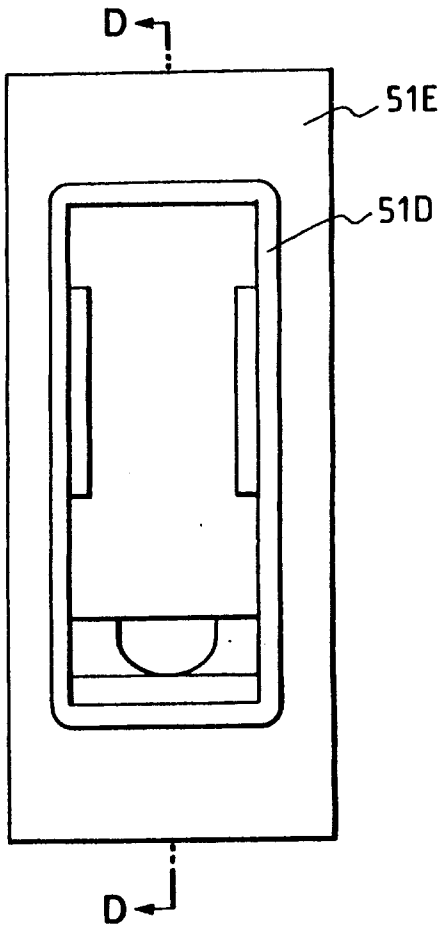
FIG. 13B is a front view of the cap as shown in FIG. 13A.
Figure 13A:
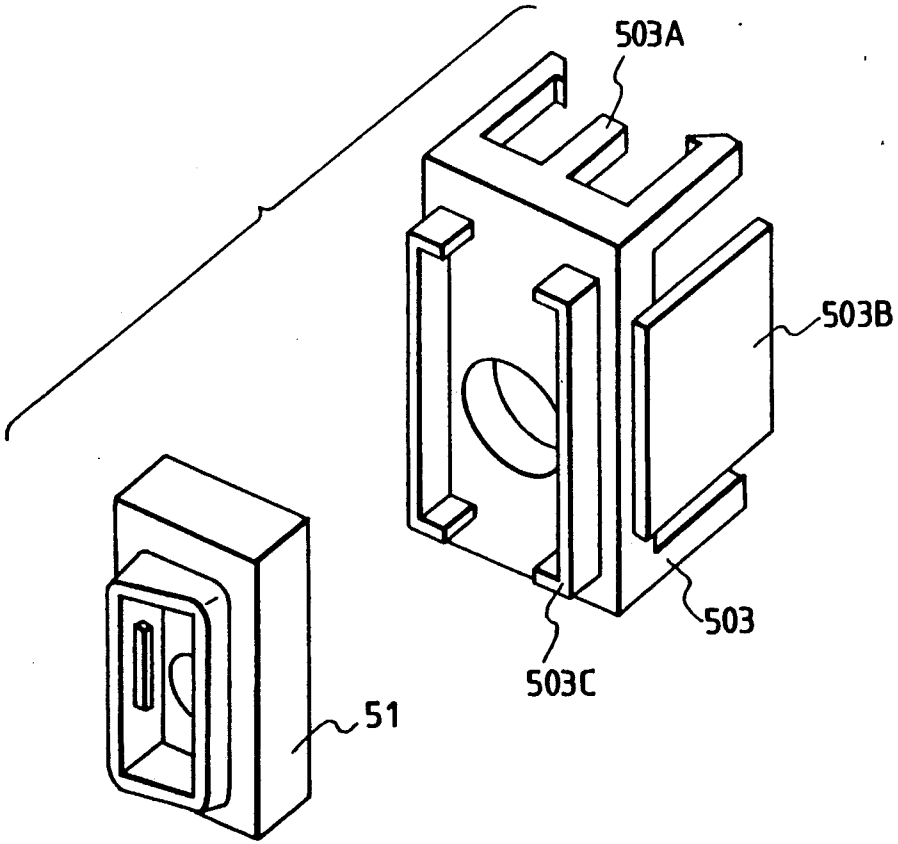
FIG. 13A is a perspective view of a cap for a suction recovery device according to one embodiment of the present invention.

FIG. 13A is a perspective view showing details of the cap 51 and the holder 503.

The cap 51 involved in this example is formed of a rubber-like elastic body so as to provide a better sealing property with an orifice plate portion of roof plate 940, and is made contact by pressure with the orifice plate portion of the roof plate with a biasing force ranging from about 60 g to about 80 g. And a leading end of rib portion, or a face of the cap 51 opposed to a discharge port formation face, is formed to be parallel in this example, in correspondence with an inclination angle $\theta$ as above described (see FIG. 4C), and having a trapezoidal cross section where a leading edge is narrowed and a base is made thicker to follow a step at the discharge ports.

In correspondence with the angle $\theta$, in order to prevent a lateral sliding when pressed against the roof plate 940, ribs 503B and 503C are provided on the cap holder 503. That is, they are adapted to prevent the deformation of the rubber cap itself with the rib 503C, and also prevent all of the cap 51 and the cap holder 503 from directing away from an attachment face of the cap lever 505, by means of the rib 503B.

Here, the roof plate 940 of the head is not horizontal with respect to a record face of the recording medium, or at right angles to the biasing direction of the cap, as previously described in FIG. DC, but makes a fixed angle $\theta$ ($\theta=5°$) in this example) with respect thereto, and has a minute step (about 0.2 mm in this example). In addition, a stop position of the carriage 11 may yield a predetermined amount of drift (e.g. about +0.5 mm) from the aimed position, when a step motor is used as the carriage motor 31.

In order to follow the shape of an orifice plate portion of the roof plate 940, a leading rib 51D is preferably small and locking hardness, while requiring a certain degree of strength to withstand a negative pressure occurring during suction and to retain a tight closeness thereof. As the orifice plate portion of the roof plate 940 has an angle $\theta$, a force will be exerted On the rib 51D of the cap 51, causing the rib to slide laterally, Whereby there is a problem of permanent set which may occur when left for a long term.

FIGS. 13A to 13E show an example according to this embodiment.

FIG. 13A is a perspective view of a cap portion.

Figure 13C:
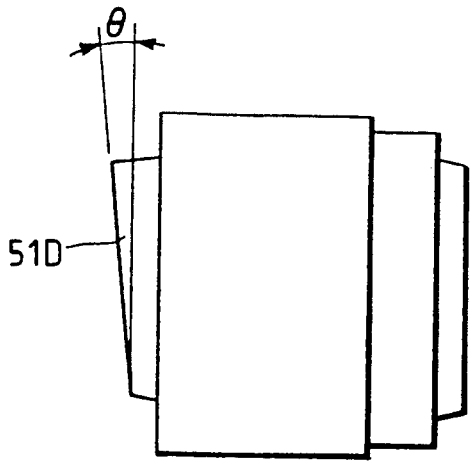
FIG. 13C is a plan view of the cap as shown in FIG. 13A.
Figure 13D:
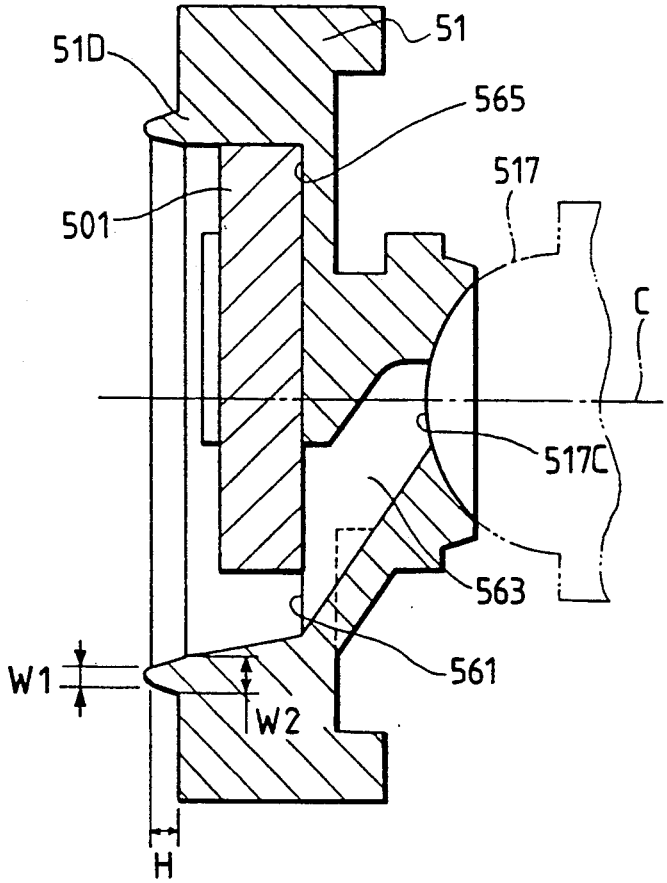
FIG. 13D is a cross-sectional side view taken along a line D—D in FIG. 13B.
Figure 13E:
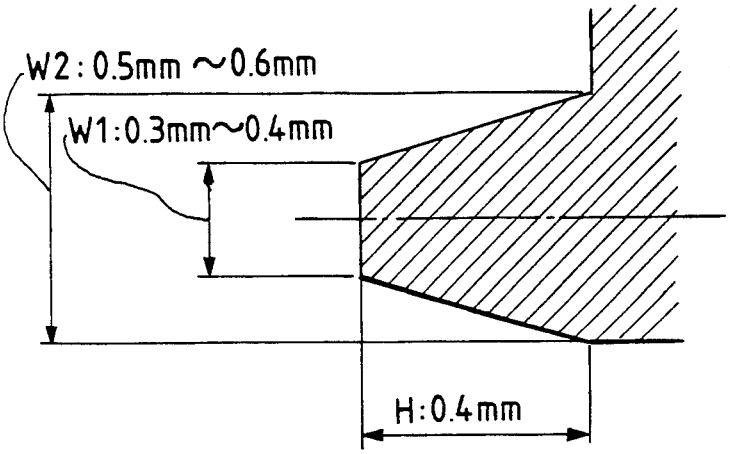
FIG. 13E is a view showing a cross-sectional outline of a leading end portion of a rib for the cap.

FIG. 13B is a front view of a cap 51, FIG. 13C is a plan view of the cap 51, and FIG. 13D is a cross-sectional side view taken along a line D—D of FIG. 13B. FIG. 13E is a view showing a cross section of a rib leading edge portion.

In view of the above mentioned problem, the shape of the rib 51D is selected in this example as follows. That is, the above problem was resolved with W1=about 0.3 mm−0.4 mm, W2=about 0.5 mm−0.6 mm in FIG. 13D, and the hardness of rubber being 60° (in accordance with JIS K6301 A scale).

That is, with a trapezoidal narrow leading edge portion being deformed, even if there are some irregularities, or a minute step 940*a* on the roof plate 940 of the head, the tight closeness can be ensured in capping. Furthermore, due to a strong nerve at the trapezoidal thick base, a lateral sliding can be prevented when the cap 51 is biased against the roof plate 940 with an inclination angle $\theta$ to the capping direction. In capping, the inside of the cap 51 is placed in a reduced pressure state of 0.4 to 0.7 atm, due to the suction by suction means, but the strong nerve of the trapezoidal cross-sectional rib base can retain the capping air-tight against the force caused by an air pressure difference from the external atmospheric pressure.

At the same time, as a peripheral portion 51E of the rib is sufficiently large with respect to a shape of the rib, the above effect can be more reliably obtained, for example, by making the width for the peripheral portion 51E of the rib greater than 2 to 3 mm, and the thickness greater than 2 to 3 mm.

It should be noted that a rubber in use for the cap is any of a butyl rubber, chlorinated butyl rubber, and silicone rubber.

By the way, the discharge port formation face does not necessarily have to be parallel to a face which an edge section of the rib portion forms.

Figure 13F:
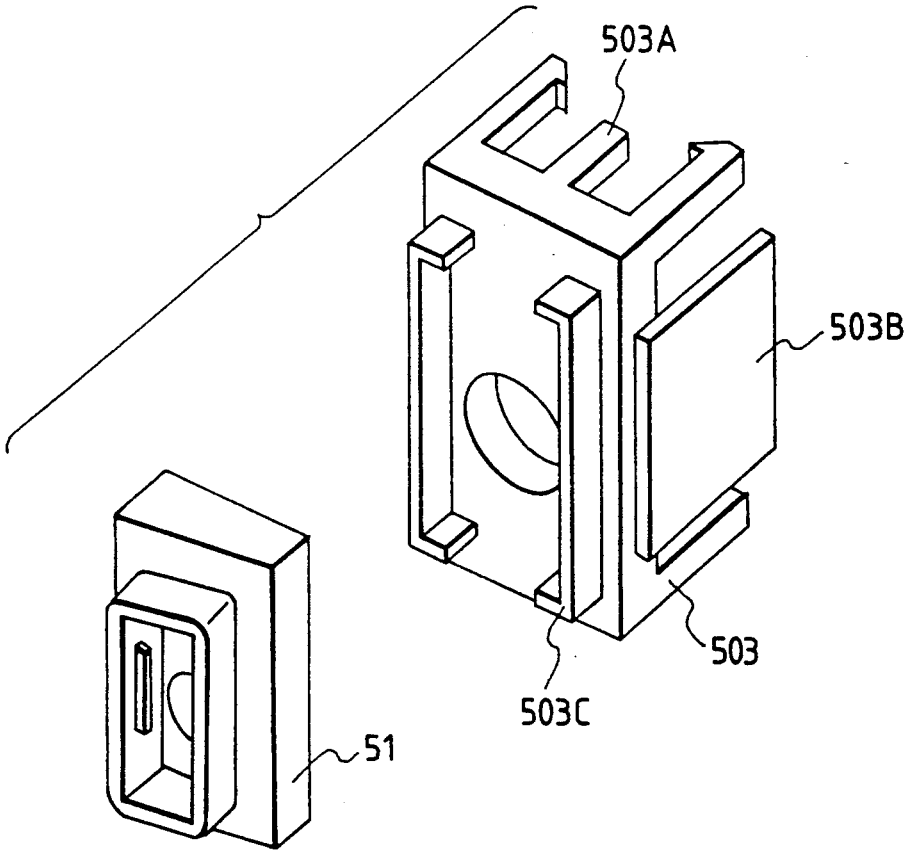
FIGS. 13F to 13H are perspective views of a cap for a suction recovery device according to another embodiment of the present invention.
Figure 13G:
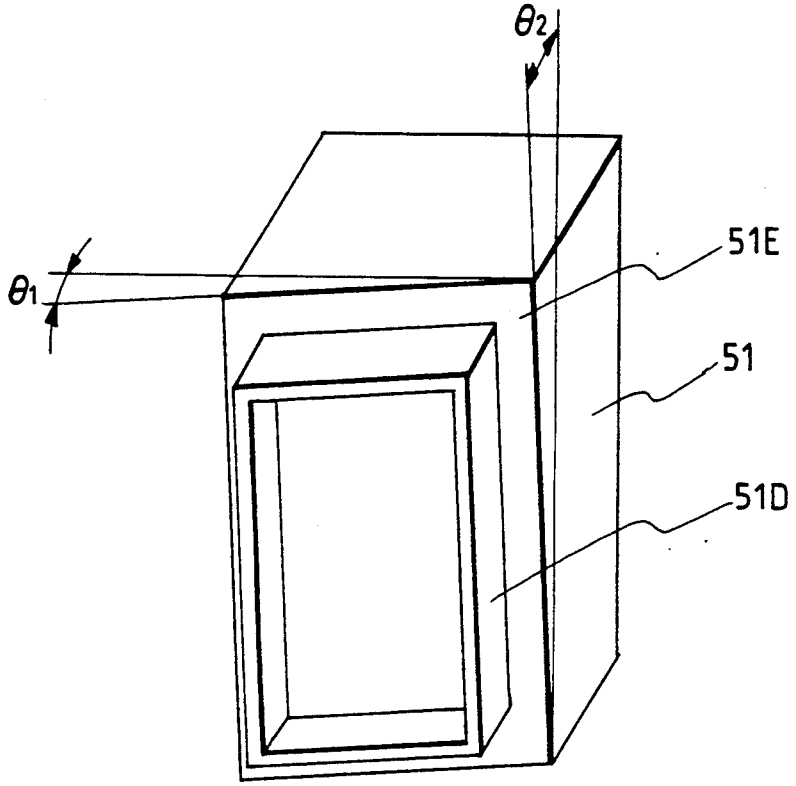
Figure 13H:
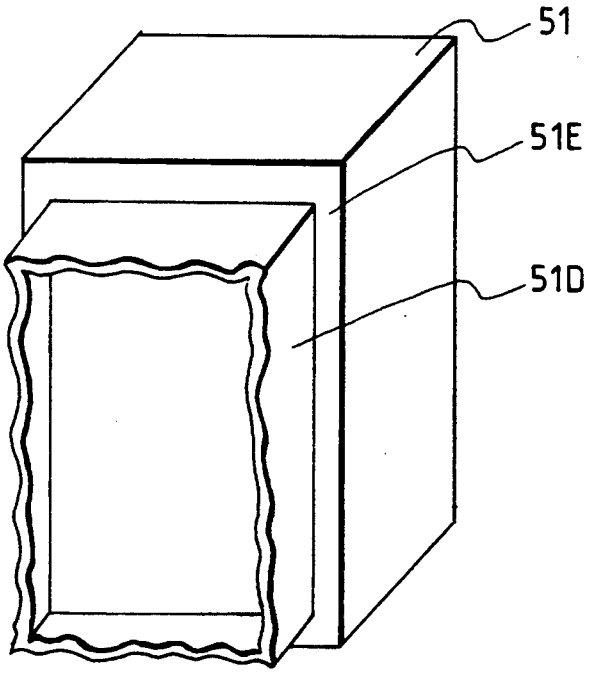

Such another embodiment is shown in FIGS. 13F to 13H.

FIG. 13F is a perspective view of the cap portion with a face of the cap 51 opposed to the discharge port face being inclined, FIG. 13G is a perspective view of the cap with a face of the cap 51 opposed to the discharge port face being inclined laterally by $\theta_1$ and vertically by $\theta_2$, and FIG. 13H is a perspective view of the cap formed With irregularities at the rib edge portion toward the discharge port direction.

When they are parallel, the edge portion simultaneously makes or loses contact with the discharge port formation face in attaching/detaching the cap 51, so that there is a fear that the ink meniscus within the discharge ports may not be retained properly because a large pressure fluctuation may occur instantaneously in a sealed space with the cap 51. That is, by making them non-parallel, the edge section gradually comes into contact with the discharge port formation face until the entire portion is tightly closed. In opening the cap, the edge section is gradually separated until the complete detachment is accomplished.

In this way, the cap configuration as previously described is not necessarily applied only to a discharge port formation face as shown in FIG. 4C. That is, the above cap configuration is also applicable to the discharge port formation face formed parallel to a record face of a recording medium, for example.

A plane which an edge portion forms can take an appropriate direction. Further, it is not necessarily a plane, but may be provided with irregularities on the edge portion.

Figure 14B:
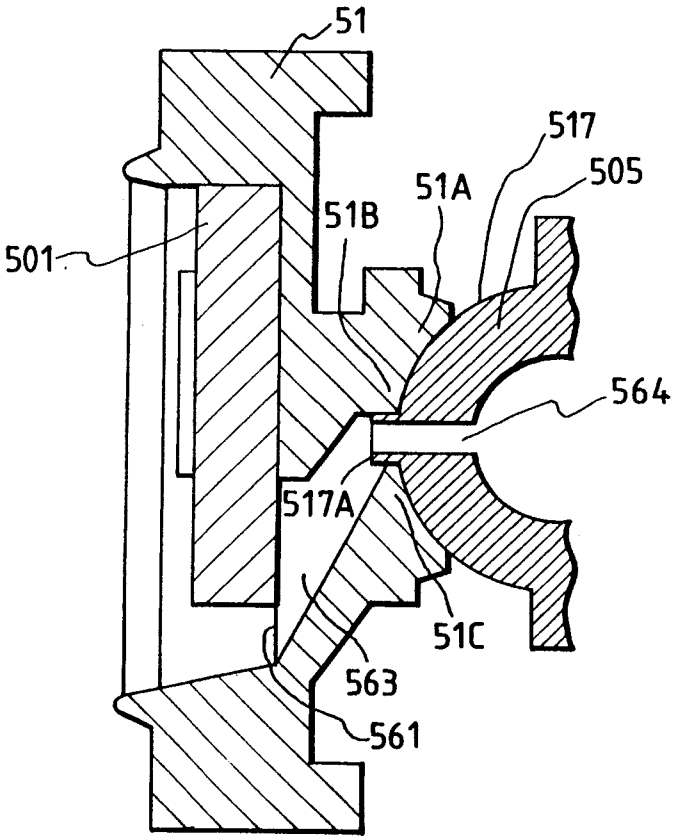
FIGS. 14B to 14D are cross-sectional side views of a cap and a cap lever according to another embodiment of the present invention.
Figure 14A:
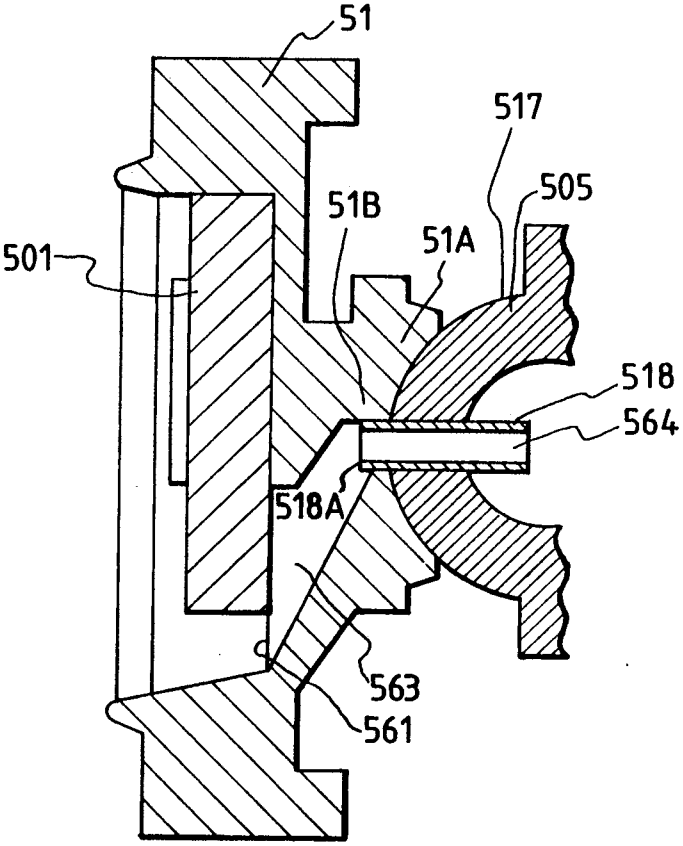
FIG. 14A is a cross-sectional side view of a cap and a cap lever according to an embodiment of the present invention.

FIG. 14A is a side cross-sectional view of the cap 51 and the cap lever 505.

Here, in this example, an ink suction port 561 within the cap opens at a vertical lower portion, with an ink flow path 563 being formed toward an ink inlet port 517C provided on a working section 517 of the cap lever 505. And the suction port 561 is not completely covered by an absorbing member 501. Conventionally, the absorbing member 501 was provided over all of the ace 565 of the cap 51, with the ink flow path running vertically on a dashed line C as shown in FIG. 13D and the suction port opening at a central portion of the back side for the absorbing member 501. According to this conventional configuration, as the ink received into the absorbing member at the discharge recovery processing will flow downwardly of the ink absorbing member under the influence of gravity, the ink left unabsorbed may stiffen at that portion, which leads to a degraded absorption capability or a decreased suction power of the ink absorbing member. On the contrary, according to this example, even if the ink flows downwardly with the influence of gravity, the ink is absorbed through the suction port 561 provided on the lower portion, and so the amount of ink remaining within the ink absorbing member 501 is significantly reduced, with the result that the degradation due to the stiffness can be greatly retarded, and the life of the ink absorbing member or the cap 51 attached thereto can be lengthened.

FIG. 14A is a view showing a communicating member 518 for communicating an exhausting path 563 provided on the cap 51 with a guide path 564 provided on the cap direct contact member, according to an embodiment of the present invention.

Conventionally, as a configuration having no communicating member was used unlike this example, a leak of the suction power might occur from a junction portion 517 between the cap 51 and the cap lever 505, and a sufficient suction power might not often act on the inside of the cap 51.

On the contrary, according to this example, by providing an elastic communicating member 518, no leak of the suction power occurs, and since the communicating member is constructed of an elastic material, the suction power can be exerted without trouble even if the cap 51 is rotated in making contact with the recording head.

This example is concerned with an ink jet recording apparatus comprising a cap having an exhausting path for exhausting the ink as well as covering a discharge portion for discharging the ink of a recording head, a cap direct contact member having a guide path for communicating to the exhausting path of the cap and guiding the ink in the exhausting direction, and a communicating member for permitting the passage of the ink inside thereof in which at least one of the- exhausting path of the cap or the guide path of the cap direct contact member is made of elastic material, the communicating member being located within the path defined by the elastic member and supported by a stronger pressure, than that in the direct contact state between the cap and the cap direct contact member. Thereby the above mentioned problems can be resolved so that a stable effect is accomplished for a long term.

This invention is especially effective in that the member defining the exhausting path is elastic, and the communicating member is provided with end portions 517A and 518A downwardly in the gravitational direction, which do not abut on the capping member but are located within the cap in the exhausting path. With this configuration, the ink reaching to the direct contact area is introduced into the communicating member and concentrated to the end portions with greater degrees of freedom, so that the effect of preventing a leak of the ink can be increased for a long term.

In addition, the above mentioned cap has the elastic portions 51A and 51C which abut on the above mentioned direct contact member, in which a direct contact pressure occurs at said direct contact portion by the elastic deformation thereof, during a capping state against the above mentioned recording head. And with a configuration in which the communicating member 518 exerts a stronger pressure against the direct contact member 505 than the above mentioned direct contact pressure (preferably when not capped), it is possible to separate a seal acting portion in the capping state from the seal acting portion in the non-capping state for the ink jet recording apparatus, so that the effect of durability can be greatly improved as preferred.

Note that the communicating member 518 according to this embodiment of the invention is a polyethylene tube with an external diameter of about 1 mm, an internal diameter of about 0.5 mm and a length of about 5 mm, and inserted into the guide path 564 of the cap direct contact member (made of polyacetal) by pressure and carried thereon.

Figure 14C:
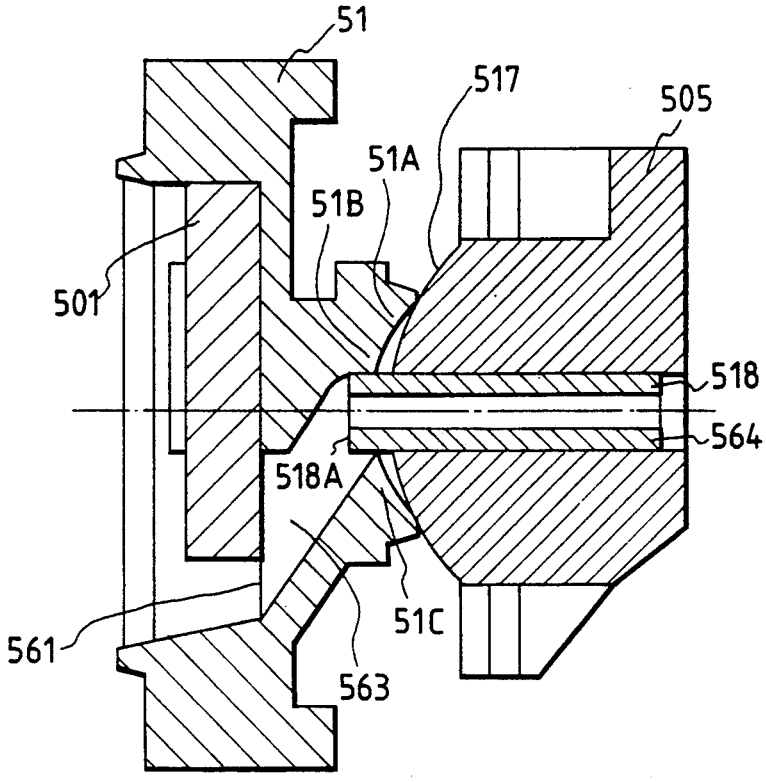
Figure 14D:
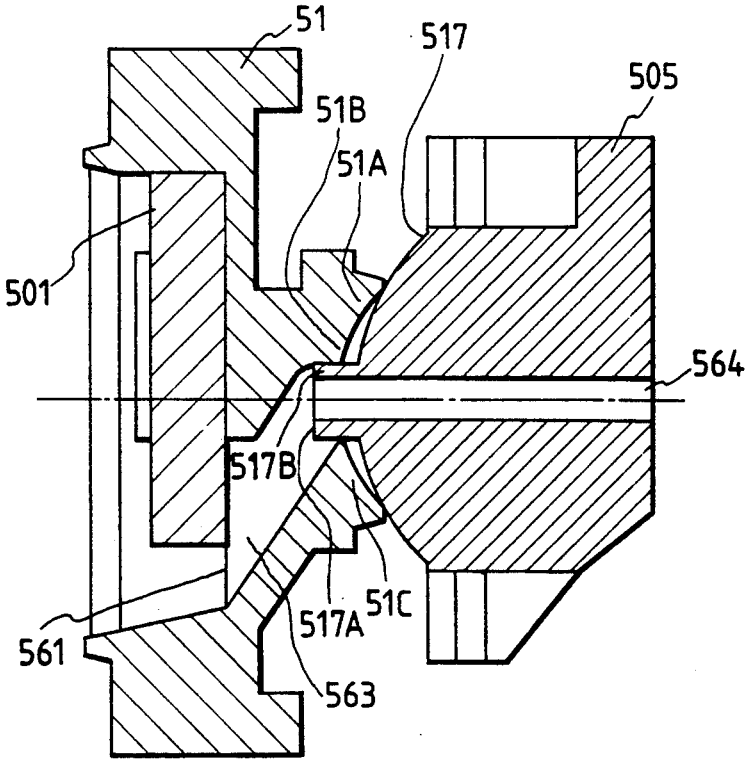

FIG. 14B shows a communicating section 517B in which the communicating member and the cap direct contact member 505 are integrated, according to another embodiment of the invention. With such a configuration, it is possible to obtain the same effect as for the communicating member 518 in FIG. 14A, and in addition, to omit a process of inserting the communicating member 518, into the direct contact member 505. Furthermore, other embodiments are shown in FIGS. 14C to 14D. That is, if it is constructed in such a manner that a communicating path and the communicating member 518 can be fitted to each other, the initial object of the present invention can be accomplished. In this case, if the elastic portion can maintain a shape sufficiently to guide the ink, the communicating member itself may be elastic. Practically, if the communicating member itself is made of a relatively rigid material such as resin or metal, the effect of relative durability can be increased.

It is an additional effect that in the claims of the present invention having the configuration of suction means, the suction effect can be improved much more with the above described embodiment.

It should be noted that in this example, an ink flow path 563 within the cap 51 is constructed as shown in the figure, because the flow path is provided within the cap lever, but the ink flow path within the cap does not have to be constructed as shown in the figure if an ink suction path is provided otherwise. That is, the ink suction port 561 is provided in the vertical lower portion of the and any configuration for the ink flow path is permitted as desired.

The recovery system will be described in the following.

Figure 15:
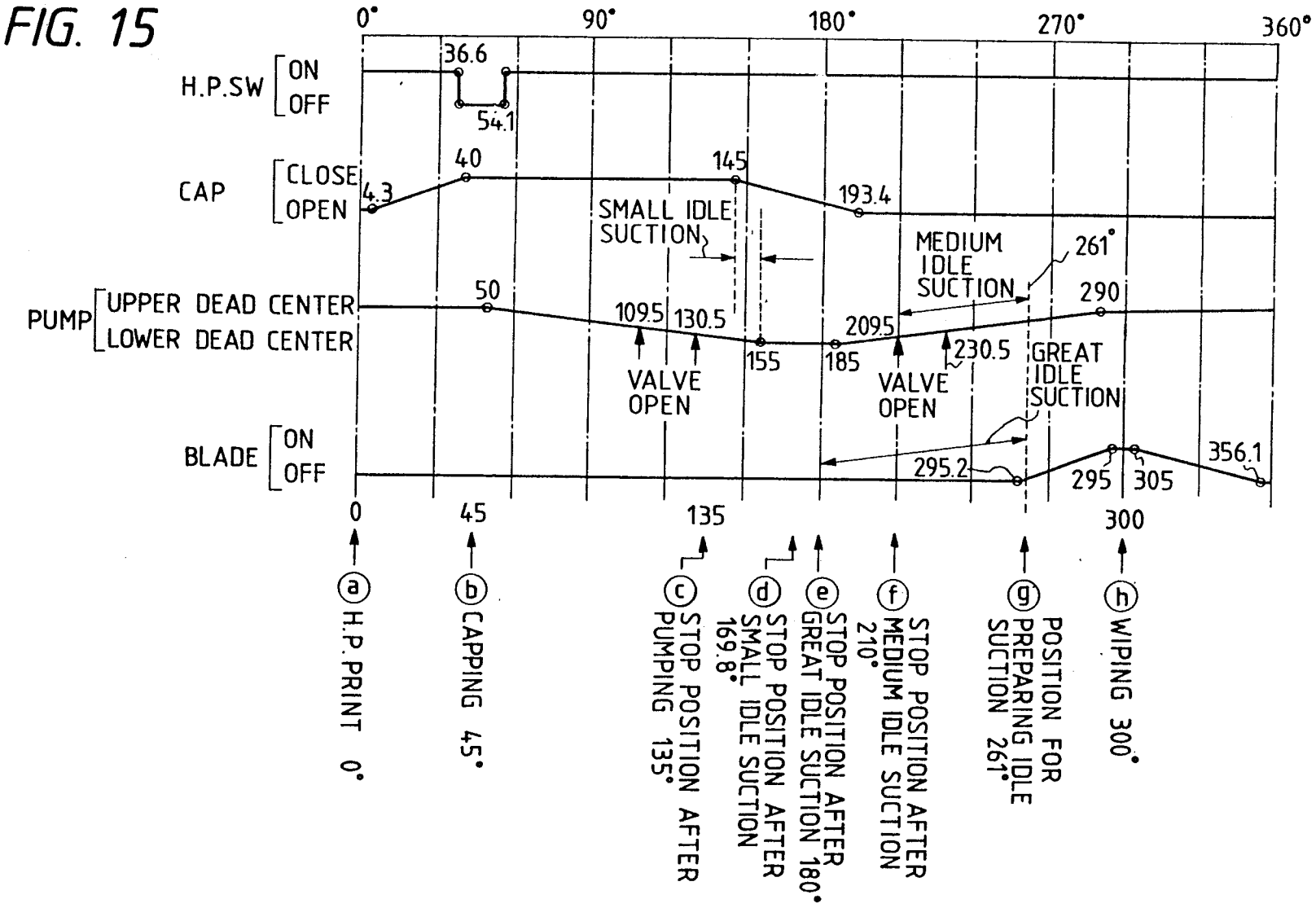
FIG. 15 is a diagram showing a contour curve of a cam for operating each portion of a suction recovery device.
Figure 16:
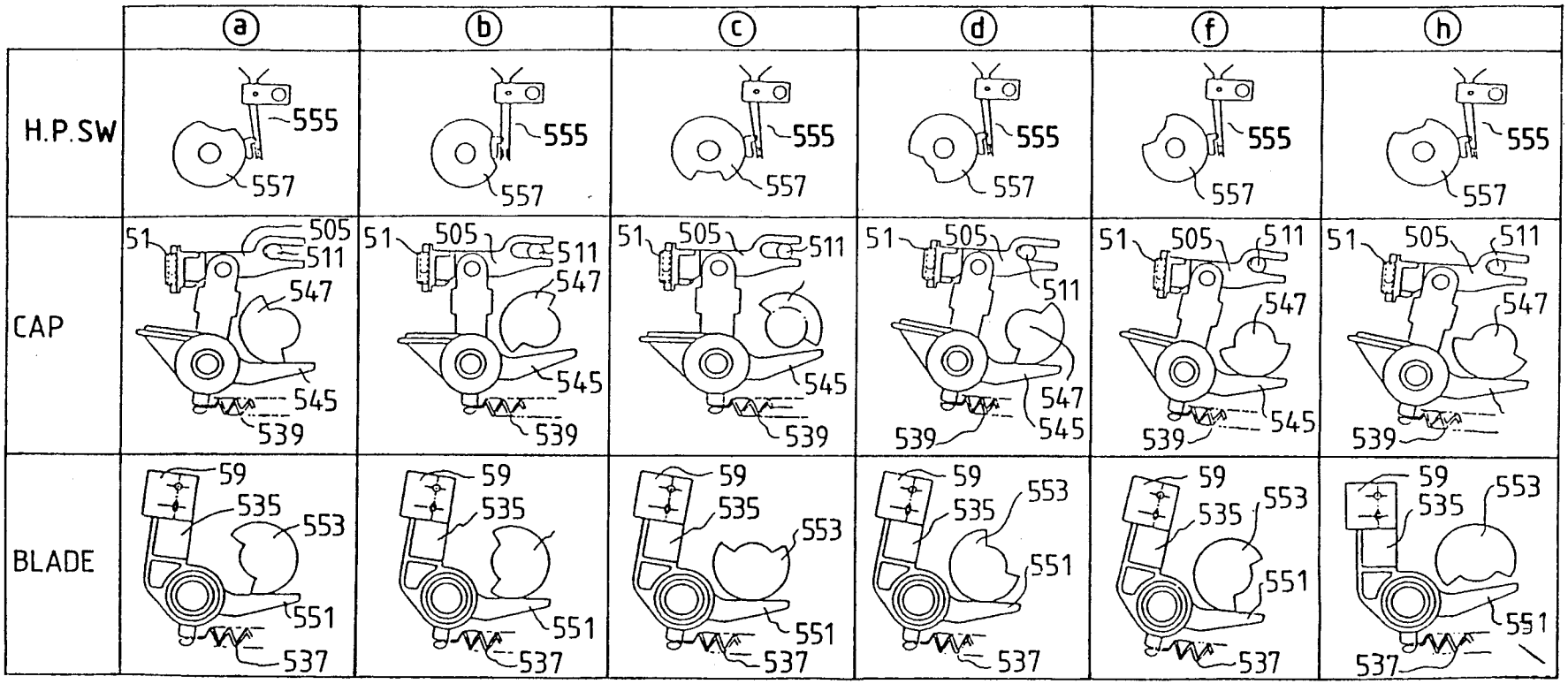
FIG. 16 and FIG. 17 are explanation views showing the operation of each portion in main cam positions.

FIG. 15 shows the contour curve of each cam for a cam mechanism, FIG. 16 shows the operation position of each portion except for a pump corresponding to main cam positions (a–d, f and h in FIG. 15) and FIG. 17 shows views for describing the operation positions of the pump 53. Note that numerals in FIG. 15 indicate cam rotational angles.

Referring now to FIGS. 15–17, the function of the recovery system unit according to this example will be described.

In FIG. 15, state a shows a home position of the cam 549, which is a waiting state for the recovery device during the recording operation. At this time, a switch 555 is on, the cap 51 is separated away from discharge ports (hereafter referred to as an open state), and a blade 59 is in the off state, i.e., the state in which it is also separated away from the discharge port formation face of head (see FIG. 16). The pump 53 is at the upper dead center.

Next, state b is a capping state, in which the discharge port formation face is covered and protected in the state of not using a printer. At this time, the switch 555 is off, the cap 51 connects with the discharge port formation face of head (closed state), the pump 53 is at the upper dead center, and the blade is in the off state.

State c is a state in which the pumping has been completed. The switch 555 is on, the cap 51 is closed, and the pump 53 opens a valve completely but has not yet reached to the lower dead center. The blade 59 is placed in the off state.

State d is a state in which the cap 51 is opened after the completion of pumping, and at the same time a small idle suction for taking the ink filled within the cap 51 and the cap lever 505 into the pump 53 has been performed. Then the switch 555 is on, the cap 51 is open nearly half, the pump 53 is at the lower dead center, and the blade is in the off state.

Next, the g state will be explained. This is a preparatory position for starting the idle suction with which the ink filled within the pump 53 by the pumping is exhausted into the waste ink tank. At this time, the switch 555 is on, the cap 51 is open, and the pump 53 is positioned slightly lower than the upper dead center.

The blade 59 is in the off state.

The states e and f indicate the stop positions where a great idle suction and a medium suction are performed, respectively. In either position, the switch 555 is on, the cap 51 is open, and the blade 59 is in the off state, but the state of the pump 53 is at the lower dead center in the state e while it has not been lowered completely in the state f.

State h is a state for wiping. Then the switch 555 is on, the cap 51 is open, and the pump is at the upper dead center. The blade 59 is in the on state, where if the carriage 11 with the head cartridge 9 mounted moves, the wiping of the discharge port formation face of head can be performed.

Figure 17A:
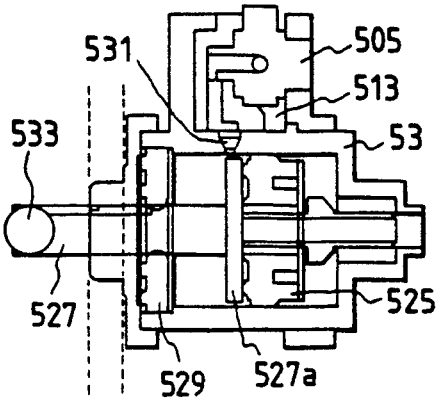

Next, in FIG. 17A, (position 1) 1 indicates a state in which the piston 525 is at the lower dead center within the pump. The pumping is conducted with a negative pressure caused by a space in the left side from the piston 525 within the pump 53. 531 is a valve port through which the negative pressure is transmitted to the cap 51. It will be seen in state 1 that the piston 525 goes beyond this valve port 531 further to the right side. As the piston 525 is pressed by and tightly attached with a flange portion of the piston shaft 527*a* from the left side, the generated negative pressure does not leak anywhere and is transmitted to the cap 51. The ink remaining on the right portion of the piston 525 is forced out into the waste ink tank FIG. 17B (position 2) indicates a state in which the piston 525 is located at the upper dead center. It is noteworthy here that the piston 525 has reached to the right side of the valve port 531, and the valve port 531 is not closed. That is, in this state, the cap 51 is placed in a state of communicating to the atmosphere.

Figure 17C:
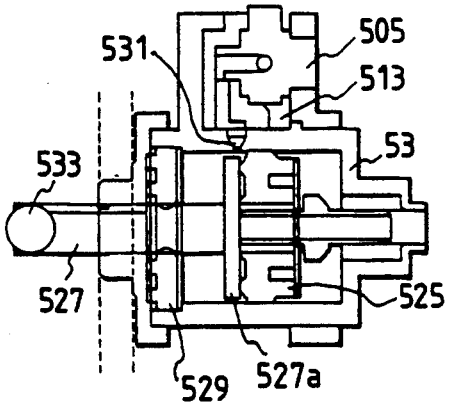
Figure 17B:
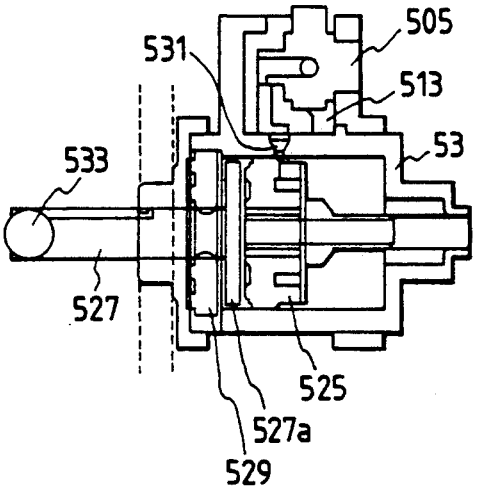

FIG. 17C (position 3) shows a state of the pump 53 corresponding to the position c of FIG. 15. The piston 525 proceeds beyond the valve port 531 slightly to the right side.

Figure 17D:
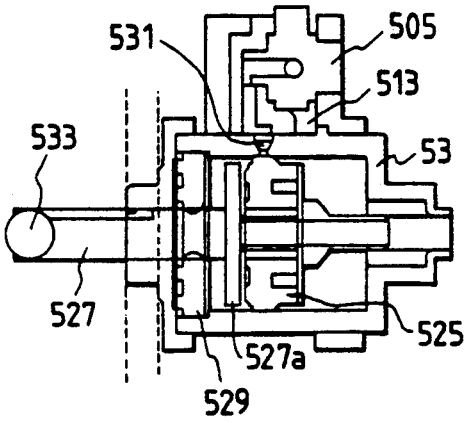

FIG. 17D (position 4) indicates a state corresponding to the position g as shown in FIG. 15, where the great idle suction or the medium idle suction is performed by reciprocating between this state and state 1 or 5, respectively. It is noteworthy here that the valve port 531 is closed by the piston 525. The pump 53 according to this example is not provided with a valve equivalent to that which an ordinary pump has, and if a positive pressure occurs within the pump, the back flow may occur toward the cap 51. Therefore, the amount of back flow can be effectively reduced by closing the valve port 531 except for necessary cases.

Figure 17E:
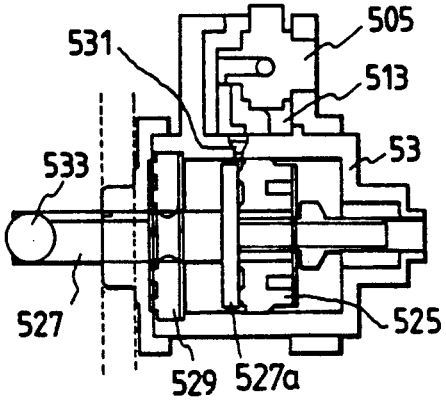

FIG. 17E (position 5) indicates a state in which the medium idle suction has been completed. It is noteworthy here that the piston 525 has stopped immediately after going beyond the valve port 531. If the piston 525 moved up to the lower dead center position 1, a long period for which the valve port 531 is not closed would be necessary to return to the upper dead center position 2 or the position for preparing idle suction position 4. Though a slight clearance is made between a flange 527*a* of the piston shaft and the piston 525 to prevent the positive pressure from being generated in a space on the left side, and to communicate with a right space of the piston 525, the positive pressure may be generated by the resistance of the flow path, whereby there is a fear that the back flow may occur. On the contrary, as in this example, if the piston 525 is constructed to return from the position 5 to the position 1 or 4, the back flow is effectively prevented.

Figure 18:
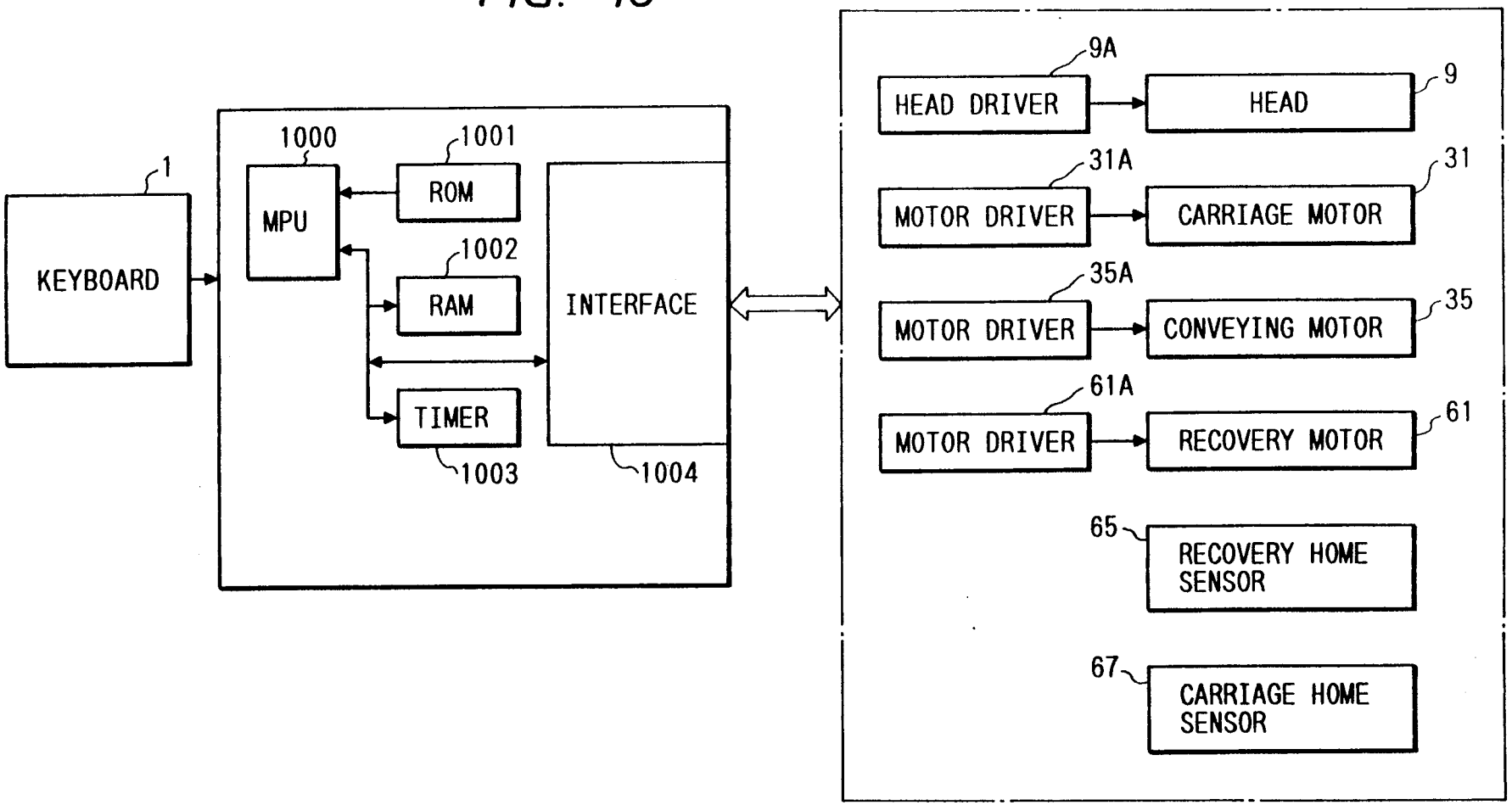
FIG. 18 is a block diagram showing a configuration example of a control system of device involved in this example.

FIG. 18 is a block diagram showing a configuration for the control system of a recording apparatus with the above construction.

A capping position and a move position of the carriage 11 can be known based on the detections with a recovery home sensor 65 and a carriage home sensor 67. In the same figure, 1000 is a MPU for controlling each section by executing the control procedure as will be described later with reference to FIGS. 19 to 21, 1001 is a ROM for storing the program corresponding to the control procedure as above indicated; and 1002 is a RAM used for a work area during execution of the control procedure; And 1003 is a timer for measuring the time as will be described later.

Figure 19:
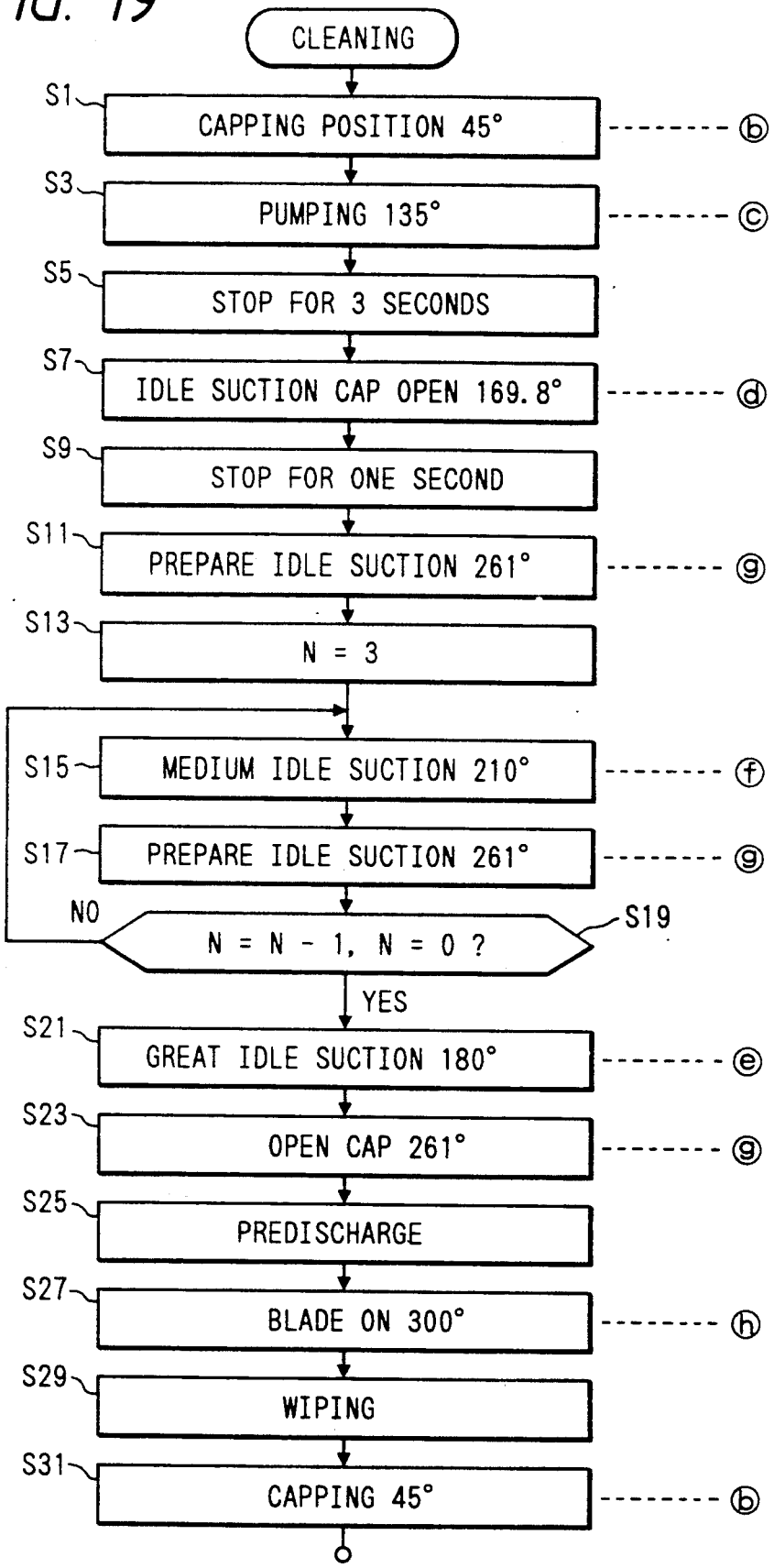
FIG. 19 is a flowchart showing one example of the cleaning operation procedure in a suction recovery processing.

FIG. 19 shows an example of the head cleaning procedure which is performed by the recovery unit under the control of MPU1000 as shown in FIG. 18.

This procedure starts with the capping state h as shown in FIG. 15 (step S1). And the processing proceeds to the c state, where the pumping is performed (step S3), and stops for 3 seconds, for example, in order to suck the sufficient amount of ink in that state (step S5). Simultaneously with opening of the cap at the state d, the small idle suction is performed (step S7), and stops for one second, for example, to receive the ink within the cap 51 and the cap lever 505 (step S9).

Next, the idle suction is performed to exhaust the ink filled within the pump 53. That is, the piston is transferred to the position for preparing idle suction 9 (step S11), and then reciprocated between that position and the medium idle stop position, three times, for example (steps S13 to S19).

Finally, the great idle suction is performed (step S21) by moving the piston from g to e, to force out the ink within the pump 53 to the waste ink tank. Subsequently, by transferring to the position g (step S23), the predischarge is performed (step S25), and the blade 59 is projected by setting at the position h (step S29), and the piston is returned to the initial capping state b (step S31).

It should be noted that the present procedure including the recovery processing, the idle suction and the predischarge, can be appropriately performed in the main control routine for the device, or can be initiated in accordance with an indication by an operator.

Figure 20:
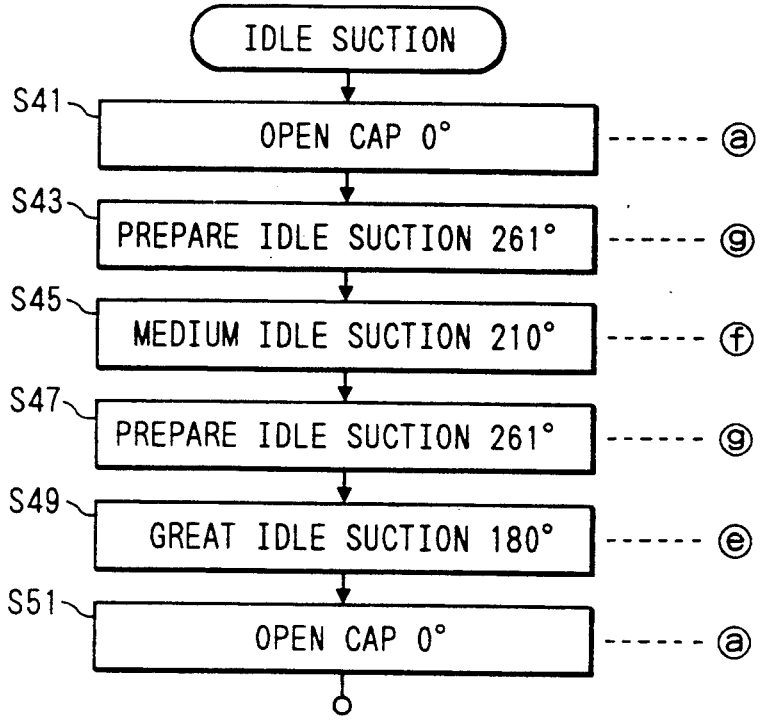
FIG. 20 is a flowchart showing one example of the operation procedure of an idle suction processing associated with a suction recovery processing.

FIG. 20 is a flowchart showing an operation example for the idle suction to take into the waste ink tank the ink stored with the predischarge which is performed during the recording as required. This procedure is a process performed during recording by interrupting the recording, and starting with the wait state a in FIG. 15 (step S41). The cam 63 is rotated reversely from this state downward to the g position (step S43), and then it is caused to return to the f position to perform the medium idle suction (step S45). And after setting at the g position again (step S47), it is caused to return to the e position, to perform the great idle suction (step S49). Thereafter, by setting at the state a, the cap is Op®ned (step S51), and the recording is performed.

Figure 21B:
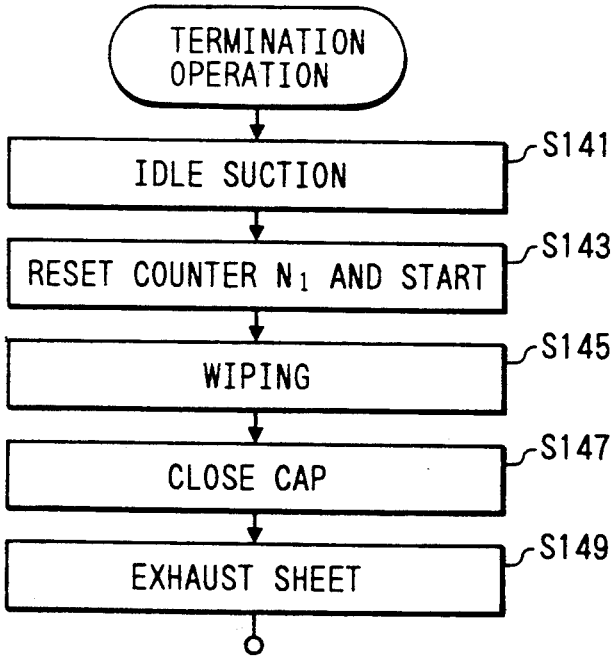
Figures 1, 21A:
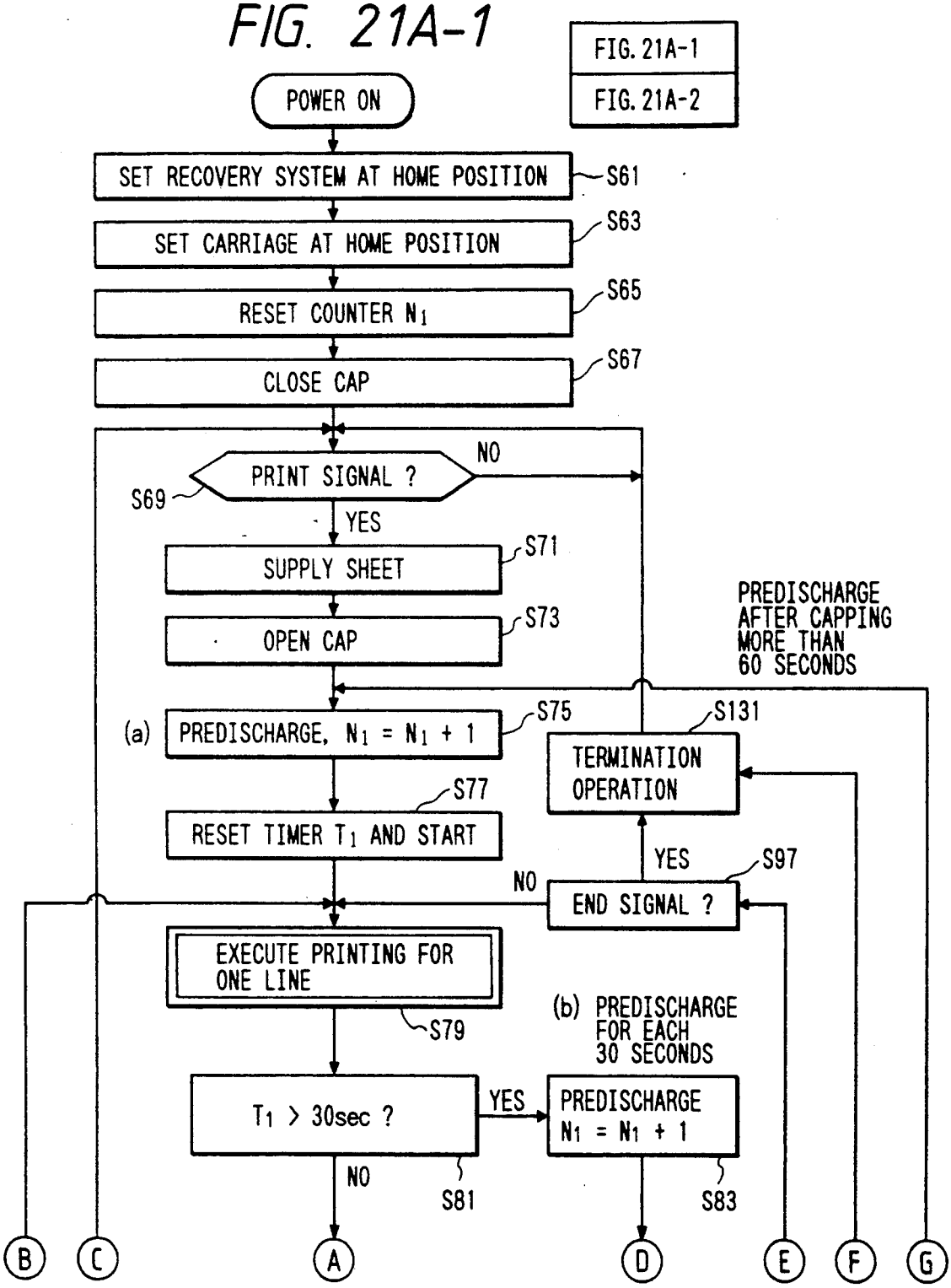
Figures 2, 21A:
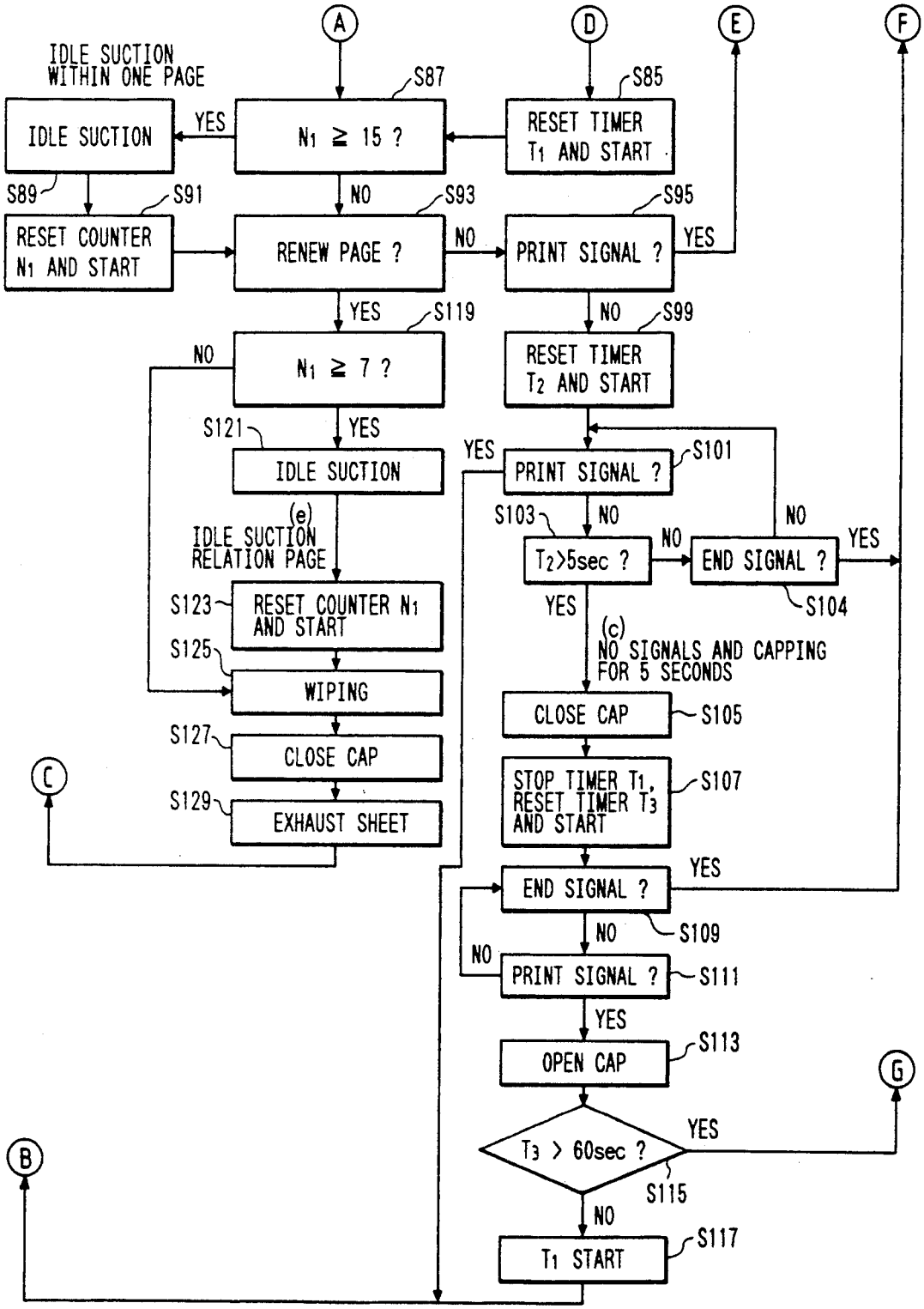

FIGS. 21A and 21B show one example of the record printing procedure according to this example.

First, the power is turned on, FIG. 21A, the recovery system unit is set at the home position of the recovery system at step S61, and after opening the cap, the carriage 11 is set at the home position at step S63. Next, at step S65, a counter N1, which is used to activate the idle suction when a predetermined number of predischarges (15 or 7 times in this example) has been reached, is reset, and after closing the cap at step S67, the processing waits for a data signal for recording (printing) (step S69).

If the print signal is entered, the paper feed is started at step S71, and after the cap is opened at step S73, the carriage 11 is set at the home position to perform the predischarge, and the counter N1 is incremented by +1, at step S75. Next, at step S77, the timer T1, which activates the predischarge every predetermined time (for example, every 30 seconds) during the recording operation, is reset and started, and at step S79, one line of print is performed. After that, at step S81, a determination is made whether a value of the timer T1 exceeds 30 seconds or not, and if so, after passing through steps S83 and S85 which are the same as steps S75 and S77 respectively, the processing goes to step S87, while if not, it goes to step S87 immediately.

At step S87, a determination is made whether a value of the counter N1 has reached 15 or not, and if so, the idle suction is performed midway through one page of printing at step S89. In doing so, the procedure as shown in FIG. 20 is initiated. Thereafter, the counter N1 is reset and restarted at step S91, and the procedure transfers to step S93. Note that if a negative determination is made at step S87, the processing goes immediately to step S93.

At step S93, a determination is made whether or not one page of recording has been completed and the change of page is indicated, and if not, the processing proceeds to step S95, where it is determined whether a print signal exists or not. If a positive determination is made at step S95, a determination is made at step S97 whether or not there is the END signal for the termination of recording, and if not, the processing transfers to step S79 to print the next line.

If no print signal is entered at step S95, the processing proceeds to step S99, where a timer T2, which is used to perform the capping when print data is not entered for a predetermined time (for example, 5 seconds), is reset and restarted. Next, at step S101, a determination is made whether or not there is any print signal, and if so, the processing returns to step S79 to print the next line.

On the other hand, if a negative determination is made, a determination is made at step S103 whether the clock content of the timer T2 exceeds 5 seconds or not, and if not, the processing proceeds to step S104, and if no END signal is entered, the processing returns to step S101.

If 5 seconds have passed, the cap is closed at step S105, and the timer T1 is stopped at step S107, while a timer T3, which activates the predischarge if a predetermined time (e.g. 60 seconds) of the capping state continues, is reset and restarted.

Next, determinations are made whether or not the END signal and a print signal are entered (steps S109 and S111), respectively, and if there is any print signal, the cap is opened at step S113, and a determination is made at step S115 whether the clock content of the timer T3 exceeds 60 seconds or not. Here, if the determination is positive, the processing proceeds to step S75 to perform the predischarge and other steps while if it is negative, the processing proceeds to step S117 where the timer T1 is started. Then the processing returns to step S79.

Additionally if a page change instruction is entered at step S93, the processing proceeds to step S119, where a determination is made whether or not the content of the counter N1 is more than or equal to 7. Here, if a positive determination is made, the idle suction between pages is performed at step S121 and then the counter N1 is reset/restarted at step S123. Thus, the processing proceeds to step S125 to perform the above mentioned wiping. And the cap is closed at step S127 and a recorded paper is exhausted at step S129, and then the processing proceeds to step S69 to wait for a next print signal.

Note that if the END signal is detected at step S97 or S109, the termination of operation is performed at step S131. This is a processing including the idle suction (step S141), the reset/start of the counter N1 (step S143), the wiping (step S145), the closing of the cap (step S147), and the exhaustion of paper (step S149), as shown in FIG. 21B.

Summarizing the main operations as above described, first, the predischarge is cited. In this example, the predischarge is performed immediately before printing, and thereafter every 30 seconds. The timer T1 is used to integrate over the 30-second interval. As the timer T1 is stopped upon entering the capping (c) after 5 seconds or more have passed without a print signal, the time for the capping is not counted during this 30-second interval. When the capping (c) continues over 60 seconds, the control procedure returns to the predischarge (a), where after opening the cap, the predischarge before printing is performed.

In this example, the predischarge is performed into the inside of cap. Accordingly, when the predischarge is performed repeatedly, the idle suction is necessary to take the ink reserved within the cap into the waste ink tank. This is the idle suction as shown in FIG. 20. Fundamentally, the idle suction is carried out between pages during which the printing is not performed. If the counter N1 for the predischarge is 7 or more after one page of print, the idle suction (d) is performed. However, even midway during the printing of one page, if the counter N1 is 15 or more, i.e., if a document will require a long print time, the idle suction (e) should be performed. And at the termination of print, the idle suction must be always performed. Next, the wiping is used to clean a head face which is wet after the printing, and should be performed after termination of one page or all print.

As described above, according to this example, the ink reserved within the cap with predischarges during the printing can be efficiently delivered into the waste ink tank, by performing the same operation as the idle suction after the ink suction, about two times, during the printing or after termination of the printing.

The amount of ink reserved within the cap with predischarges is slight, compared with that at the ink suction during the cleaning for the recovery of discharge. Accordingly, it is sufficient that the times of idle suctions during the printing is less than those of idle suctions during the cleaning, and it is effective for the improvement of the actual print speed of a recording apparatus to reduce the times to as little as possible.

The times of idle suctions during the cleaning or printing can be set not only as an upper limit, but also as appropriate.

According to this example, reciprocation of the piston for idle suction is configured to be short initially, and to take the stroke that reaches to the lower dead center at the last several times, whereby the efficient idle suction can be implemented so that the ink within the cap 51 can be surely taken into the pump 53, with reduced back flow, and further, the amount of ink remaining within the pump 53 is reduced, with most of the ink delivered to the waste ink tank.

Note that the way of changing the stroke during the idle suction was such that the short stroke (medium idle suction) is performed three times, and the long stroke (great idle suction) once in the above example, but the times thereof can be altered as appropriate.

Next, a waste ink tank involved in this example will be described.

As shown in FIG. 2, in this example, in addition to a first waste ink tank, a second waste ink tank is provided by effectively using a space within the device, and between two waste ink tanks is connected a tube 71. As both waste ink tanks are provided in series with the recovery system unit, the waste ink produced with the discharge recovery processing or the above mentioned idle suction processing is first introduced via the tube 57 into the first waste ink tank 55. While the first waste ink tank 55 has a sufficient capacity to receive the waste ink, the waste ink is reserved therein, but thereafter, if the first waste ink tank 55 can not receive the waste ink any more, the waste ink leaked therefrom is introduced via the tube 71 into the second waste ink tank.

In this way, as the second waste ink tank 70 is provided by effectively using a space within device in this example, a compact device can be realized without reducing the capacity for reserving the waste ink.

Figure 22:
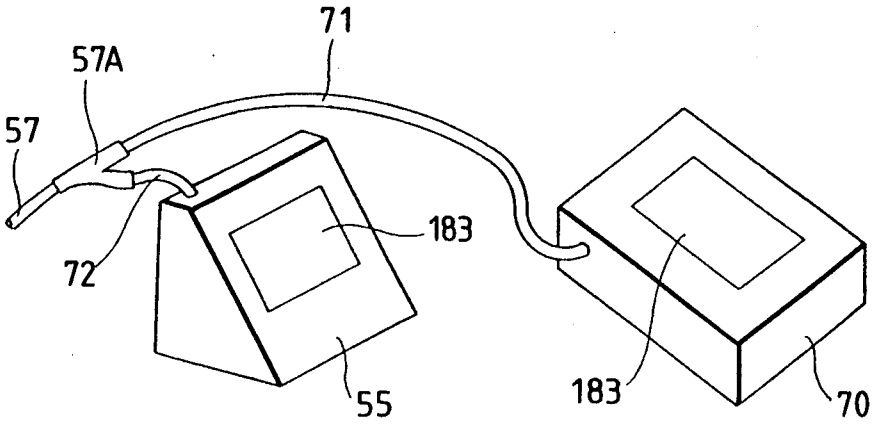
FIG. 22 and FIG. 23 are perspective views of waste ink systems according to two other embodiments.

Note that an appropriate ink absorbing member can be provided within the waste ink tank. In FIG. 22, 183 is a gas permeable cloth, which passes the ink solvent vapor but does not permeate the ink liquid, and more specifically, a vapor road (Teijin Limited) may be used, for example. With this gas permeable cloth 183 placed, the leak of ink from the waste ink tanks 55 and 70 can be prevented. In the above example, two waste ink tanks are connected in series, but they are connected parallel with respect to the recovery system unit.

FIG. 22 shows a configuration example for that parallel connection, in which in this example, the tube 57 has one end thereof connected to the recovery system unit and the other end connected to three way joint 57A, through which the flow of waste ink is branched, so that the waste ink is introduced via the tubes 72 and 71 into the waste ink tanks 55 and 70, respectively. With this example, the same effect as above described can be obtained.

From the viewpoint of effectively using a spare space of device within the where waste ink tanks can be distributed, not only a second waste ink tank but also more waste ink tanks can be provided as appropriate.

Figure 23:
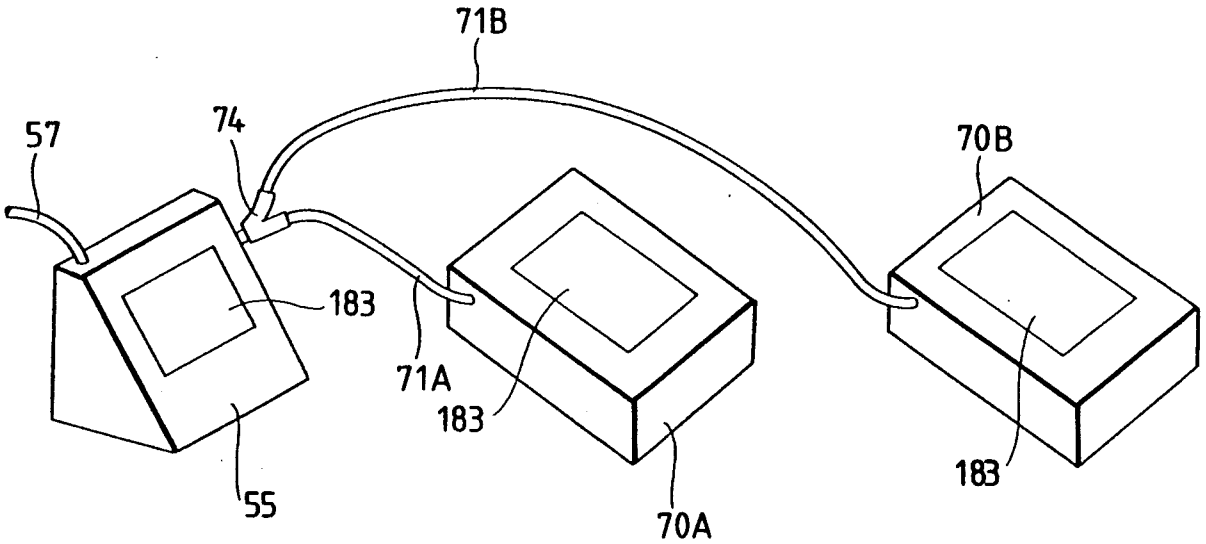

FIG. 23 shows a configuration example where two more waste ink tanks are provided in addition to the waste ink tank 55, a second waste ink tank 70A and a third waste ink tank 70B being provided parallel to the waste ink tank 5. If the waste ink overflows from the waste ink tank 55, this waste ink will branch by means of a joint 74, and flow via the tube 71A and 71B into the second waste ink tank 70A and the third waste ink tank 70B, respectively.

With such a configuration, the capacity for reserving the waste ink can be further increased.

An appropriate configuration can be adapted with the connections between two or more waste ink tanks.

Example 2

Figure 24A:
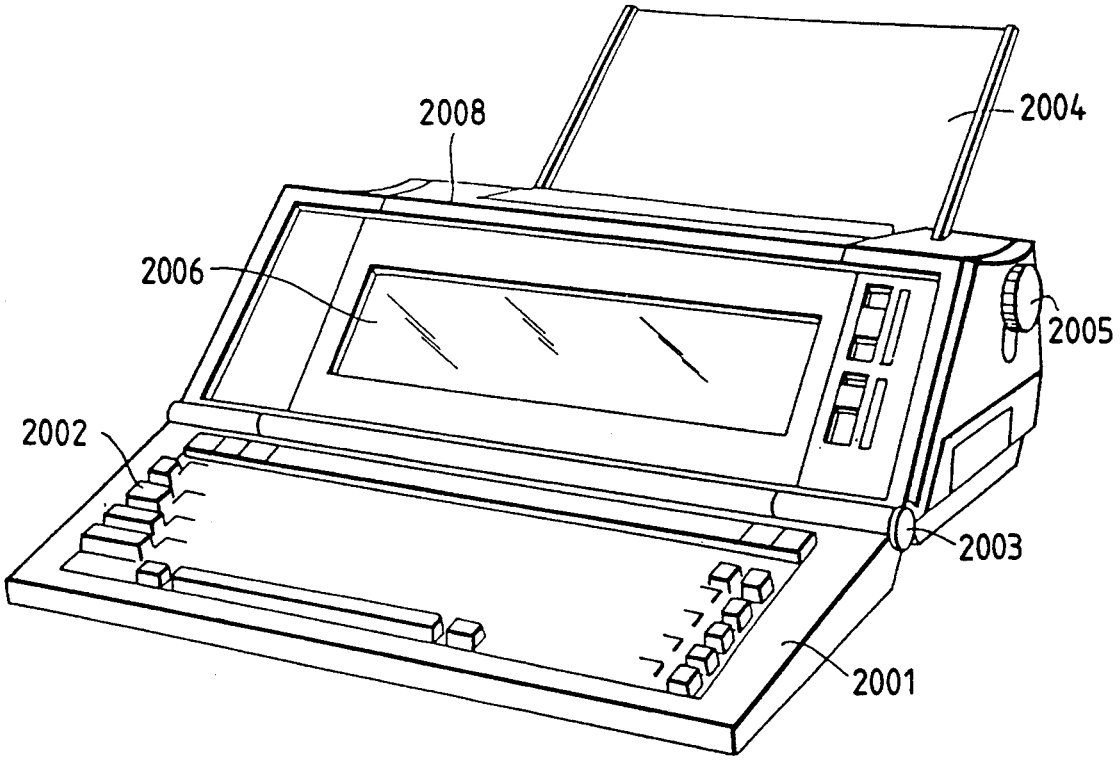
FIGS. 24A and 24B are external perspective views of an electronic typewriter as an apparatus according to another embodiment of the present invention, when in use and storage, respectively.
Figure 24B:
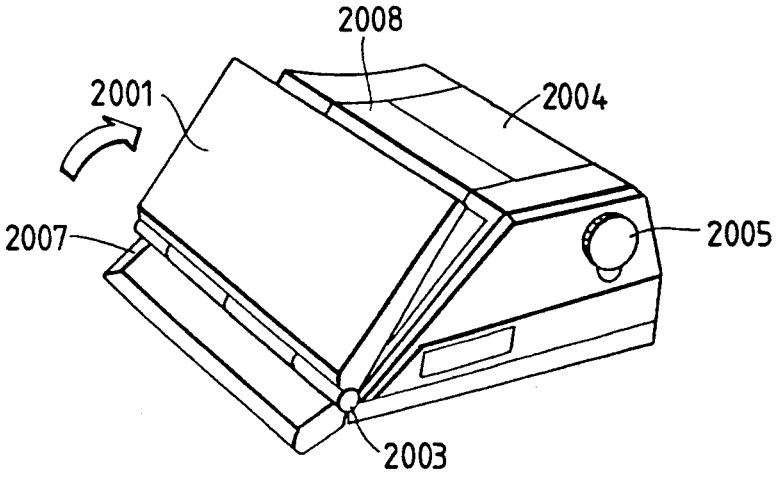

FIGS. 24A and 24B show perspective views of an electronic typewriter, another device to which this invention is applicable.

2001 is a keyboard, in which there is arranged a group of keys 2002, such as keys for entering characters, e.g. letters and numerals, and control keys. When it is not used, it can be folded by turning it around a hinge 2003, as shown in FIG. 24B 2004 is a feed paper tray for feeding a sheet-like recording medium onto a printer section within the apparatus, and can be also stored by folding over the printer section, as shown in FIG. 24B, when not used. 2005 is a feeder knob for setting or exhausting the recording medium manually, 2006 is a display for displaying input sentences or other data, and 2007 is a handle used to transport the apparatus in accordance with this invention.

2008 is a window constituting a cover for the electronic typewriter in accordance with this example, and provided on an upper portion of the typewriter adjacent to the display 2006, which enables a visual inspection of an ink jet printer and a recording medium that are accommodated therein, as will be described later.

Figure 25:
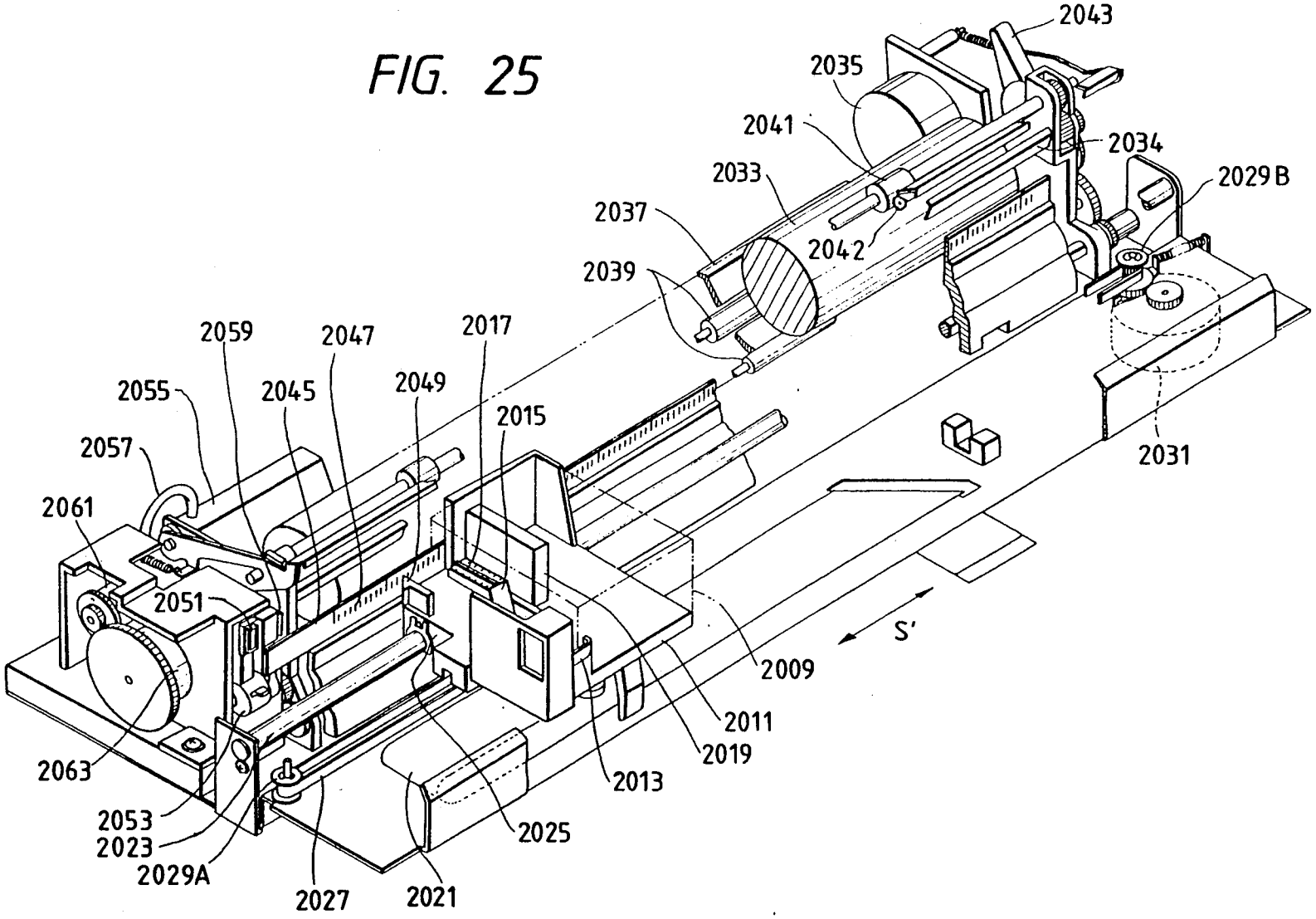
FIG. 25 is a perspective view showing a configuration of a printer according to another example to which the present invention is applicable.

FIG. 25 shows a construction of a printer section according to this example.

2009 is a head cartridge having an ink jet recording head, and 2011 is a carriage for scanning in the S direction in the figure with the head cartridge 2009 mounted thereon. 2013 is a hook for attaching the head cartridge 2009 onto the carriage 2011, and 2015 is a lever for operating the hook 2013. On this lever 2015 is provided a marker 2017 for enabling a print or set position with the recording head of the head cartridge to be read with an indication of scale provided on the cover as described later. 2019 is a support plate for supporting an electrical connection to the head cartridge 2009. 2021 is a flexible cable for connecting between the electrical connection and a control section of the main body.

2023 is a guide shaft for guiding the carriage 2011 in the S direction, which is inserted through bearings 2025 of the carriage 2011. 2027 is a timing belt for transmitting a power to move the carriage 2011 fixed thereto in the S direction, passing under tension about pulleys 2029A, 2029B arranged on both sides of the apparatus. A driving force is transmitted to one pulley 2029B via a transmission, e.g. a gear, from a carriage motor 2031.

2033 is a conveying roller for conveying a recording medium, e.g. a paper (hereafter referred to as a recording paper) in recording, as well as regulating a record face of the recording medium, and it is driven by a conveying motor 2035. 2037 is a paper pan for conducting the recording medium from the feed paper tray 2004 to a recording position, and 2039 is a feed roller, disposed along a feed path for the recording medium, for biasing the recording medium against the conveying roller 2033 to convey it. 2034 is a platen for regulating a record face of the recording medium, opposed to discharge ports of the head cartridge 2009. 2041 is a paper exhausting roller for exhausting the recording medium to a paper exhausting port, not shown, which is disposed downstream from the recording position in the direction of conveying the recording medium. 2042 is a spur provided correspondingly to the paper exhausting roller 2041, for pressing the roller 2041 via the recording medium, and developing a force for conveying the recording medium with the paper exhausting roller 2041. 2043 is a release lever for releasing the energizing state for a feed roller 2039, a presser bar 2045, and a spur 2042, when setting the recording medium.

2045 is a presser bar for suppressing the floating of a recording medium in a neighborhood of a recording position to secure a tight contact condition against the conveying roller 2033. In this example, an ink jet recording head to record with the discharge of ink is used. Accordingly, as a distance between an ink discharge port formation face of the recording head and a record face of the recording medium is relatively slight, and must be strictly controlled to avoid a contact between them, the presser bar 2045 is effectively disposed. 2047 is a scale provided on the presser bar 2045, and 2049 is a marker provided on the carriage 2011 corresponding to this scale, both enabling a print or set position for the recording head to be read.

2051 is a cap made of an elastic material, e.g. rubber, which is placed opposite to an ink discharge port formation face of the recording head in a home position, and supported therein to be able to attach detach from the recording head. The cap 2051 is used for protecting the recording head when it is not used, or in a suction recovery processing for the recording head. The suction recovery process is such a processing that the cap 2051 is opposed to the discharge port formation face, and the ink is discharged from the discharge ports by driving energy generation elements for the ink discharge provided inwardly of the ink discharge ports thereby discharge faulty factors, such as bubbles, dusts, or thickened ink not suitable for recording are removed (predischarge), or otherwise, discharge faulty factors are removed by forcedly discharging the ink from the discharge ports, with the discharge port formation face being covered with the cap 2051.

2053 is a pump used to generate a suction force for the forced discharge of ink, and to suck the ink received within the cap 2051 in the suction recovery process with the forced discharge or predischarge. 2055 is a waste ink tank for reserving waste ink sucked by the pump 2053, and 2057 is a tube for communicating between the pump 2053 and the waste ink tank 2055.

2059 is a blade for wiping the discharge port formation face of the recording head, which is movably held between a position for wiping during the movement of head by projecting onto the recording head, and a retracted position not engaging the discharge port formation face. 2061 is a motor, and 2063 is a cam mechanism for driving the pump 2053 and moving the cap 2051 and the blade 2059, with the power transmitted from the motor 2061.

As to the detailed description of above described head cartridge 2009, that description with reference to FIG. 3 and FIG. 4 should be used.

Figure 26A:
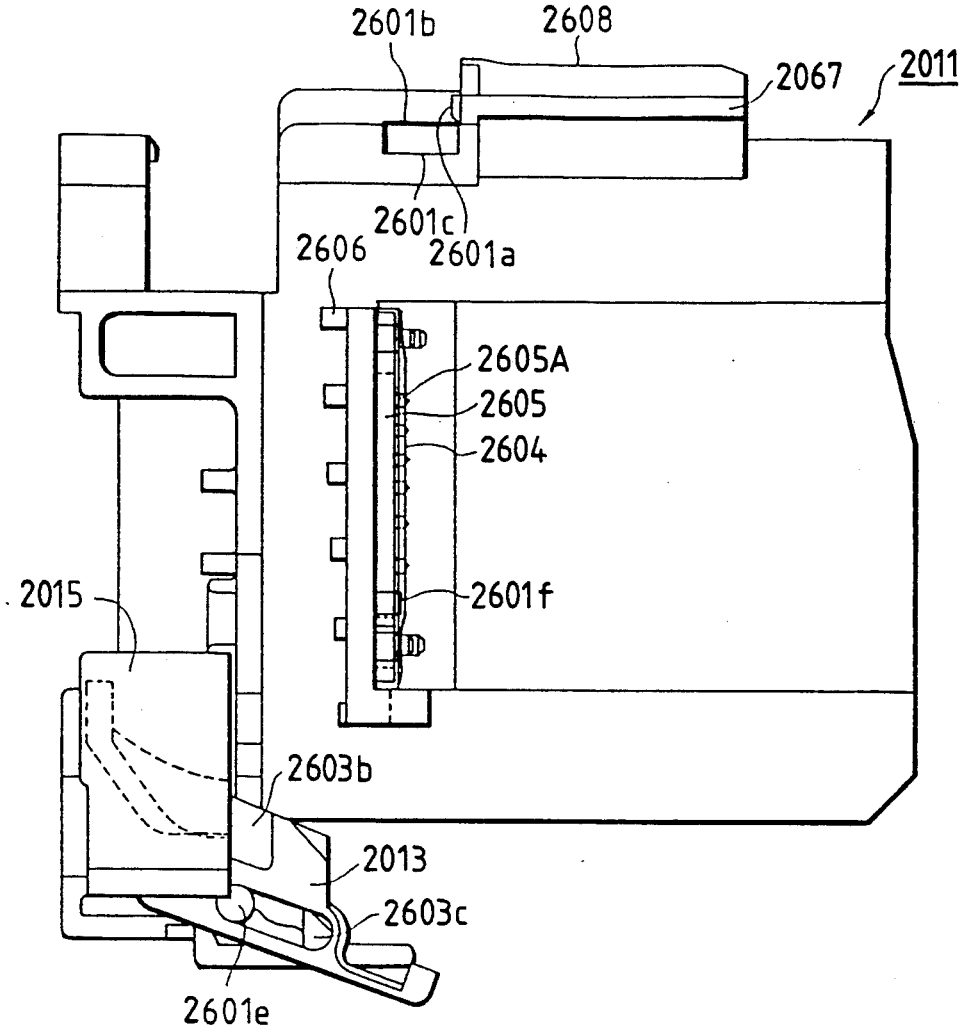
FIGS. 26A and 26B are upper and side views of a carriage as shown in FIG. 25.
Figure 26B:
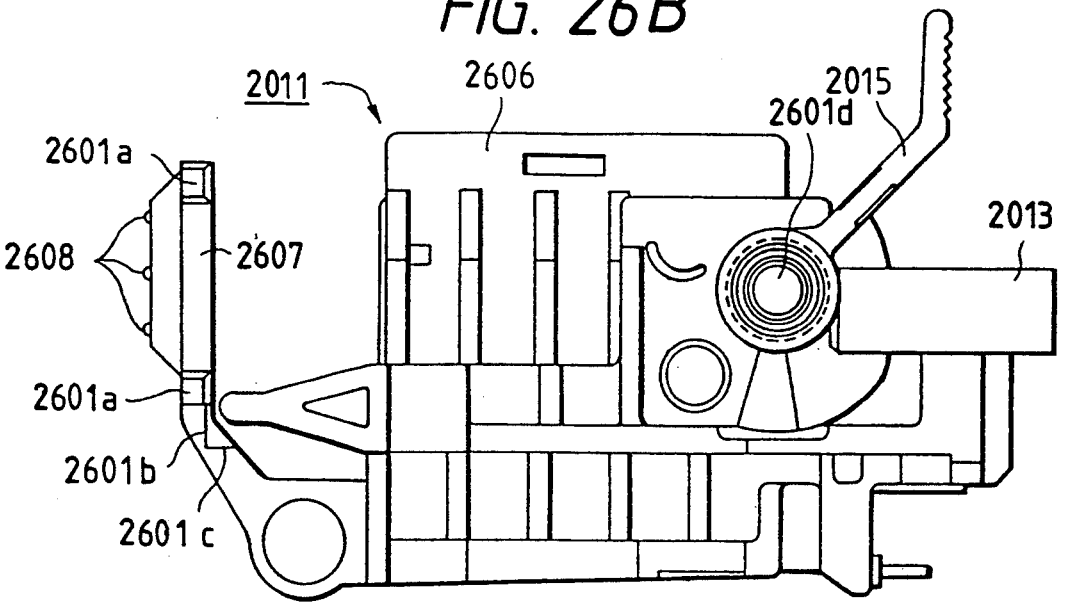

FIGS. 26A and 26B are upper and side views showing the carriage 2011 in detail, respectively.

2606 is a support plate standing on a bottom portion of the carriage 2011, for supporting a flexible substrate 2604 and a rubber pad 2605 having projection portions 2605A corresponding to terminal pads formed in the substrate 2604.

2607 is an abutting member which is also stands on the bottom portion in front of the carriage 2011. The abutting member 2607 is formed so that its wall thickness is thin, in order to preserve a largest space of ink tank within a limited range of space for disposing both the head cartridge 2009 and the carriage 2011. Hence, on the member 2607 are formed three ribs 2608 to secure the strength thereof. The extending direction of the ribs 2608 is the movement direction of the carriage 2011 so as to have a sufficient strength to withstand the movement of the head cartridge in the swivel direction when it is detached. The ribs 2608 are formed to be about 0.1 mm forwardly of the discharge face when the head cartridge 2009 is attached. Thereby even when a recording paper protrudes toward the travel path of the recording head with any action, the recording paper is prevented from rubbing the discharge face, causing damage.

An operation lever 2015 for attaching or detaching the head cartridge freely rotatably bears on a shaft 2601*d* on the carriage body 2011. A hook 2013 is used, with the movement engaging with a portion of the operation lever 2015, to attach or detach the head cartridge 2009 which is partly in engagement with that operation lever 2015. The hook 2013 can perform the above mentioned attaching or detaching operation by guiding a long hole 2603*c* formed therein into a guide shaft 2601*c* on the carriage body 2011.

As the attaching or detaching mechanism which consists of the operation lever 2015 and the hook 2013, is provided laterally of the carriage 2011, or in the movement direction side of the carriage 2011, the attaching or detaching mechanism does not create any large dead space due to the movement of the carriage.

Next, an abutting portion used to position the head cartridge when attaching will be described.

2601*a* are abutting portions for positioning the head cartridge in the left and right directions, provided at two locations on the both sides of the abutting member 2607. It should be noted that for positioning the head cartridge in the left and right directions, an abutting portion 2601*f* on the support plate 2606 may be also used, in addition to the abutting portions 2601*a*.

2601*b* is an abutting portion to position the head cartridge in the forward and backward directions, formed in a laterally underside portion of the abutting member 2607.

2601*c* are abutting portions to position the head cartridge in the upper and lower directions, formed at two locations, i.e., in a laterally underside portion of the abutting member 2607 and a laterally underside portion of the support plate.

Figure 27A:
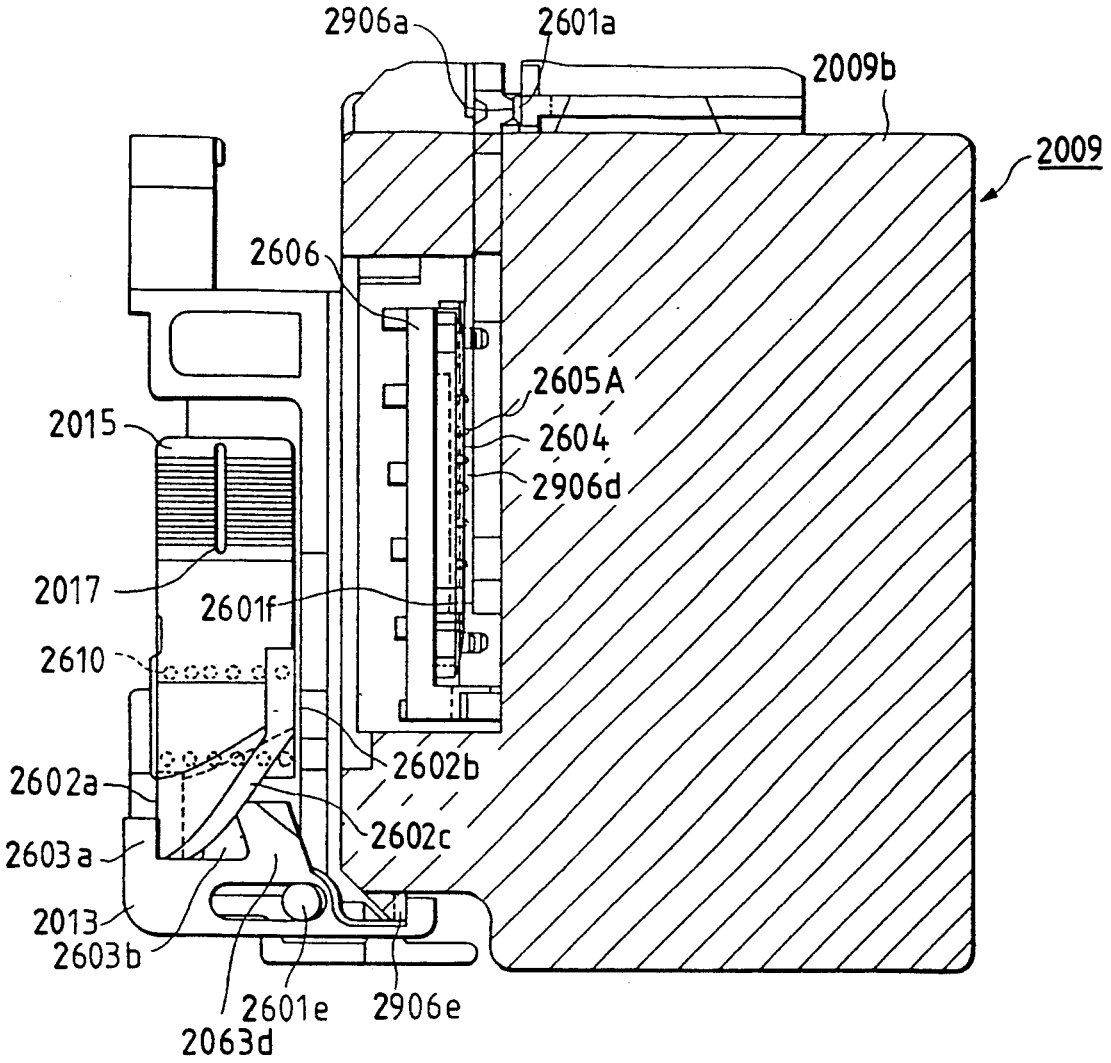
FIGS. 27A and 27B are upper and side views showing a state where the above mentioned head cartridge is mounted on the above mentioned carriage.
Figure 27B:
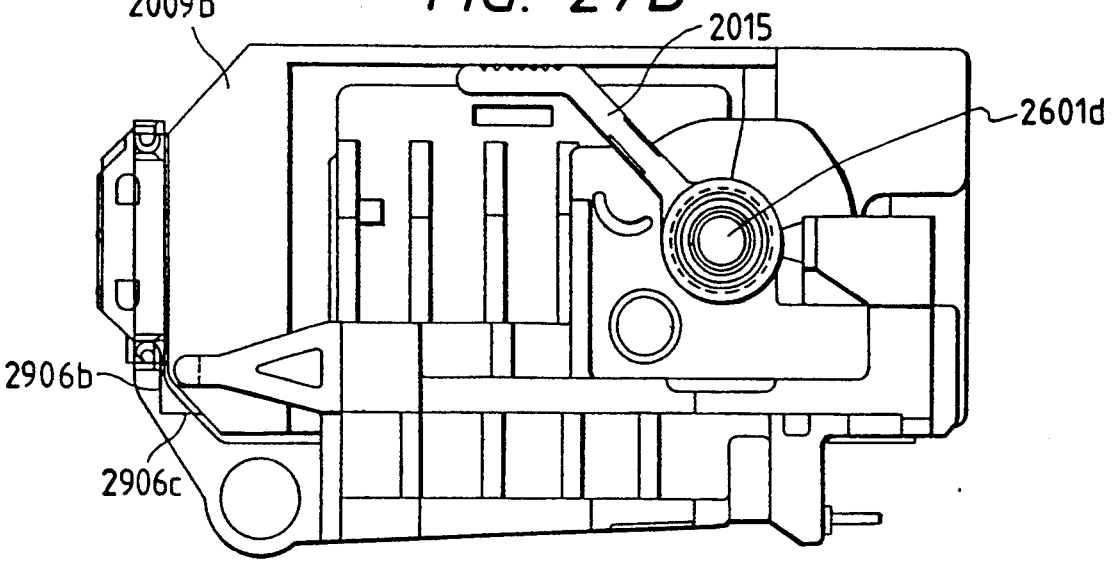

FIGS. 27A and 27B are upper and left side views showing the state when the head cartridge 2009 is attached onto the carriage 2011, respectively.

In these figures, 2906*a* is a direct contact portion provided on the head cartridge 2009 so as to come into direct contact with an abutting portion of the carriage 2011, when the recording head is attached, while 2906*b* and 2906*c* are also direct contact portions corresponding to the abutting portions 2601*b* and 2601*c*, respectively.

Referring now to FIG. 27A, the engagement relations between portions when the recording head is attached will be outlined.

The direct contact portion 2906*a* of the head cartridge 2009 is directly in contact with the abutting portion 2601*a* of the carriage 2006, while simultaneously the clock 2906 of the head cartridge 2009 is forced to the left side in the figure, with the energizing force of a coil spring 2610 against the hook 2013 engaged therein, whereby the head cartridge 2009 is subject to the moment force around the above mentioned direct contact portion. Then a substrate 2906*d* on the head is brought into direct contact with the abutting portion 2601*f*, so that the head cartridge 2009 can be positioned in both left and right directions, thereby holding that position.

At this time, the projection portion 2605A of the rubber pad 2605 is compressed by coming into direct contact with the substrate 2906*d*. This deformation causes a force pressing a terminal pad of the flexible substrate 2604 into contact with a terminal of the substrate 2906*d*, in which as the substrate 2906*d* is in direct contact with the abutting portion 2601*f*, the amount of deformation for the projection portion 2605A is kept constant, thereby causing a stable pressing force as indicated above.

In the above figure, the compressed state of the projection portion 2605A is not shown.

The forward or backward and upper or lower positioning for the head Cartridge 2009 can be performed in the attaching process.

Figure 28A:
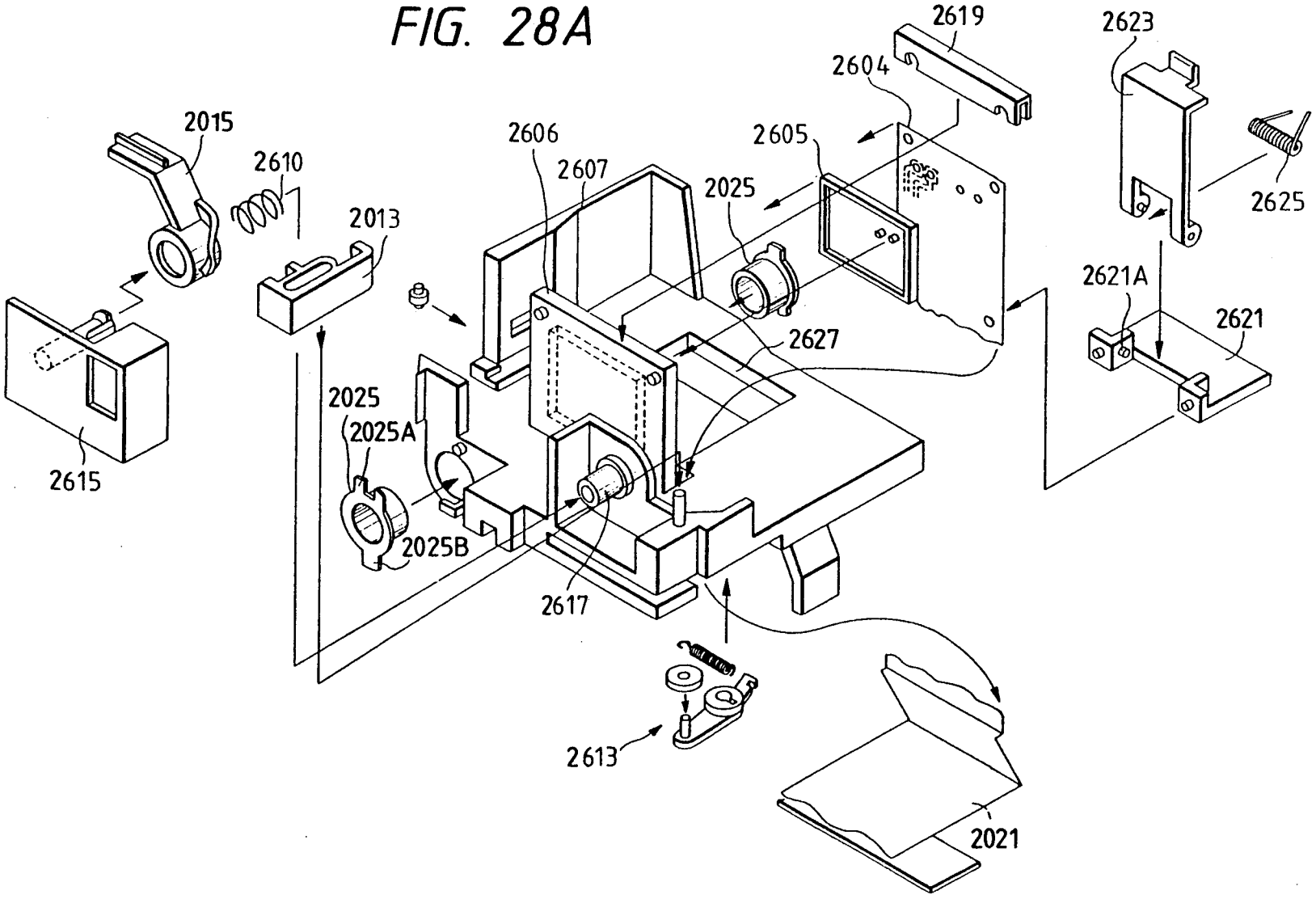
FIGS. 28A, 28B and 28C are an exploded perspective view of the above mentioned carriage, a side view of the same carriage, and a side view showing a state where the head cartridge is mounted on the carriage, respectively.

FIG. 28A is an exploded perspective view of the above mentioned carriage 2011.

Here, 2613 is a roller spring as described later, and 2615 is a lever stop for mounting an operation lever 2015 onto a mounting portion 2617 on the carriage 2011. 2619 is a mounting member constituting one end portion of a flexible cable 2021, for fixing upper edge portions of a flexible substrate 2604 and a rubber pad 2605 integrated therewith in this example to the support plate 2606, while 2621 is also a mounting member for fixing lower edge portions thereof.

In addition to the construction as above mentioned, a substrate cover 2623 is provided for covering the flexible substrate 2604 on the carriage side when the head cartridge 2009 is not attached, and protecting the flexible substrate 2604 and a circuit within the main body connected thereto, from a contact with hands of an operator and a breakage due to said contact or an action of an electrostatic force. This substrate cover 2623 is rotatably secured into pins 2621A on the lower edge portion mounting member 2621 for the substrate. 2625 is a spring for exerting a tendency to rotate the substrate cover 2623 toward the direction of covering the flexible substrate 2604, and 2627 is a recess for housing the substrate cover 2623 when the head cartridge 2009 is attached.

Figure 28B:
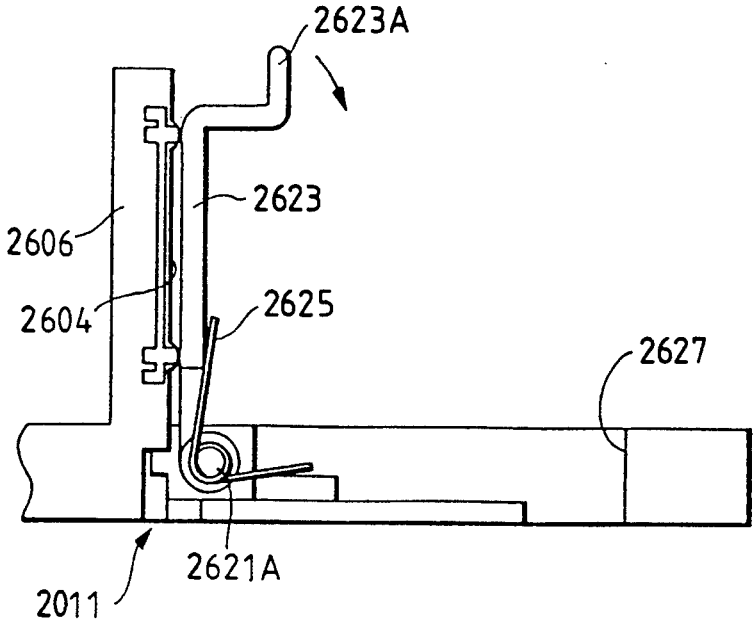
Figure 28C:
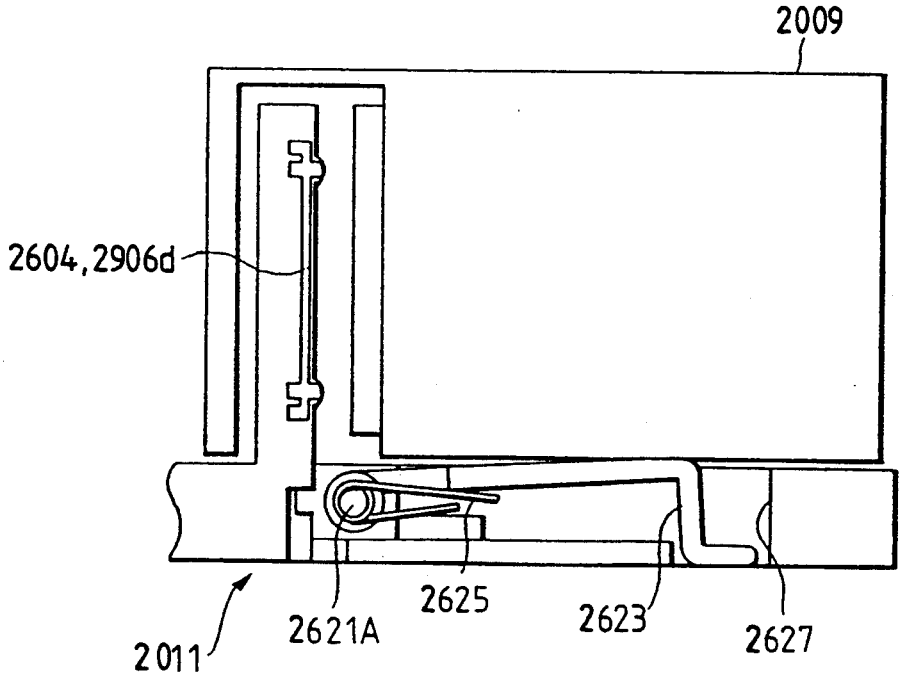

Referring now to FIGS. 28B and 28C, the operation of the substrate cover 2623 will be described. When the head cartridge 2009 is not attached, the substrate cover 2623 covers a flexible substrate 2604 with a biasing force of a spring 2625, as shown in FIG. 28B. If the head cartridge 2009 is attached from an upper side in the above state, the substrate cover 2623 is rotated clockwise in the figure around pins 2621A against the biasing force of the spring 2625, with the engagement between the lower surface of the head cartridge and a cover operation portion 2623A, or the engagement between an operator hand and the operation portion 2623A. And if the head cartridge 2009 is completely attached, and the substrate 604 is placed in direct contact with the substrate 2906*d* on the head side, the cover 2623 is housed in the recess 2627 by being pressed against the lower surface of the head cartridge 2009, as shown in FIG. 28C. It should be noted that if the head cartridge 2009 is removed, the cover 2623 immediately returns to the state as shown in FIG. 28B, thereby protecting the substrate 2604.

Figure 29A:
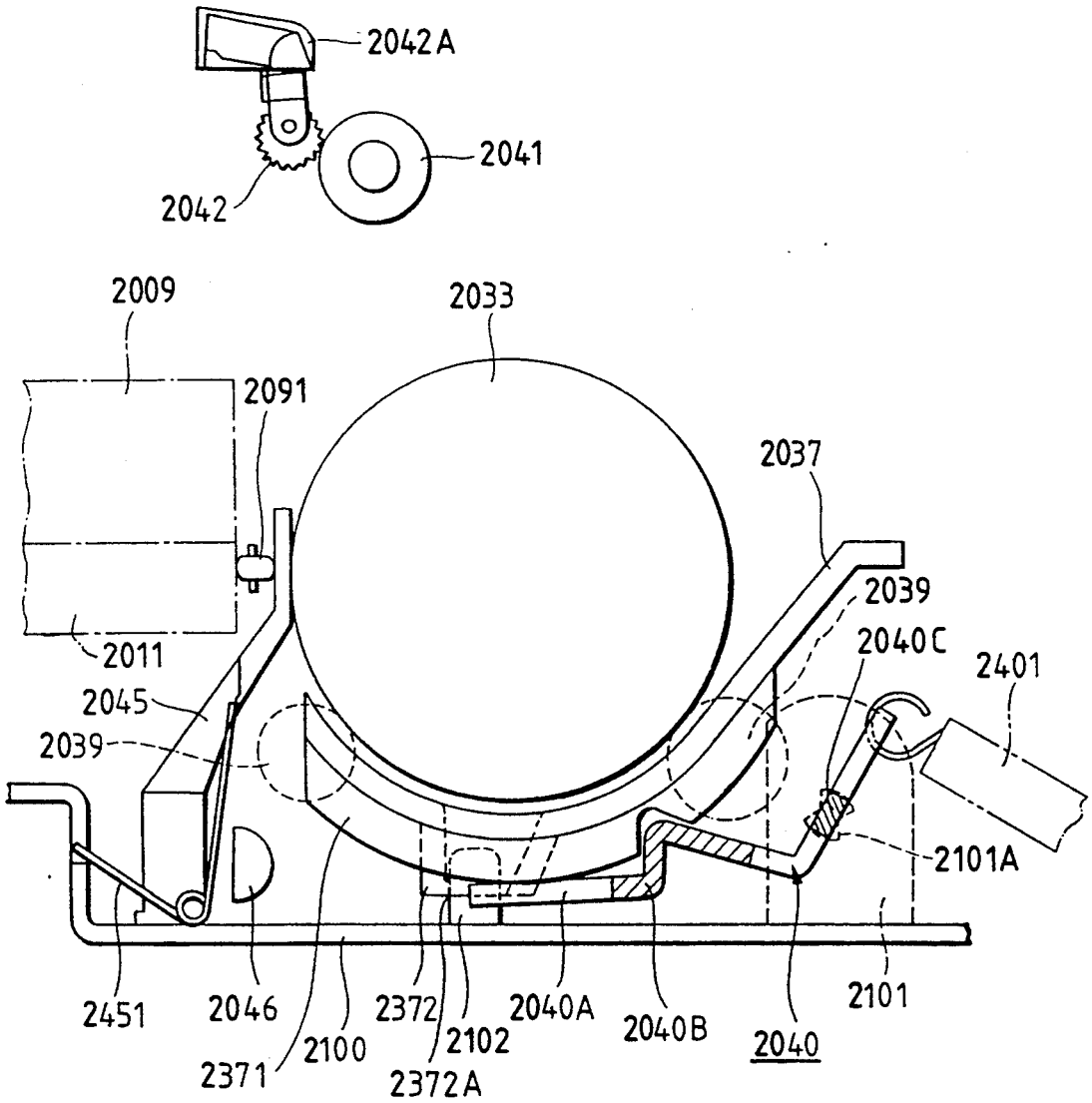
FIGS. 29A and 29B are cross-sectional side and exploded upper views of a recording medium conveying system of the printer as shown in FIG. 25, respectively.

FIG. 29A is a typical side view for mainly showing a recording medium conveying system of the apparatus as shown in FIG. 2.

FIG. 29A shows an arrangement of each of elements at the normal conveyance of a recording medium. The recording medium fed from a feed paper tray not shown is introduced into a conveying path formed between a conveying roller 2033 and a paper pan 2037. In this conveying path, the recording medium is conveyed with the friction force between the conveying roller 2033 and the recording medium, based on the pressing force of the feed roller 2039, by the conveying roller 2033 rotating clockwise in the figure. Thereafter, the recording medium is introduced between the conveying roller 2033 and a paper presser bar 2045, and then also conveyed with the friction force between the conveying roller 2033 and the recording medium, based on the pressing force of the paper presser bar 2045. Further, the recording medium is regulated in the direction by the paper presser bar 2045, and conveyed along a platen 2034 between a paper exhausting roller 2041 and a spur 2042, while the recording is performed onto the recording medium with the discharge of ink droplet from a recording head cartridge 2009.

Figure 29B:
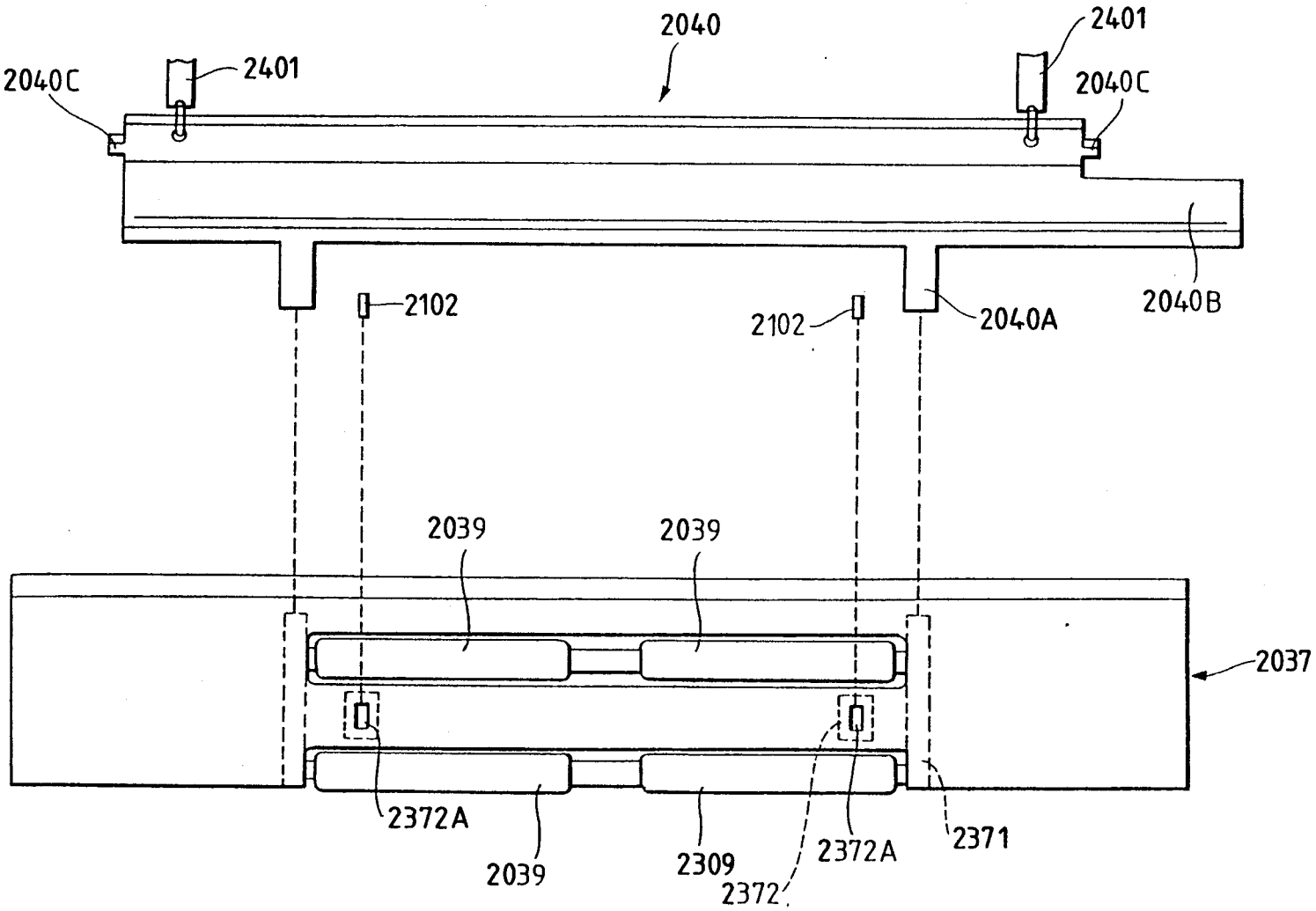

FIG. 29B is a top view showing a paper pan 2037, and a release plate for forcing it in the direction toward the conveying roller 2033, which are separated for clarity of explanation.

Referring now to FIGS. 29A and 29B, the mechanism for conveying a recording medium will be described. In these figures, 2040 is a release plate which is a member for pressing a feed roller 2039 to a conveying roller 2033 via a paper pan 2037, and releasing that pressing force. The release plate 2040 rotatably bears on an axis such that axis portions 2040C provided on the ends thereof are in engagement with axis holes 2101A on an axis bearing member 2101 for the release plate 2040 stood on a bottom plate 2100 of the mechanism, so that if this portion is forced obliquely toward the right lower direction by a spring 2401 engaging at two end positions of the release plate 2040, the release plate 2040 rotates clockwise by bearing on the axis portion 2040C, as shown in FIG. 29A. 2371 are ribs provided at two locations underneath the paper pan 2037. The ribs 2371 are brought into contact with the pressing portion 2040A during the above rotation of the release plate 2040, and pressed upwardly in FIG. 29A. Thereby the feeder roller 2039 which bears on the ribs 2371 presses the conveying roller 2033.

The release of pressing force with the release plate 2040 is performed in such a way that a shoulder 2040B extending at one end of the release plate 2040 is pressed downwardly in FIG. 29A against the rotation force owing to a spring 2401. If this pressing force is released, the paper pan 2037 and the feed roller 2039 move downwardly by their weights, thereby providing a predefined amount of space between the feed roller 2039 and the conveying roller 2033.

2372 is a rectangular projection portion formed when a portion of the paper pan 2037 extends downwardly. In the projection portion 2372 is provided a rectangular hole 2372A, which engages a projection 2102 upstanding on the bottom plate 2100 with a predetermined amount of looseness. With this engagement, the positioning of the paper pan 2037, and hence the feed roller 2039 with respect to the conveying roller 2033 can be performed.

Figure 30A:
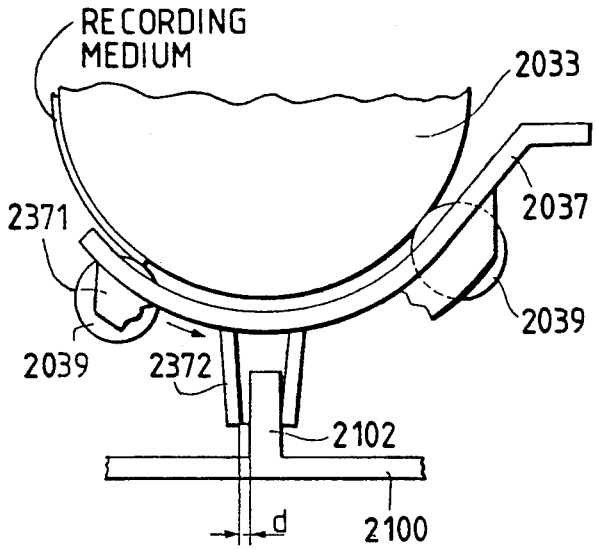
FIGS. 30A and 30B are typical side views showing a configuration for the run off of a feed roller in the above mentioned conveying system.
Figure 30B:
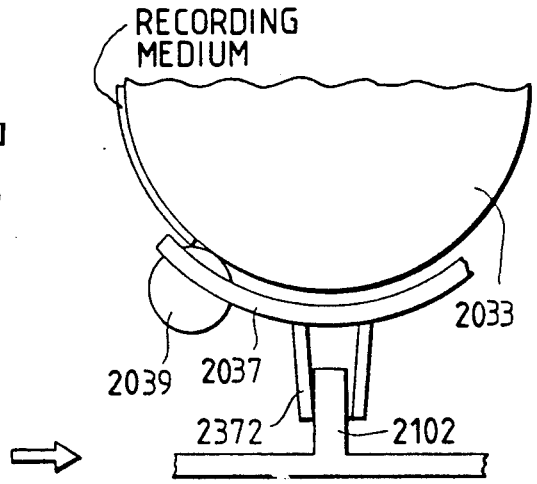

With the arrangement having a looseness in the above engagement, an adverse effect due to a so called kicking, which occurs when a trailing portion of a recording medium to be conveyed passes through the feed roller 2039, can be eliminated. While the recording medium is transferred from the state where a trailing portion of the recording medium is pressed against the conveying roller 2033 by the feed roller 2039 as shown in FIG. 30A, to the state where the feed roller 2039 and the conveying roller 2033 are in direct contact with each other as shown in FIG. 30B, it is forced out between the feed roller 2039 and the conveying roller 2033. In a conventional construction, especially when the recording medium is an envelope or a cardboard, such kicking phenomenon occurs with the force exerting on various portions in forcing out the recording medium.

Figure 30C:
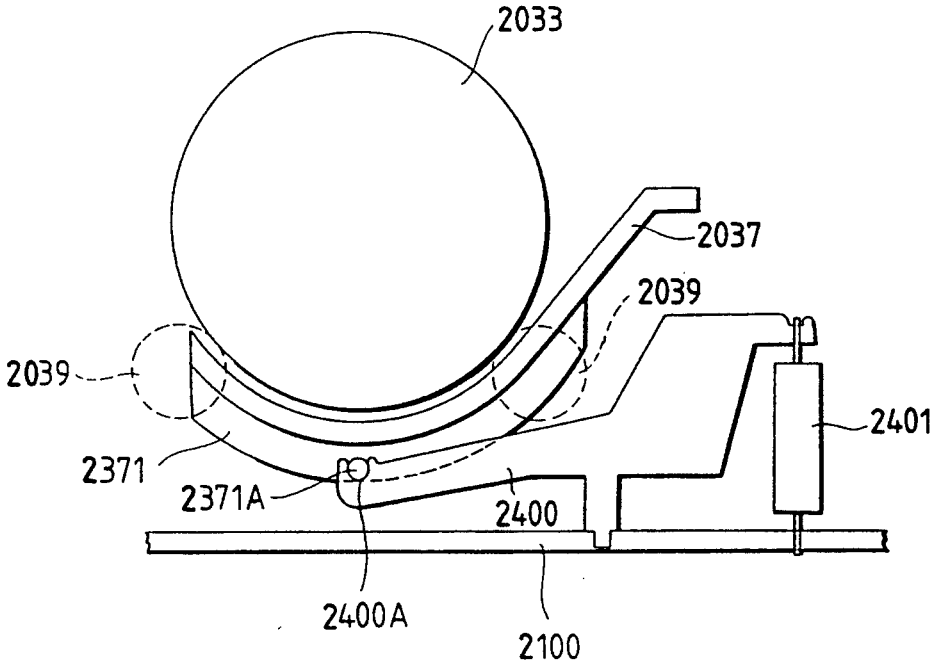
FIG. 30C is a typical side view showing one conventional example of an energizing mechanism for a feed roller.

For example, in a conventional construction for carrying the paper pan as shown in FIG. 30C, or in a construction where the boss 2371A of the paper pan 2037 is carried by the engagement portion 2400A of the energizing member 2400 not to escape in the forward and backward directions (left and right directions in the figure), the feed roller 2039 can not escape in a reverse direction to the direction of forcing the recording medium out, thereby causing the conveying roller 2033 to be rotated in forcing out the recording medium, so that the recording medium is conveyed by a greater distance than a predetermined amount. Consequently, there occurred such a problem that a recording position on the recording medium is deviated.

On the contrary, in the construction in accordance with this example as shown in FIG. 29A, FIGS. 30A and 30B, the paper pan can escape by a distance d with the above engagement in the right direction in the figures, in forcing out a trailing portion of the recording medium, in which the force due to the extrusion will not be exerted on the recording medium and the conveying roller 2033, thereby such a problem as above mentioned does not occur.

Referring now to FIG. 29A again, 2451 is a spring for biasing the paper presser bar 2045 in the direction toward the platen 2033.

The spring 2451 has one end thereof extending from the coil-shaped portion engaged with a portion of the paper presser bar 2045, and the other end engaged with a portion of the bottom plate 2100 of the mechanism. The coil-shaped portion bears on a portion of the bottom plate 2100. The paper presser bar 2045 is pressed via a roller 2091 provided on a leading portion of the carriage 2011 against the carriage 2011, as described later. The distance between the discharge ports of the head cartridge 2009 and a record face of the recording medium can be properly maintained by the biasing force via the roller 2091 by the spring 2045.

The paper presser bar 2045 also exerts the pressing force on the conveying roller 2033 via the recording medium due to the biasing force as above described, thereby conveying the recording medium with a friction force between the recording medium and the conveying roller 2033 based on that pressing force.

Here, to successfully convey various types of recording media, it is requisite to make appropriate the friction force between the paper presser bar and the recording medium, and between the conveying roller and the recording medium. In other words, it is desirable that the friction force between the paper presser bar and the recording medium is as small as possible, while that between the conveying roller and the recording medium is as large as possible.

Further, it is also desired to make the friction force between the paper presser bar and the conveying roller as small as possible. This is because if that friction force is large, the motor load becomes large at so-called idle feeding. If a predetermined amount of gap is provided between the paper presser bar and the conveying roller to avoid it, the precision control becomes difficult with respect to the pressing of the recording medium against the platen.

Hence, in this example, the material of the paper presser bar 2045 is POM (polyacetal), and that of the conveying roller 2033 is CR (chloroprene rubber, hardness 60° in JIS K6301 A scale) mixed with 5–10% (weight ratio) of monofilament of nylon resin. Fluororesin can be also used for the paper presser bar 2045.

It should be noted that the hardness of above mentioned chloroprene rubber was 60°, but if it is within the range from 50° to 70°, it does not have an adverse effect on the conveyance of the recording paper. It is not necessary that the conveying roller 2033 and the paper presser bar 2045 are entirely made of the material as above indicated, but only direct contact portions may be constructed of that material, or further the paper presser bar and the conveying roller can be formed by pasting a sheet member of the above material onto the body portion.

As the friction coefficient between the paper presser bar 2045 and the recording medium can be reduced by fabricating the paper presser bar and the conveying roller with any of above materials, the paper presser bar 45 can be configured to press against the conveying roller 33, as described above. Consequently, the distance between the recording medium and the head cartridge can be controlled more easily than that in a previous construction which did not allow for various paper thicknesses of recording medium. As the friction coefficient between the recording medium and the conveying roller becomes larger, the sliding does not occur during the conveyance, whereby the successful conveyance of the recording medium can be accomplished.

In FIG. 29A, 2046 is a shaft member which extends parallel to the paper presser bar 2045, in which both ends thereof bear on the device frame, with its cross-section being a D character shape. When a recording medium is conveyed, the rotation position is determined so that a straight portion of D character is placed in a longitudinal direction (from the upper to the lower direction in the same figure). On the other hand, when the pressing force of the paper presser bar 2045 against the conveying roller 2033 is released as shown in FIGS. 31 and 32, the straight portion of the paper presser bar is directed transversely (from the left to the right direction in FIG. 29A) so as to come into direct contact with a portion of the spring 2451, causing the spring to be biased, thereby releasing the engagement between the spring 2451 and the paper presser bar 2045. Thus, the pressing force is only released without changing the position of the paper presser bar 2045.

Consequently, even if the carriage is operated with the pressing force being released for the insertion of a recording medium, the head cartridge and the carriage are not damaged with the interference between the head cartridge and carriage and the paper presser bar. In other words, it is possible to perform various operations by moving the carriage, even while the pressing force of the paper presser bar is being released. The pressing force against the paper presser bar 2045 via the roller 2091 is not released in this case, but this pressing force is directed to one point of a portion where the paper presser bar 2045 is opposed to the carriage 2011, and so it does not have any problem for inserting the recording medium.

In FIG. 29A, 2041 is a paper exhausting roller, with which a spur 2042 engages. The spur 2042 is energized against the paper exhausting roller 2041 by the energizing means as shown in FIGS. 31 and 32, in which the recording medium can be also conveyed with the friction force between the recording medium and the paper exhausting roller 2041 based on that pressing force, as previously described. The spur 2042 is energized via a holding member 2042A against the paper exhausting roller 2041 as above described, and can be released from engagement therewith, by a detaching operation from the paper exhausting roller 2041 via the holding member 2042A.

Figure 29C:
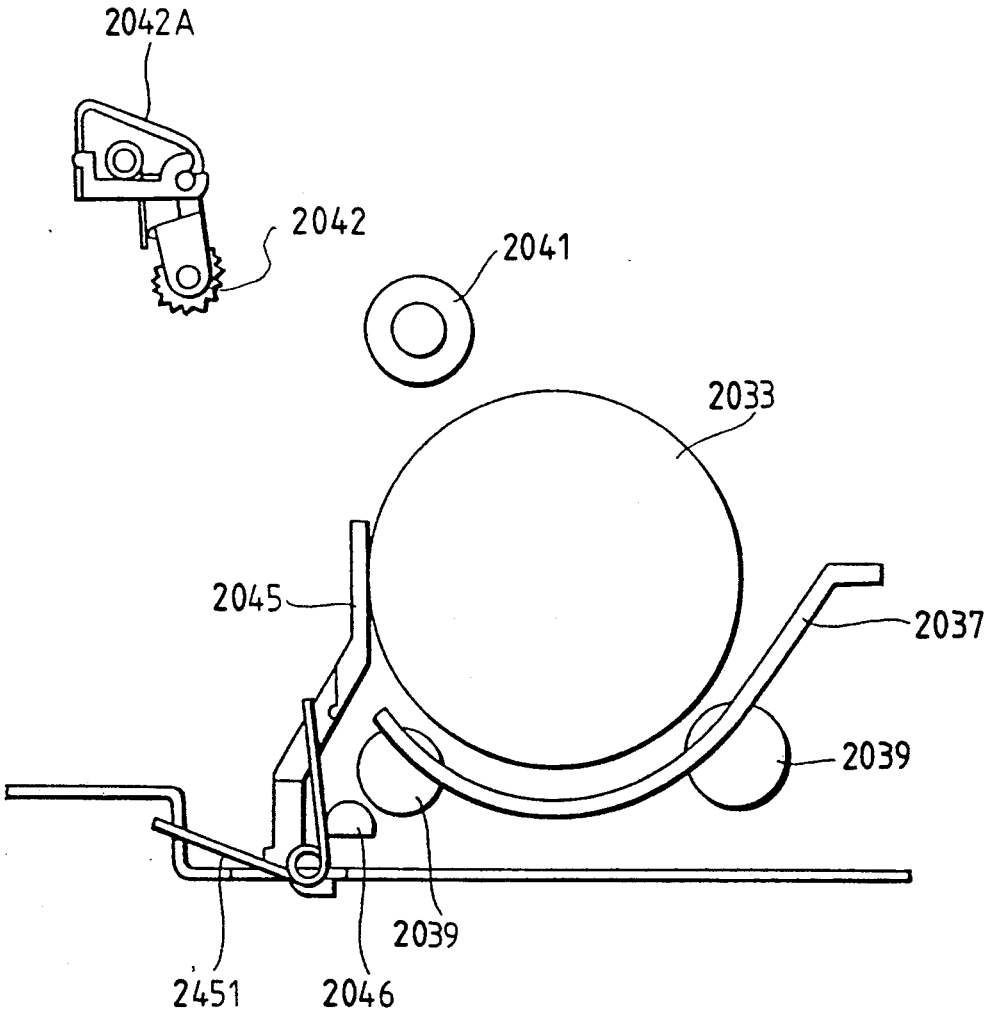
FIG. 29C is a cross-sectional side view showing a state where each energizing force is released on the above mentioned conveying system.

As described above, the paper pan 2037 (feed roller 2039), the paper presser bar 2045 and the spur 2042 as shown in FIGS. 29A and 29B can be released from their energizing forces in the respective forms. Those releases can be performed simultaneously by the operation of a release lever 2043 as shown in FIG. 25, resulting in the state as shown in FIG. 29C.

Figure 31A:
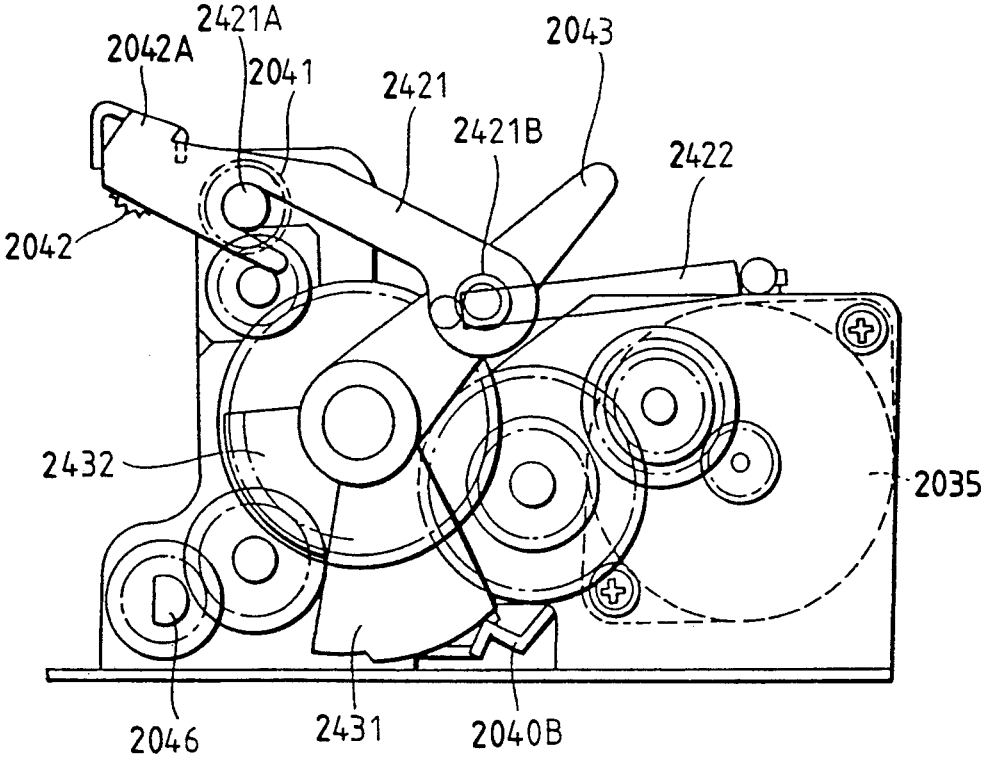
FIGS. 31A and 31B are side views of portions disposed on the right hand of a device in a mechanism for releasing an energized state of a feed roller, a paper presser bar and a spur on the above mentioned conveying system, before and after the releasing thereof, respectively.
Figure 31B:
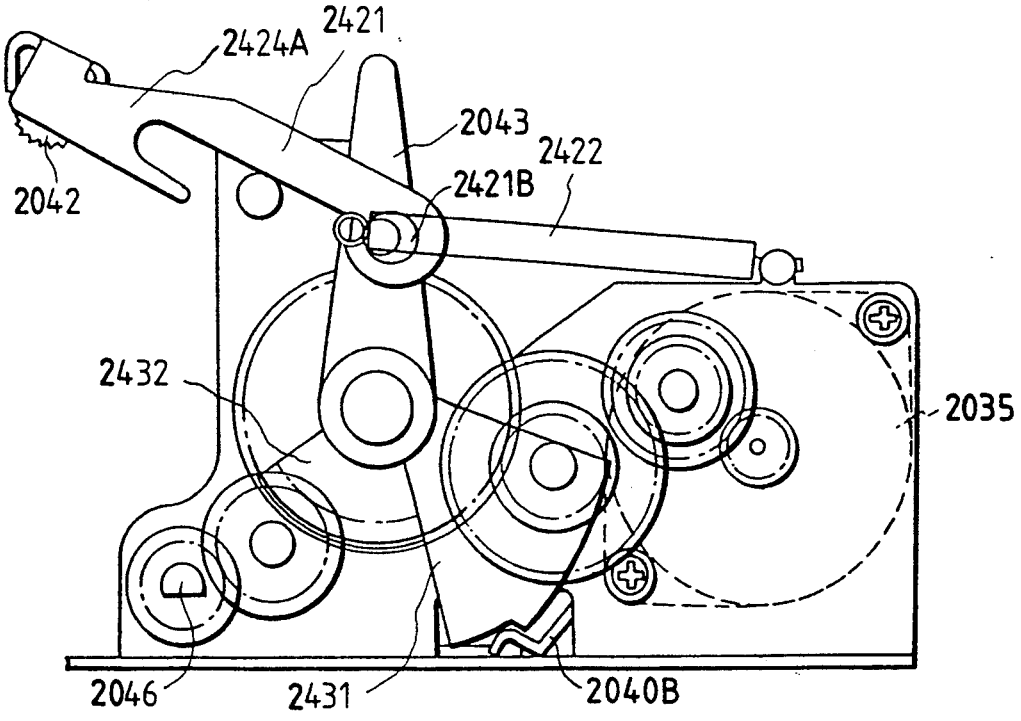
Figure 32A:
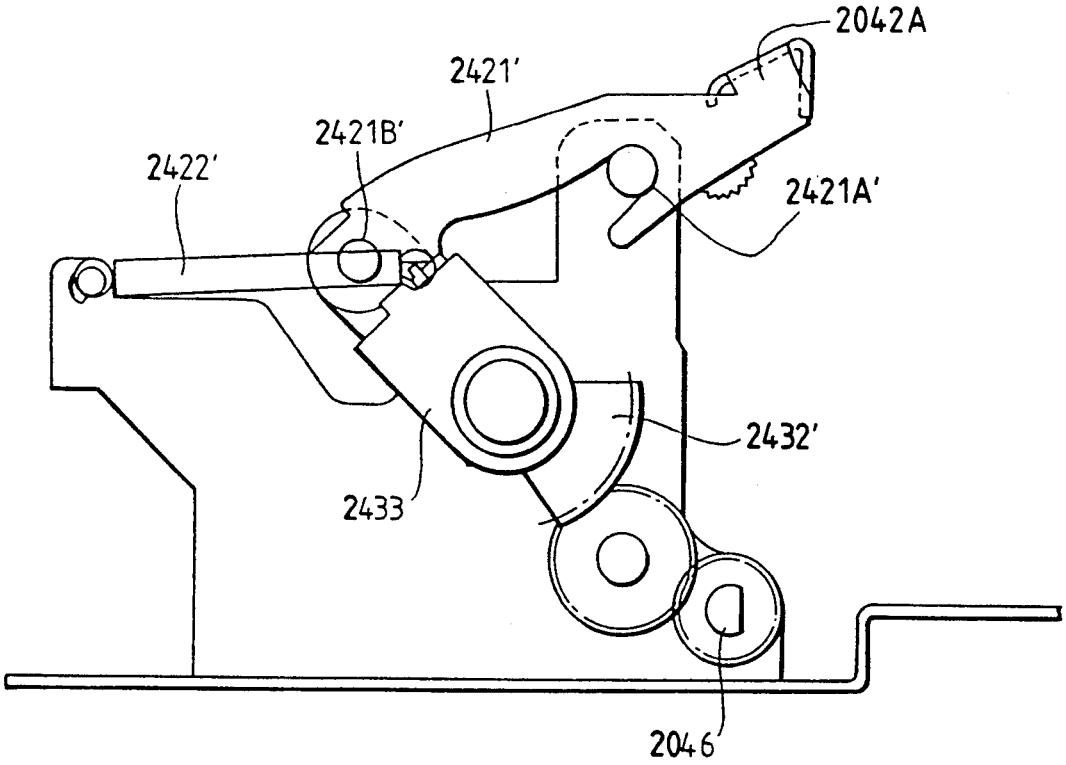
FIGS. 32A and 32B are side views of portions disposed on the left side of the device in the same mechanism, before and after the releasing thereof, respectively.
Figure 32B:
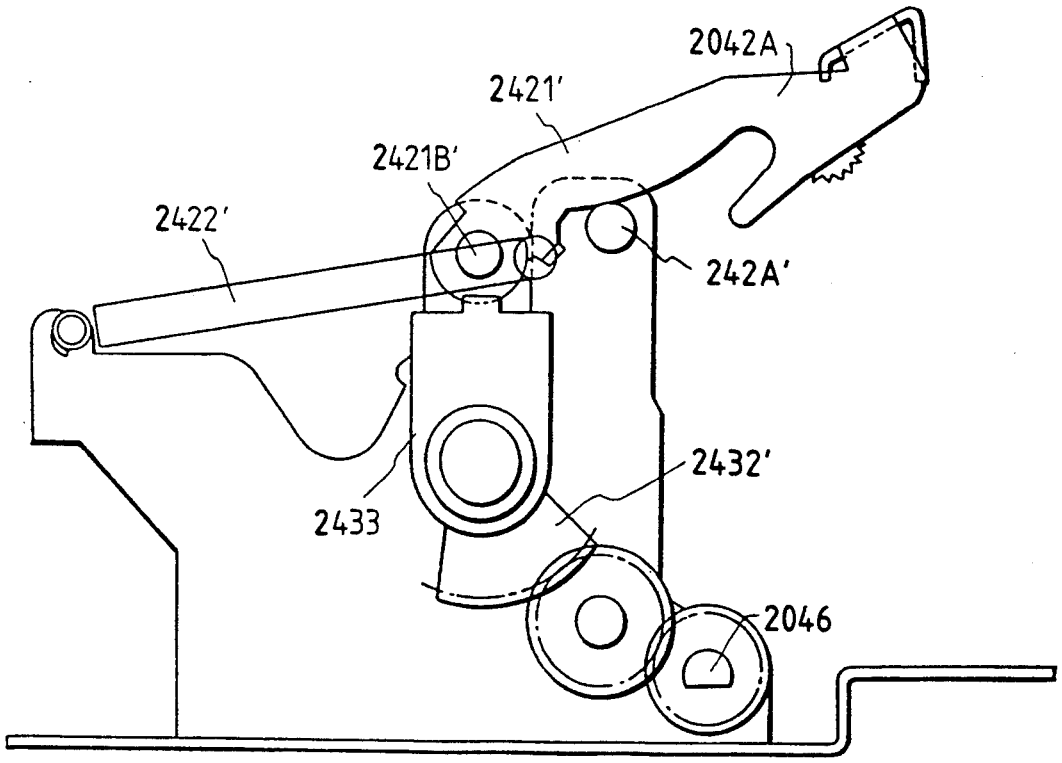

FIGS. 31A and 31B, and FIGS. 32A and 32B are views showing the mechanism for releasing the above mentioned energizing forces, in which FIGS. 31A and 31B show that mechanism of the recording apparatus viewed from the right side, while FIGS. 32A and 32B show the same mechanism viewed from the left.

FIG. 31A and FIG. 32A show a state where the energizing force in conveying a recording medium is not released. Then the release lever 2043 which rotatably bears on a shaft of the conveying roller 2033 is placed in a laid position due to the energizing force of a spring as described later, whereby a cam member 2431 fixed to the lever 2043, a gear 2432, and a gear 2432' disposed on the other end portion opposite to the end portion at which the lever 2043 is disposed, and fixed to the shaft coaxial with that of the conveying roller 2033 are in engagement with a shoulder portion 2040B of the release plate 2040 and a train of gears for rotating a shaft member 2046, with predetermined positional relations. Spur arms 2421 and 2421' extending from the spur holding member 2042 and disposed on both end portions thereof are forced backwardly of the device via the respective engagement portions 2421B and 2421B' in engagement with the lever 2043 and the connection member 2433, by the tensile forces of the springs 2422 and 2422'. In this energizing condition, the engagement portions 2421A and 2421A' provided on the respective spur arms can engage with the shaft of the paper exhausting roller 2041, so that the appropriate engagement between the spur 2042 and the paper exhausting roller 2041 with a proper position and a pressing force can be accomplished.

As the engagement of the spur arms 2421 with the release lever 2043 is accomplished with a predetermined amount of looseness, the appropriate engagement Of the spur 2042 with the paper exhausting roller 2041 can be performed without requiring a great precision for the shape of the spur arms 2421 and so on.

The rotation of the release lever 2043 is transmitted via a gear 2432 and a train of intermediate gears to the shaft member 2046, and therefrom to a train of intermediate gears and a gear 2432' on the opposite end portion, and the connection member 2433, finally moving the spur arm 2421'. In this case, the looseness due to the backlash between gears interposed therein can be absorbed by the engagement with a looseness between the release lever 2043 and the spur arm 2421 as shown above.

It should be noted that a member that can be released from the energized condition with the above configuration is not limited to the spur, but may be any type of roller for conveying a recording medium.

FIGS. 31B and 32B show the state where the spur 2042, the paper presser bar 2045 and the paper pan 2037 have been released from the respective energized conditions. These releases can be accomplished by rotating the release lever 2043 forwardly of the device against the tensile force with the spring 2422.

That is, if the release lever 2043 is rotated, the gear 2432 is rotated accordingly. Then, as described above, the shaft member 2046 is rotated via the train of intermediate gears in engagement with the gear 2432, thereby making a straight line portion of D character cross-wise, so that the shaft member 2046 forces the spring 2451 toward the direction for narrowing the spring 2451, as described above in FIG. 29A, thus releasing the engagement between the spring 2451 and the paper presser bar 2045, and so releasing the energizing force for the paper presser bar 2045.

Along with the rotation of the release lever 2043, a cam 2431 can be rotated. With a cam portion of the cam member 2431 is engaged the shoulder portion 2040B of the release plate 2040, as described above in FIG. 31, and when the cam member 2431 rotates, the release plate 2040 lowers its position and thus releases the engagement with the ribs 2371 of the paper pan 2037, thereby not pressing the ribs 2371. Consequently, the force for energizing the paper pan 2037 (feed roller 2039) toward the conveying roller 2033 is released, and the paper pan 2037 falls downward by its weight. With the rotation of the release lever 2043, the shoulder portion 2040B and a step-like cam portion of the cam member 2431 are finally engaged, so that the engagement position thereof is fixed, and therefore the rotational position of the release lever 2043 is fixed.

Furthermore, with the rotation of the release lever 2043, the spur arm 2421 moves forwardly of the device, and with the transmission of the rotation via the shaft member 2046, as described above, the spur arm 2421' on the opposite end portion moves forwardly of the device, whereby the spur 2042 connecting to the spur arms 2421, 2421' is released from the engagement with the paper exhausting roller 2041.

In this way, by rotating the release lever once, the energizing force for the paper pan, the paper presser bar and the spur can be released, which is accomplished with a simple construction.

It should be noted that a support for the paper pan is constructed with the energizing against the release plate, and the engagement between a projection provided on the bottom plate of device and a long hole of the paper pan in the above example, but it is also constructed such that the shape of the engagement portion 2400 is a long hole toward which the paper pan can run off, as shown in FIG. 30C.

Figure 33:
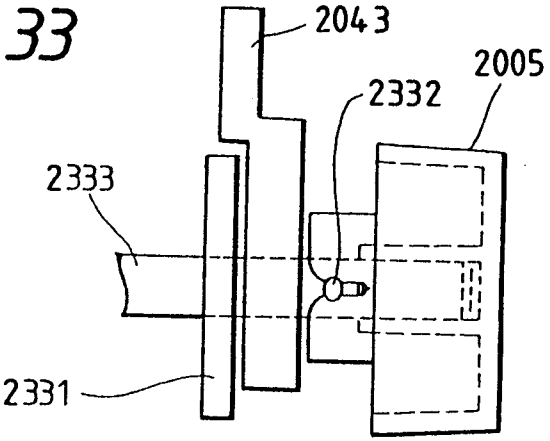
FIG. 33 is a typical front view showing an engaged state between a lever and a knob for releasing the above mentioned energizing.
Figure 36:
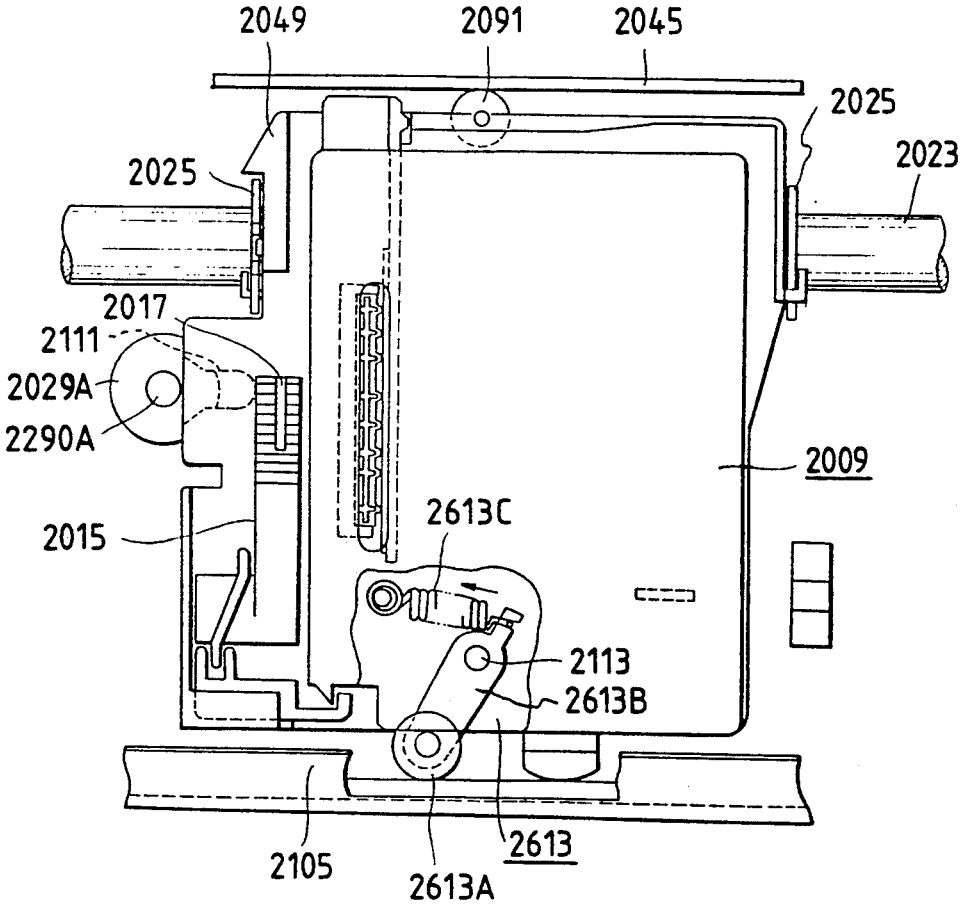

FIG. 33 is a typical front view showing a knob fixed to the shaft of the conveying roller 2033 and an assembled state of the release lever as above mentioned, and FIG. 36 is a typical exploded view.

In FIG. 33, a driven gear 2321 for rotating the conveying roller 2033 is fixed to a shaft 2333 of the conveying roller 2033, while a knob 2005 is fixed to the shaft 2333 by a spring pin 2332 drifted into the shaft 2333. The release lever 2043 freely rotatably bears on the shaft between them, but has a range of rotation restricted by a spring as above described.

Figure 34:
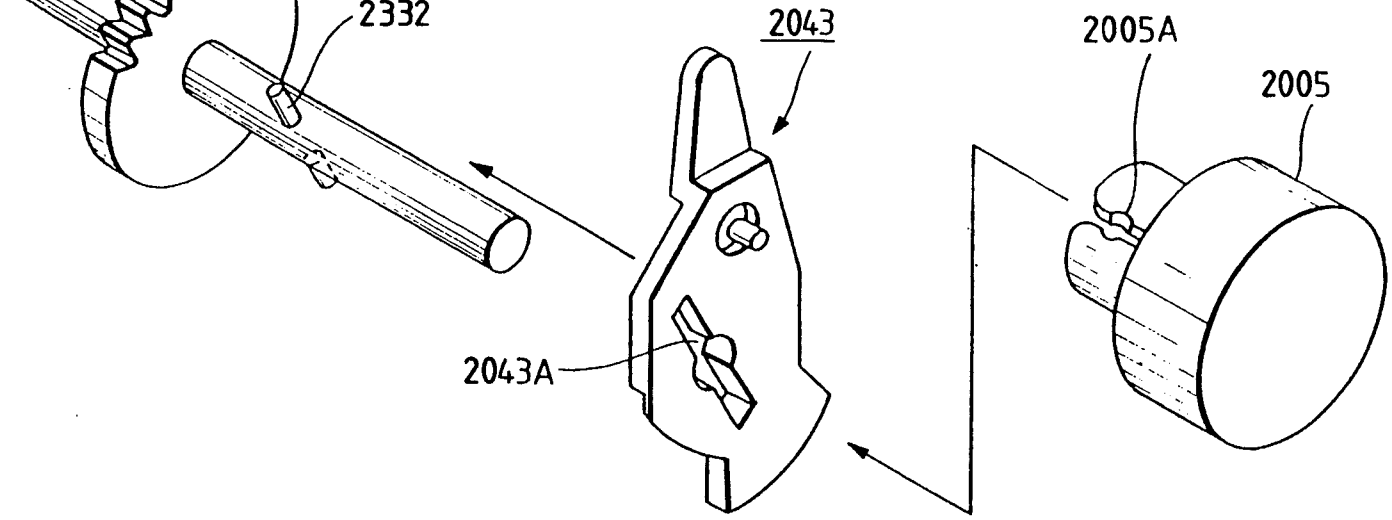
FIG. 34 is an exploded perspective view of the mechanism as shown in FIG. 35.

FIG. 34 is a view for explaining a sequence of assembling the above construction. As shown in the same figure, the spring pin 2332 has been drifted into the shaft 2333 beforehand, to which a gear 2331 is fixed. The release lever 2043 is inserted into the shaft 2333 in this state through an opening section 2043A. The opening section 2043A has a shape through which the shaft 2333 and the spring pin 2332 can pass as shown in the same figure, whereby the release lever 2043 can move beyond a position where the spring pin 2332 was drifted, to the side of gear 2331. Thereafter a knob 2044 is fixed by fitting the spring pin 2332 into a slit 2005A while inserting the knob 2005 into the shaft 2333.

With the above construction, the axial movement of the release lever 2043 can be restricted by means of the gear 2331 and the knob 2005, and the knob 2044 can be fixed by means of the spring pin 2332. As the spring pin 2332 is drifted beforehand into the shaft 333, the assembling is simpler than a case where the spring pin is drifted after inserting the lever.

Figure 35:
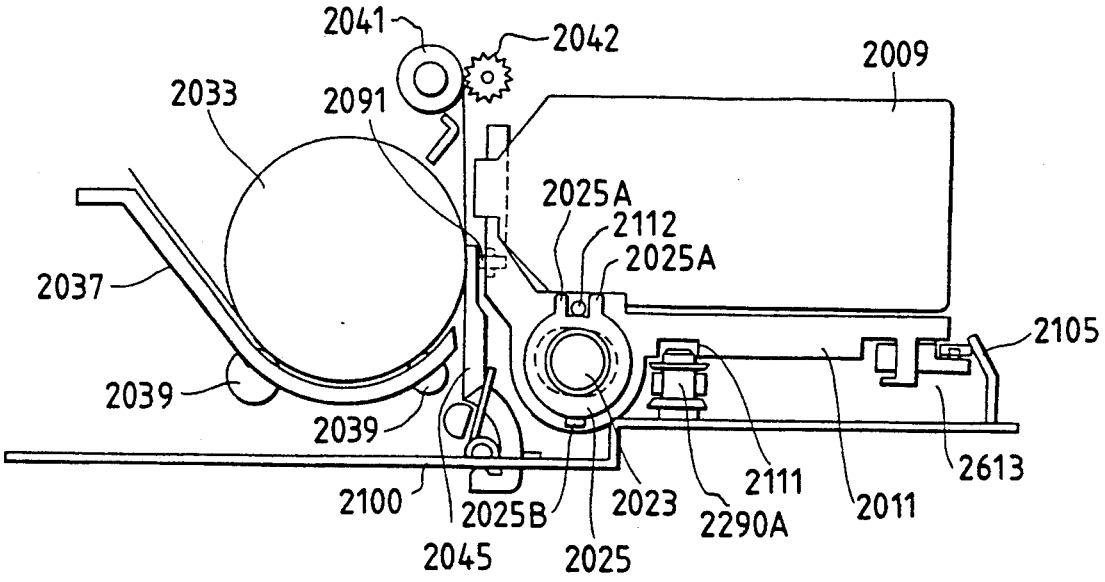
FIG. 35 and FIG. 36 are side and upper views for explanation of an engagement relation of the carriage as shown in FIG. 25 with other elements, respectively.

FIGS. 35 and 36 are side and upper views showing the mechanism around a head cartridge as shown in FIG. 25.

In these figures, 2091 is a roller which freely rotatably bears on a shaft at a front end portion of the carriage 2011, as previously described. The roller 2091 is provided so that a portion thereof may project forwardly of a discharge port face of the head cartridge, in which it comes into direct contact with the paper presser bar 2045 and rotates thereon. 2613 is a roller spring provided on a trailing portion of the carriage 2011. The roller spring 2613 is comprised of a roller 2613A, a connection member 2613B on which the roller 2613A bears, and a spring 2613C for energizing the connection member 2613B toward a predetermined rotational direction. The roller 2613A is brought into direct contact with a front end plate 2105 which extends parallel to a guide shaft as previously described, at a front end portion of the bottom plate 2100 of device, on which it rolls. The connection member 2613B freely rotatably bears on a predetermined shaft 2113 of the Carriage 2011, while the spring 2613C is carried on a predetermined axis to force the connection member 2613B to rotate counterclockwise around the shaft 2113. With the above construction of the roller spring 2613, the carriage 2011 is always energized toward the paper presser bar 2045.

2025 are is bearings for engaging with a guide shaft 2023, mounted on both side end portions of the carriage 2011. The bearings 2025 have the bearing portion eccentric to the case to be mounted, in which two bearings 2025 are mounted with the eccentric direction being opposite to each other. The bearing 2025 on the side as shown in FIG. 35 is able to swing around a boss 2112 on the carriage 2011. That is, a portion of the carriage 2011 to which this bearing 2025 is mounted is formed with a long hole, with two projections 2025A of the bearing 2025 regulating the movement in the forward or backward direction (the left or right direction in FIG. 35) in conjunction with the boss 2112. Consequently, this bearing 2025 swings relative to the carriage 2011, in correspondence with the movement of the carriage 2011, as will be described later. The movement of this bearing 2025 in the direction toward the guide shaft 2023 is regulated to a part of the carriage 2011 (refer to FIG. 28A) by a projection 2025B provided on the bearing 2025.

Figure 37B:
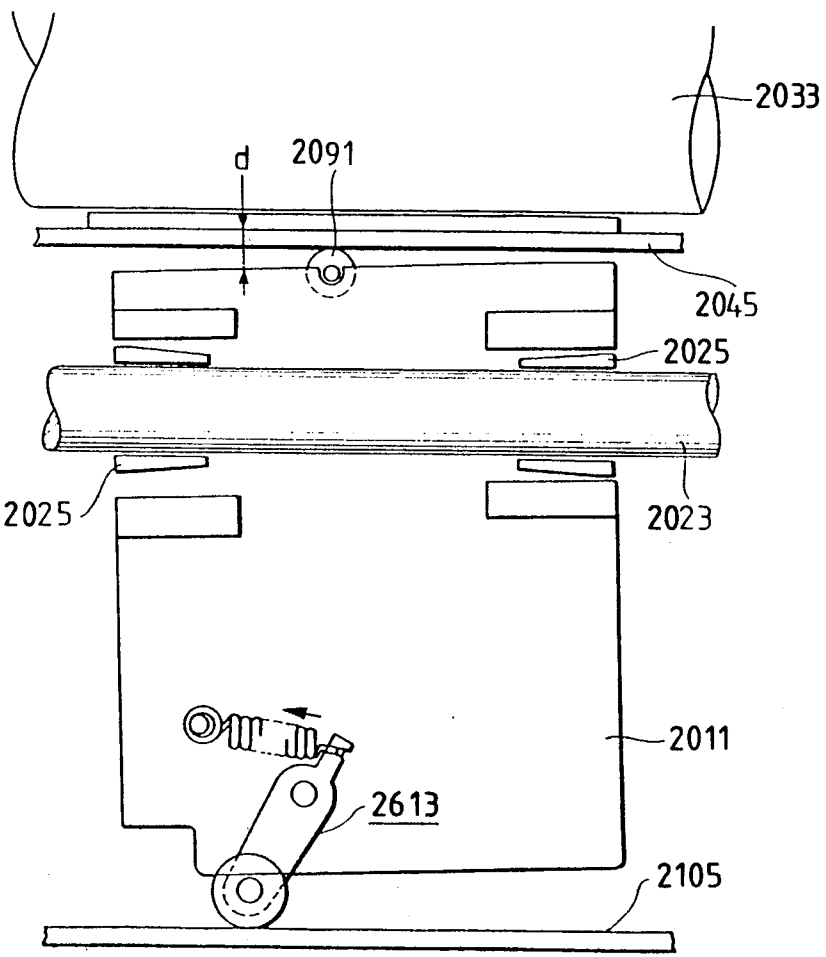
FIGS. 37A and 37B are typical upper views showing how the above mentioned carriage changes its position depending on the thickness of a recording medium.
Figure 37A:
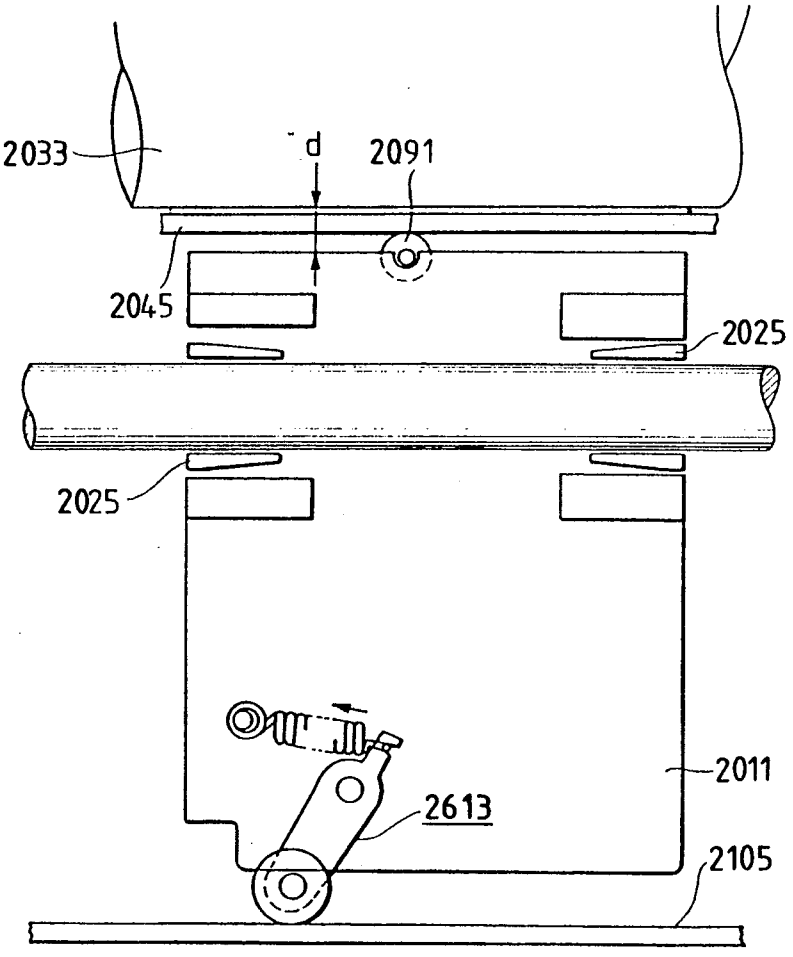
Figure 38:
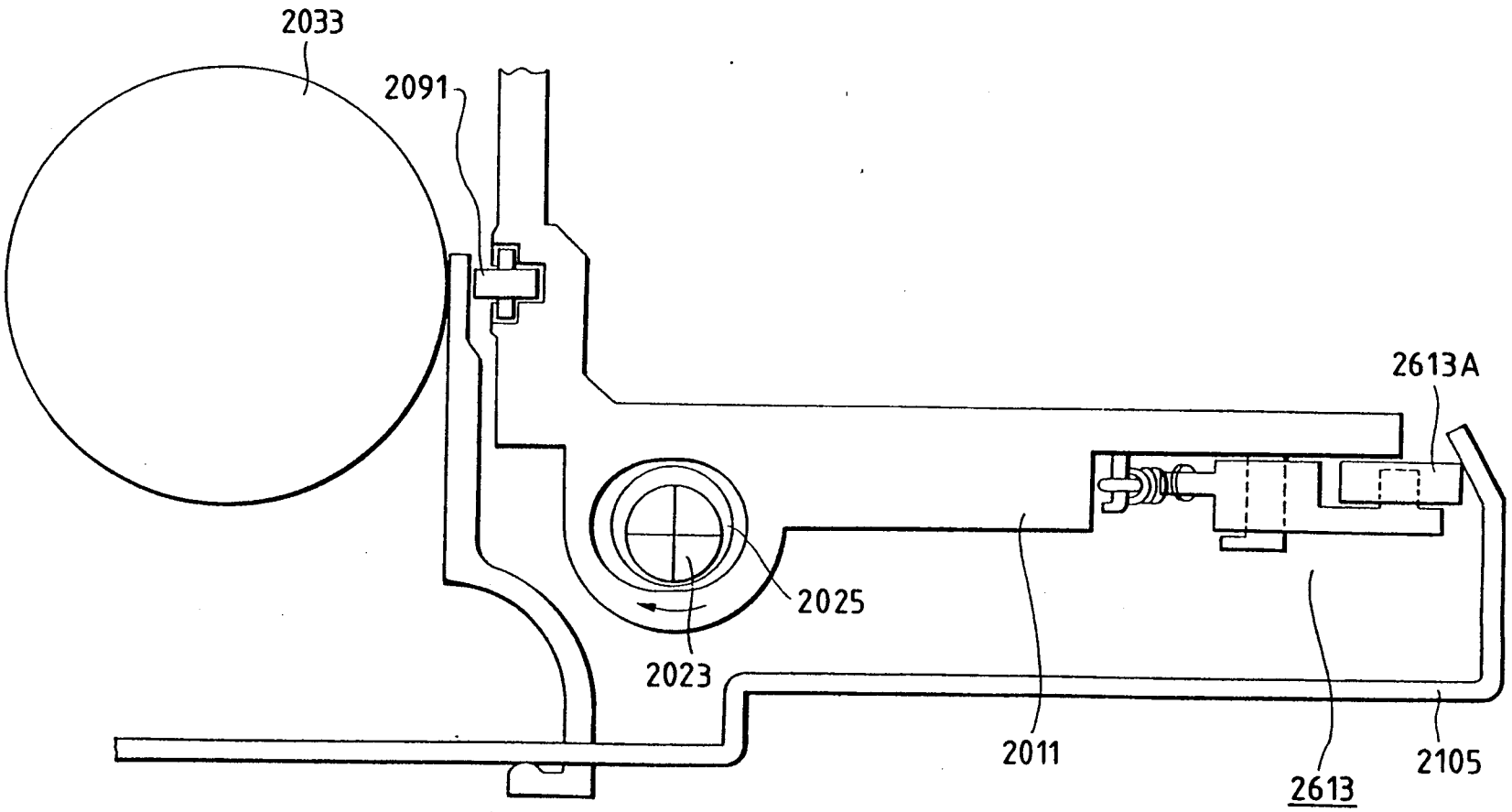
FIG. 38 is a typical side view for explanation of the change of a guide bearing accompanied by the above mentioned change.

Referring now to FIGS. 37 and 38, the automatic adjustment of an interval (hereafter referred to as a gap) between a recording medium and a discharge port face of the head cartridge, based on the construction of the roller 2091, the roller spring 2613 and bearings 2025 will be described in the following.

The automatic adjustment of the gap can be performed depending on the thickness of a recording medium inserted between the paper presser bar 2045 and the platen roller 2033. When the recording is performed onto a relatively thin, ordinarily used recording medium as shown in FIG. 37A, the left bearing 2025 in FIG. 37 is located almost centrally in the long hole. The carriage 2011 is energized toward the paper presser bar 2045 by a reaction force from the front end plate 2105 biased by the roll spring 2613, whereby the roller 2091 presses the paper presser bar 2045. Respective reaction forces against the force with which the roller 2091 presses the paper presser bar 2045, and the force with which the above mentioned roller spring 2613 biases the front end plate 2105 may cause the moments around the right bearing in FIG. 37A, respectively, and the position of the bearing 2025 in the long hole as indicated above can be determined when two moments are in equilibrium. In other words, the guide shaft 2023 fixed to the body of device, and hence the position of the carriage 2011 relative to the bearings 2025 are determined, so that a gap d between discharge ports of the head cartridge 2009 mounted thereon and a recording medium can be determined.

FIG. 37B shows a position of the carriage 2011 when the recording is performed onto a relatively thick recording medium, e.g. an envelope. In this case, the roller 2091, and hence the carriage 2011 retract downwardly in the same figure due to the thickness of a recording medium, as compared with those in FIG. 37A. Thereby a reaction force from the front end plate 2105 caused by the roll spring 2613 changes, so that an equilibrium position of the above moments correspondingly changes. Consequently, a relative position between the bearing 2025 on the left side in the figure and the carriage 2011 changes, whereby the carriage 2011 has its front end portion open to the left side in FIG. 37, and the gap between the discharge ports and the recording medium is almost equal to a gap d as shown in FIG. 37A. In this case, the bearing 25 on the left side changes the position in the long hole by swinging relatively as indicated by an arrow in FIG. 38.

It should be noted that a recording medium thicker than an ordinary cardboard, for example, can be used with the positional change of the roller 2091, or the paper presser plate 2045 can be left away greatly corresponding to such cardboard and keep the gap fixed, with the position of the roller 2091.

In the above construction, as shown particularly in FIG. 38, the roller spring 2613 presses the roller 2613A downwardly, when the roller 2613A comes in direct contact with a bowed oblique portion of the front end plate 2105, so that the whole carriage 2011 is pressed downwardly. Consequently, the carriage 2011 is prevented from lifting up, so that the direction of ink discharge from the head cartridge 2009 mounted thereon can be made stable.

Referring to FIG. 36 again, 2111 is a cut away portion on the left side lower portion of the carriage 2011, to be engaged with a pulley axis 2290A near a home position. This engagement is accomplished when the carriage 2011 moves to a cap position on the discharge port face, and in this engagement position, the discharge port face is covered with the cap 2051 (see FIG. 25).

With this engagement, even if the oscillation is applied to the recording apparatus, the cap 2051 is not detached from the discharge port face of the head cartridge 2009 because the carriage 2011 can not move in the forward or backward direction, whereby the capping is performed reliably.

As the pulley axis 2290A is also used to engage with the cut away portion 2111 of the carriage 2011, no particular member is necessary for this engagement, resulting in a simple and cheap construction.

Further, the cut away portion 2111 is formed with a beveled inlet portion so as to facilitate the engagement with the pulley axis 2290 Therefore the engagement can be easily accomplished, even when the carriage 2011 is displaced depending on the thickness of a paper.

Figure 39:
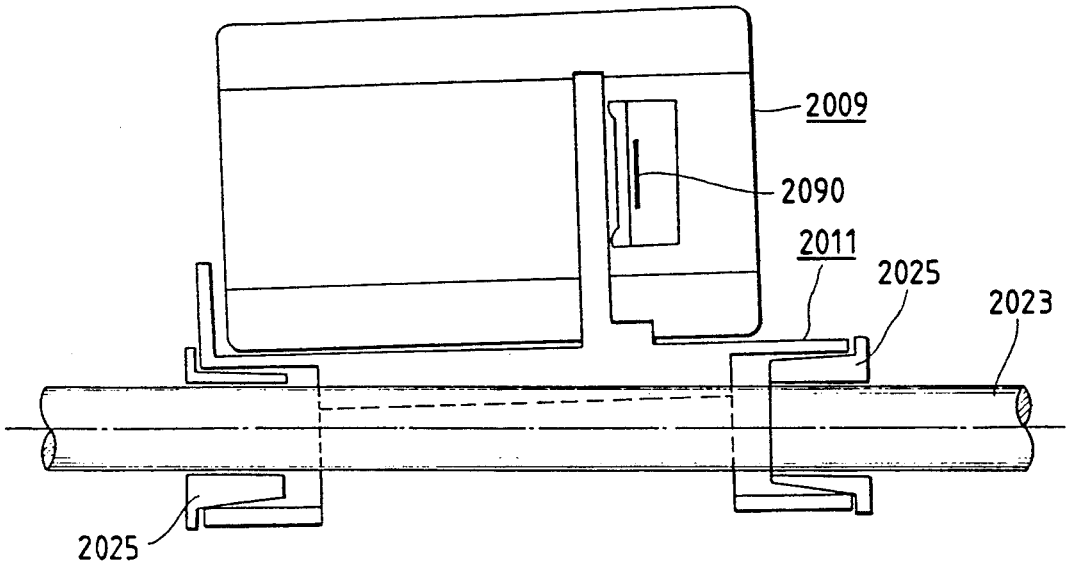
FIG. 39 is a typical front view showing a mechanism for inclining an array of discharge ports to the moving direction of the carriage as shown in FIG. 25.

FIG. 39 is a typical elevation view of the head cartridge 2009 and the carriage 2011 viewed from a recording medium side.

As clearly shown, the carriage 2011 and the head cartridge 2009 mounted thereon are inclined to the guide shaft 2023, and hence to the moving direction of the carriage 2011, so that the direction of an array of the discharge ports is also inclined.

This inclination is made by using two bearings 2025 whose bearing portions are eccentric as above described. That is, the left bearing 2025 (right bearing in FIG. 39) is mounted with its eccentric position located downwardly, as seen in FIG. 35 and FIG. 38, while the right bearing 25 (left bearing in FIG. 39) is mounted with its eccentric position located upwardly.

Figure 40A:
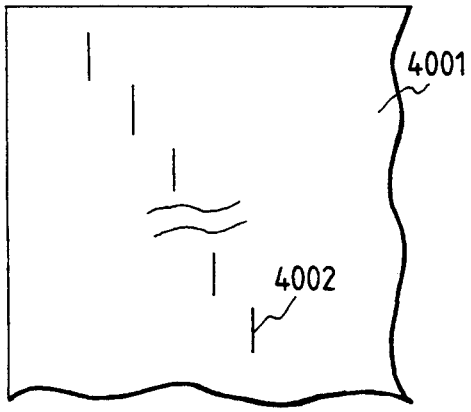
FIGS. 40A and 40B are typical plan views showing recording examples when the above mentioned inclining mechanism exists and does not exist, respectively.
Figure 40B:
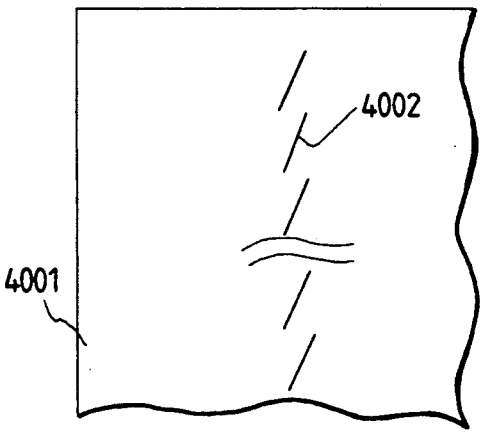

The configuration in which the array of discharge ports is inclined as above shown is used when a plurality of discharge ports ar driven with time division. An ink jet recording head is generally driven with time division from a viewpoint that the recording speed and the drive power can not be increased. For example, in a case where the vertically arranged 64 discharge ports are divided into 8 blocks to drive with the time division, if the array of discharge ports is not inclined, the recording is performed on a recording paper, as shown in FIG. 40A, taking into consideration the carriage movement, which represents slanting lines as macroscopically seen. On the contrary, if the array of discharge ports is inclined as in this example, the recording is performed as shown in FIG. 40B, which represents vertical lines as macroscopically seen. It should be noted that this inclination is not only effective to the time division drive for each block, but also to the time division drive for each discharge port. Here, in FIGS. 40A and 40B, 4001 is a recording medium, and 4002 is a line recorded on the recording medium.

Since the inclination according to this example is accomplished by the bearings 25 mounted on both side end portions of the carriage 2011, the precision of the inclination is easy to raise, because the distance between these bearings is relatively long. And as one type of bearings is necessary to mount in opposite vertical directions, the inclination is simply constructed. Furthermore, when the timings for the time division driving are different depending on the speed of the carriage, the inclination according to the above mentioned timing can be constructed by changing only the bearings without changes of the carriage and the recording head, so that it is possible to make a common use of the carriage.

Figure 41A:
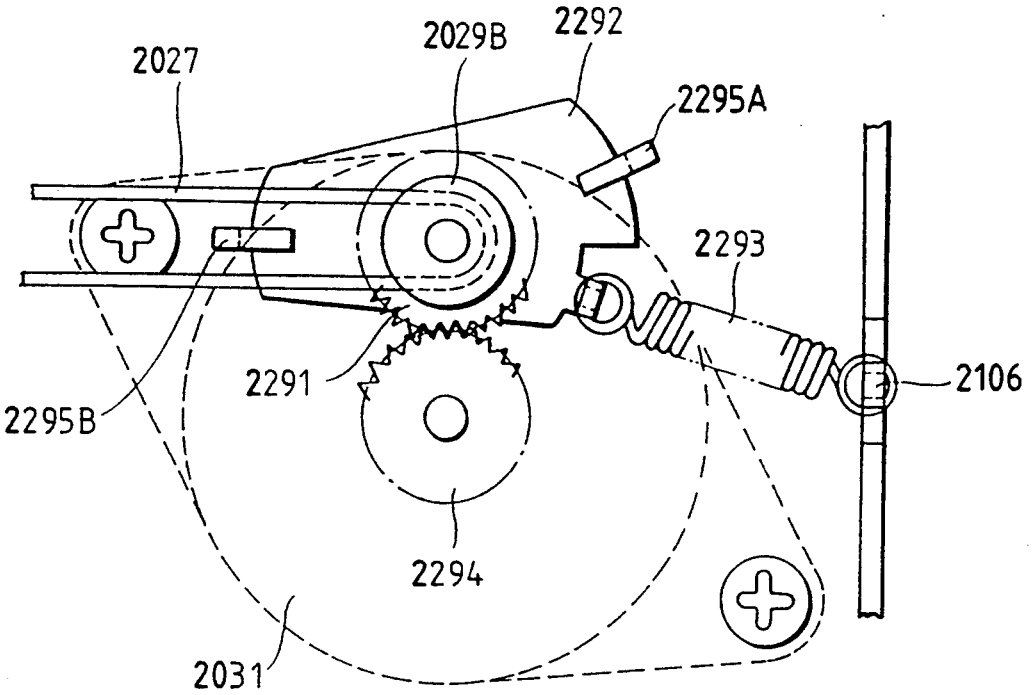
FIGS. 41A and 41B are upper and front views showing a tension mechanism for a belt and a drive mechanism for driving the carriage as shown in FIG. 25, respectively.
Figure 41B:
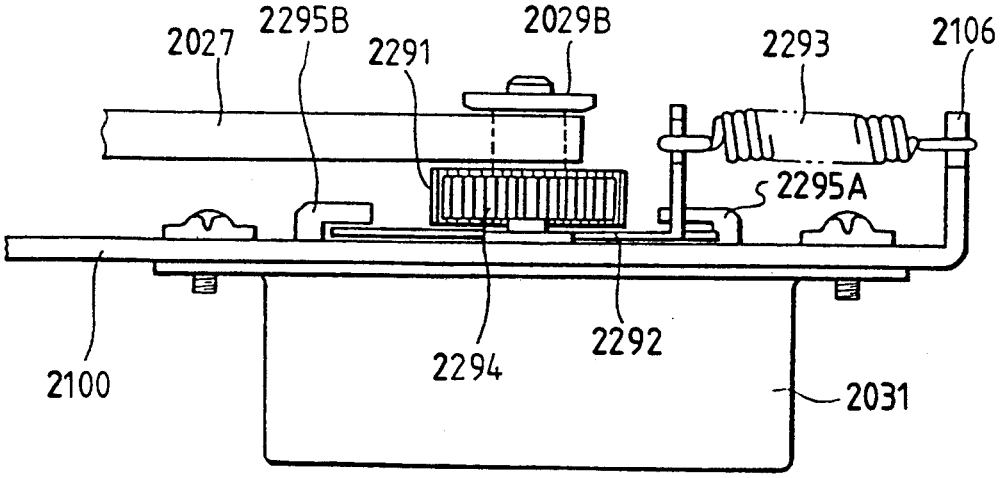

FIGS. 41A and 41B are upper and elevation views showing the detail near a pulley 2029B disposed on the right end portion of the device, wherein two pulleys are used to drive a timing belt for moving the carriage.

On the pulley 2029B is fixed coaxially a driven gear 2291, which mates with a drive gear 2294 fixed to the rotation axis of the carriage motor 2031. A bracket 2292 freely rotatably bears on a shaft to which the pulley 2029B and the gear 2291 are fixed.

One end of a spring 2293 is connected to the bracket 2292, while the other end thereof is connected to a projection 2106 stood on the bottom plate 2100. Thereby the bracket 2292 is energized in the direction deviated by a predetermined angle from the direction along which the timing belt 2027 extends. Then the bracket 2292 (and the gear 2291 and the pulley 2029B which bear on the shaft thereof) moves freely, except that it is restricted in the upper or lower direction by the L-shaped members 2295A and 2295B stood on the bottom plate 2100 and in a predetermined direction along the bottom plate 2100. Accordingly, with the above mentioned energizing force by the spring 2293, the tension on the timing belt 2027 and the mating force between the gear 2291 and the gear 2274 can be obtained depending on each component of the spring force.

Figure 42:
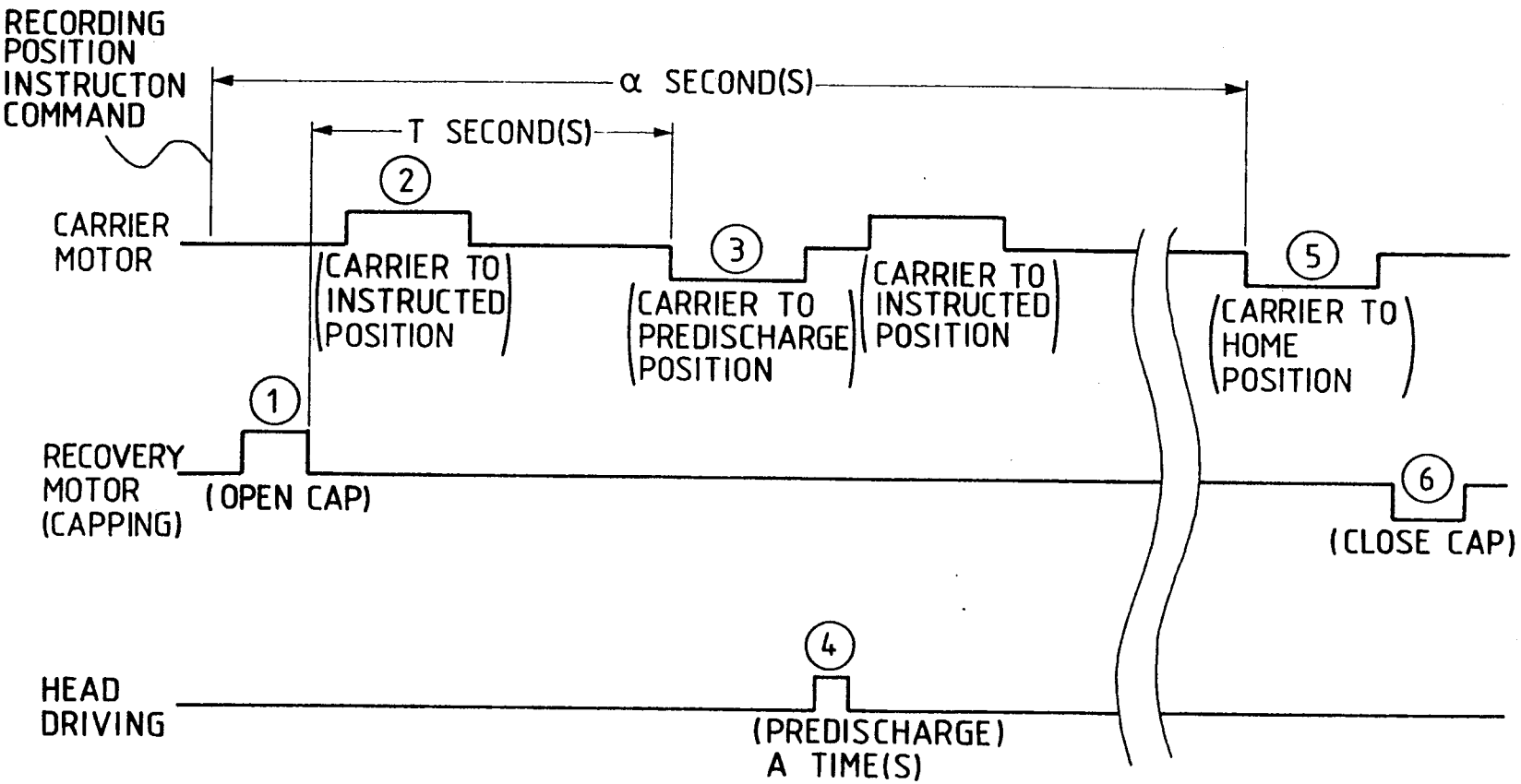
FIG. 42 is timing chart.
Figure 43:
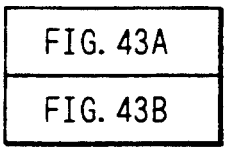
FIGS. 43, 43A and 43B are flowcharts in a recording position instructed mode for the recording apparatus as shown in FIG. 25, respectively.
Figure 43A:
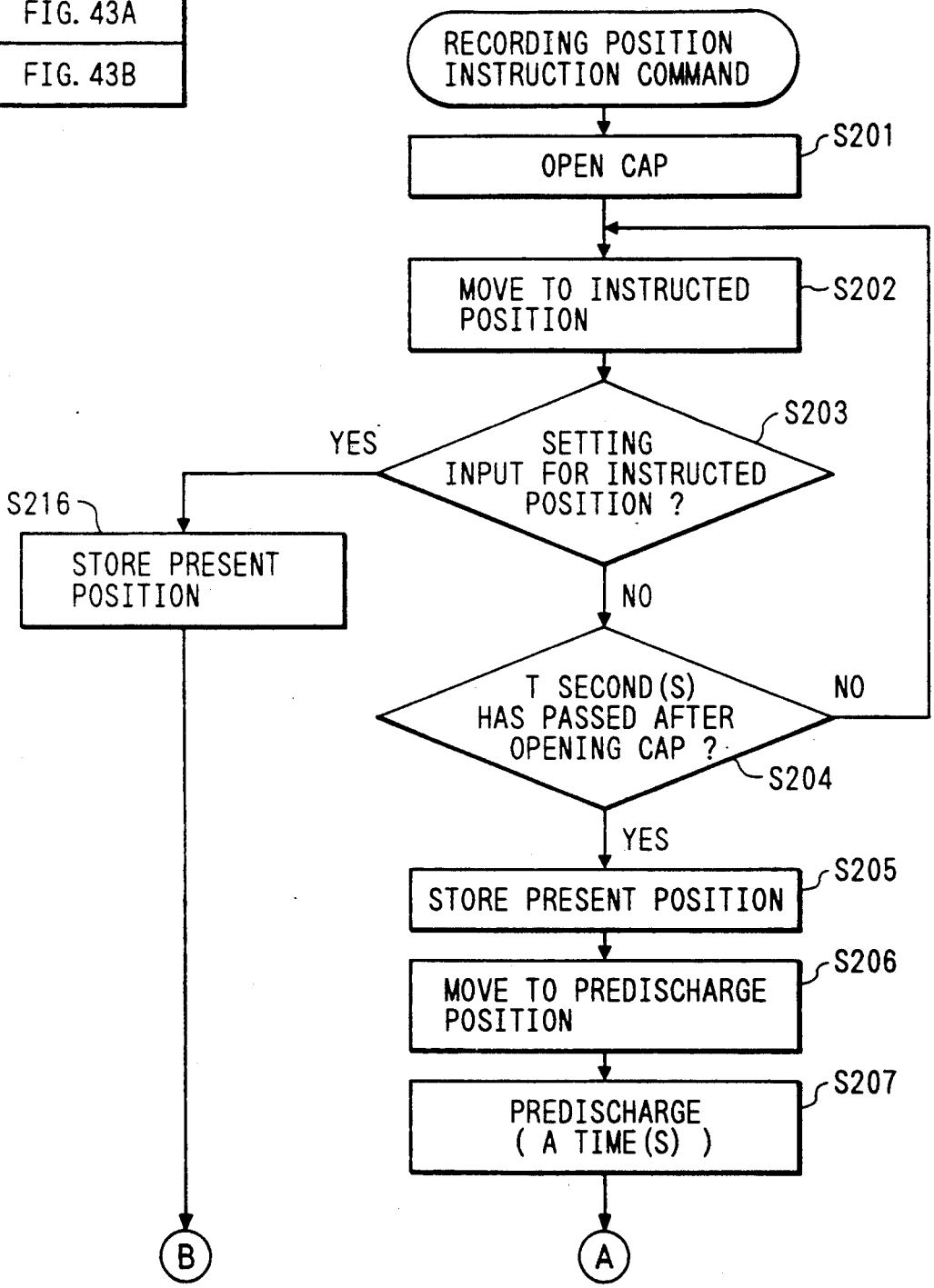
Figure 43B:
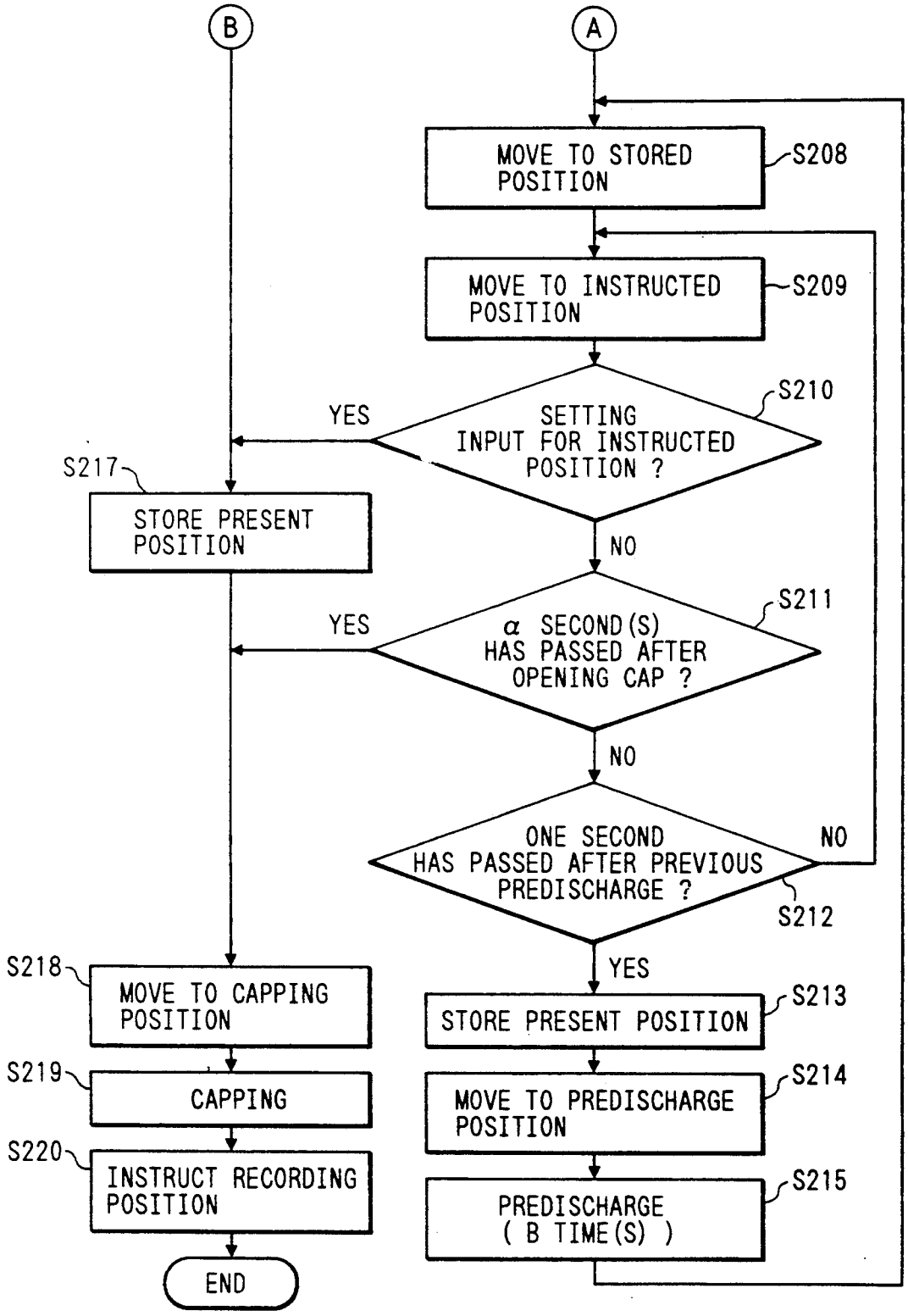

FIGS. 42 and 43 are a timing chart and a flowchart, respectively, for showing the control procedure in the recording position instructed mode for an ink jet recording apparatus according to this example.

The recording position instructed mode in accordance with this example is a control procedure that is activated when the recording is performed onto a formatted paper or a recording paper already once recorded, such as in an electronic typewriter which can use the recording position in accordance with this example. That is, the recording position and range are set and confirmed while moving the carriage (recording head), and during that period no ink droplet is discharged. Hence, in order to prevent the ink from being thick or undischarged, the predischarge and the capping are needed in which the carriage is moved to a position for the predischarge for every predetermined time, by interrupting the processing such as the setting of recording position with the carriage.

Referring now to a timing chart of FIG. 42 and based on a flowchart of FIG. 43, the control procedure in the recording position instructed mode will be described.

If a command for instructing recording position is issued with a predetermined key input, this control procedure is activated, the cap 2051 is opened at step S201 (FIG. 42, only the timing is noted hereafter), and at step S202, the carriage 2011 is moved toward an instructed position, for example, by the input of space keys (timing 2). Meanwhile, at step S203, a determination is made whether a position is set with a predetermined key input for the instructed position, when the carriage 2011 has reached to the instructed position, and if not, at S204, another determination is made whether a predetermined time T seconds have passed since the opening of the cap.

If T seconds have passed, a current position of the carriage 2011 is stored at S205, and the carriage 2011 is moved to a predischarge position at S206 (timing 3). Further, a predetermined amount of ink is predischarged (A times) at S207 (timing 4). Then at step S208, the carriage 2011 is returned to the previously stored position, and at step S209, it is moved to the instructed position in the same way as above described. Meanwhile, at step S210, a determination is made whether a position is set with a predetermined key input for the instructed position in the same way as above described, and if not, another determination is made at step S211 whether a predetermined time a seconds have passed since the command for instructing position was issued, or this control procedure started. This $\alpha$ seconds was set because the setting of the instructed position would be normally terminated during this time, and because if the recording head is kept open without the cap beyond that period, it will cause a significant damage to the discharge of ink droplet.

If a negative determination is made at step S211, another determination is made at Step S212 whether a predetermined time t seconds have passed since the previous predischarge, and if so, the processing proceeds to steps S213 and S214 which are the same as those above described, then performs the predischarges B times at step S215, and returns to step S208.

If a position is set with a predetermined key input for the instructed position at step S203 or S210, the position is stored at step S216 or S217, and if a determination is made at step S211 that $\alpha$ seconds have passed, the processing proceeds to step S218.

At step S218, the carriage 2011 is moved to the capping position (timing 5), the capping is conducted at step S219 (timing 6), the instruction mode is reset at step S220, and then the processing is terminated It should be noted that the elapsed times t, t and $\alpha$ seconds as above indicated can be set depending on the temperature or humidity in the atmosphere, or may be automatically set based on the detection by a sensor, e.g , a thermal sensor.

The movement to the instructed position with the control procedure as shown above can be performed while a user keeps the space key down, in which the position of the carriage 2011 relative to a recording medium, or the position of the discharge ports can be known, by using both a marker 2049 on the carriage 2011 and a scale 2047 on the paper presser bar 2045, as shown in FIG. 25 and FIG. 36. It should be noted that the position of the marker 2049 is offset from that of the discharge ports, this offset amount is prestored, and automatically corrected in the recording operation. As the scale 2047 is provided on a particular member of the ink jet recording apparatus, such as a paper presser bar 2045, it is possible to adjust the scale to the recording medium in close proximity.

Similarly, in the operation such as the movement to the instructed position, the amount of movement of the carriage 2011 can be known by using a marker 2017 on the lever as shown in FIG. 25 and FIG. 36, and a scale (not shown) indicated on a window 2008 on a cover of the device as shown in FIG. 24.

In this way, the construction of using the markers 2049, 2017 and other scales is especially effective in returning the carriage to the interrupted position again, when the position confirming operation with the movement of carriage is interrupted due to the predischarge in the ink jet recording apparatus.

As to a block diagram showing the control configuration for performing the controls a shown in FIG. 42 and FIG. 43, refer to FIG. 18 and the description therefor.

As to the detail of the main portion of the recovery device, refer to FIG. 12 and the description therefor.

Figure 44:
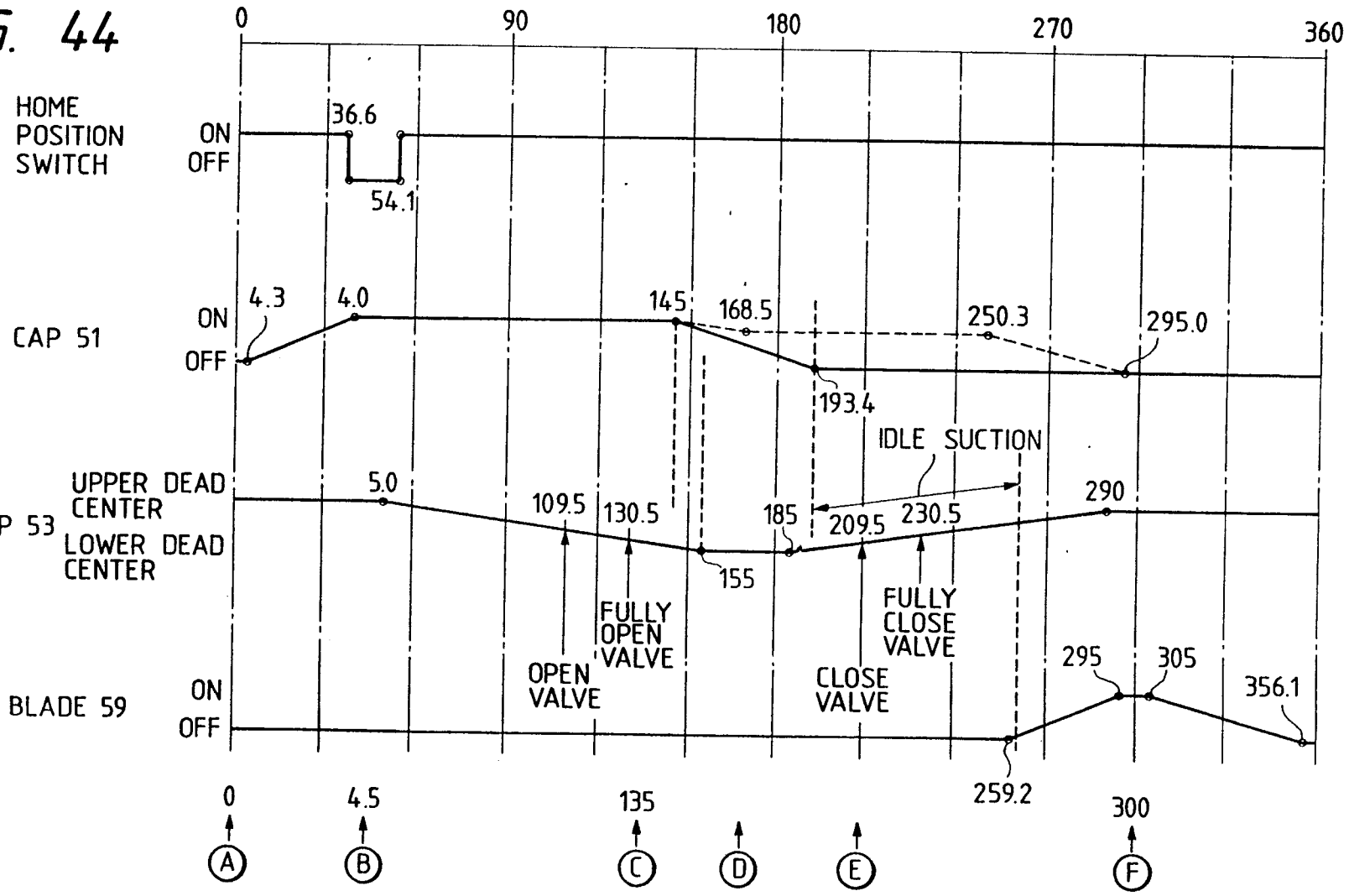
FIG. 44 is a timing chart showing a series of the recovery operation on the above mentioned mechanism.
Figure 45:
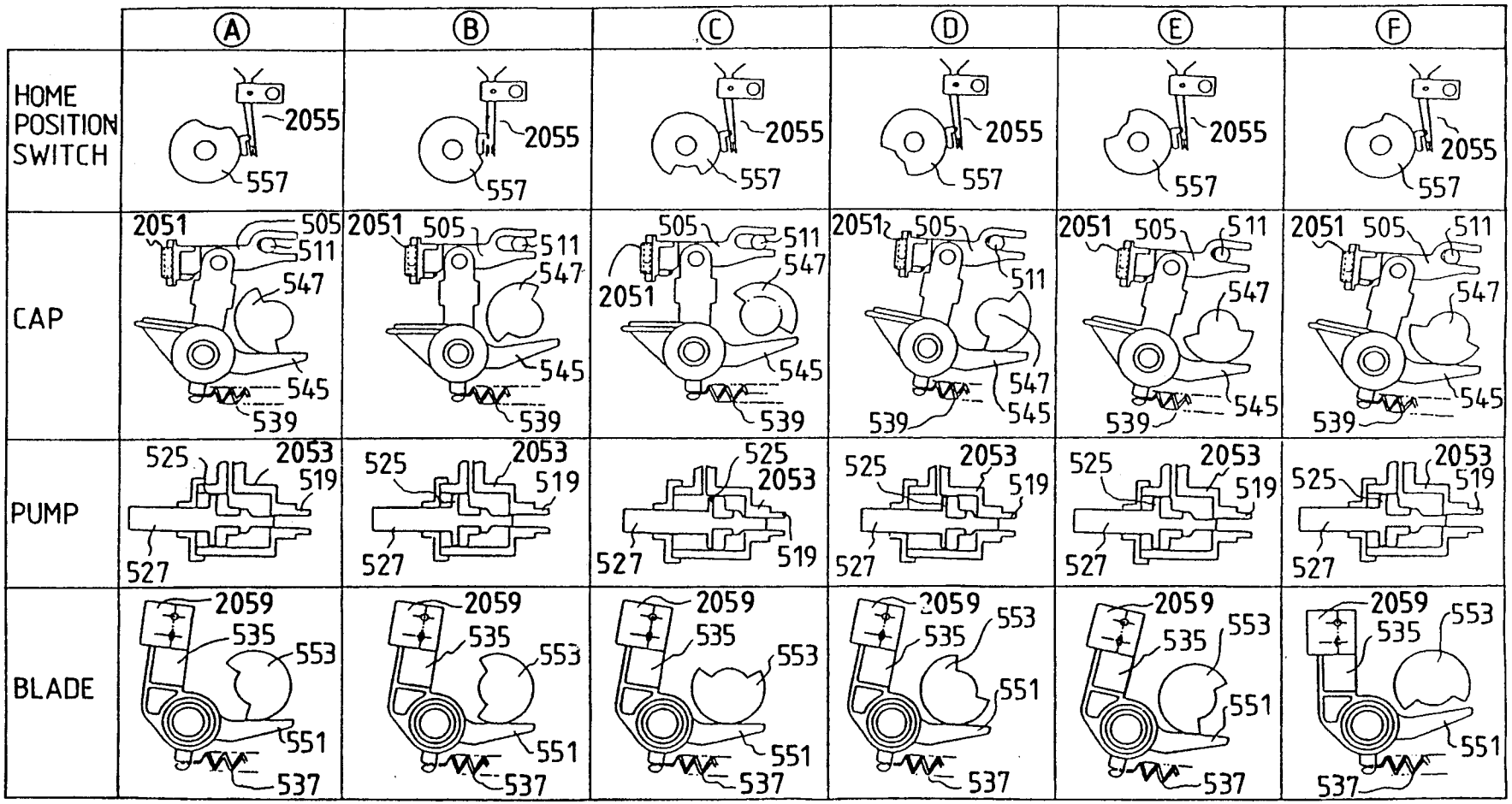
FIG. 45 is a view showing in time series the operation of each portion on the suction recovery operation for the above mentioned mechanism.

FIGS. 44 and 45 are views for explaining the profile curve of each cam in a cam mechanism 2063, and the operation position of each portion corresponding to each cam position, respectively. Note that numbers shown in FIG. 44 are rotation angles of cam.

In these figures, (A) shows the cam position and the state of each portion at the recording operation, in which the cap 2051 and the blade 2059 are isolated from a discharge port formation face of the recording head, and the pump 2053 is placed at the upper dead center. (B) is a position at which the home position switch 2055 is turned off, which is defined to be a home position of the cam mechanism 63. This position is set, for example, while waiting for recording, where the cap 2051 covers the discharge port formation face, the blade 2059 is retracted, and the pump 2053 is at the upper dead center.

If the cam is rotated from the position (B), the piston 525 moves toward the lower dead center with the cap 2051 joined to the discharge port formation face (cap on), thereby increasing a negative pressure of the suction system leading to the cap. Finally, the piston 525 arrives at an ink exhaust port of the pump, after a period of closing the pump (while a valve is closed), the valve begins to open (a point of 109.5 degrees), and completely opens (a point of 130.5 degrees), and the piston reaches to a point (C) near the lower dead center. Taking into consideration the flow resistance of the ink suction system, a sufficient suction is performed by stopping the rotation of the cam for a predetermined time, and then if the cam is rotated again, the piston 525 reaches to the lower dead center, and the cap 51 begins to separate from the discharge port formation face. This position (D) is held for a predetermined time.

After that, if the cam is further rotated, the piston begins to move toward the upper dead center again. In this process, the valve begins to close (a point of 209.5 degrees), reaching to a point at which it is completely closed, while the cap 2051 is completely isolated from the discharge port formation face at a position (E). By driving the piston 525 several times near this position, the ink remaining in the ink suction system will be sucked into the pump side (idle suction). Left and right spaces of the piston 525 within the pump are communicated through a flow path not shown, which is closed when the piston moves from the upper dead center to the lower dead center, and opens when it moves from the lower dead center to the upper dead center. The space on the right side of the piston communicates to a flow path on the pump shaft 519. Accordingly, when the piston 525 moves from the lower dead center to the upper dead center in the idle suction, the ink introduced into the left space of the piston is transferred into the right space, and when it moves from the upper dead center to the lower dead center, the ink is introduced from the ink suction system into the left space, and is exhausted from the right space to a waste ink tank.

After that, if the cam is further rotated in the positive direction, the blade 2059 projects to be in a wiping state (position (F). If the carriage 2011 is moved to the recording area side in this state, the blade 2059 engages with the discharge port formation face of the head, thereby wiping that surface and removing the ink deposited on the discharge port formation face. And the cam is further rotated to retract the blade 2055, and to set the cam at the position (A). In this state, the carriage 2011 is moved toward the cap to place the discharge port formation face of the head opposed to the cap 2051, and then the cam is moved to the position (B) for turning the cap on, and is stopped.

In transferring to the recording, the cam is rotated in the positive or negative direction from the position (B) to project the blade 2059, and after the wiping with the blade 2059, the recording can be performed.

Figure 46:
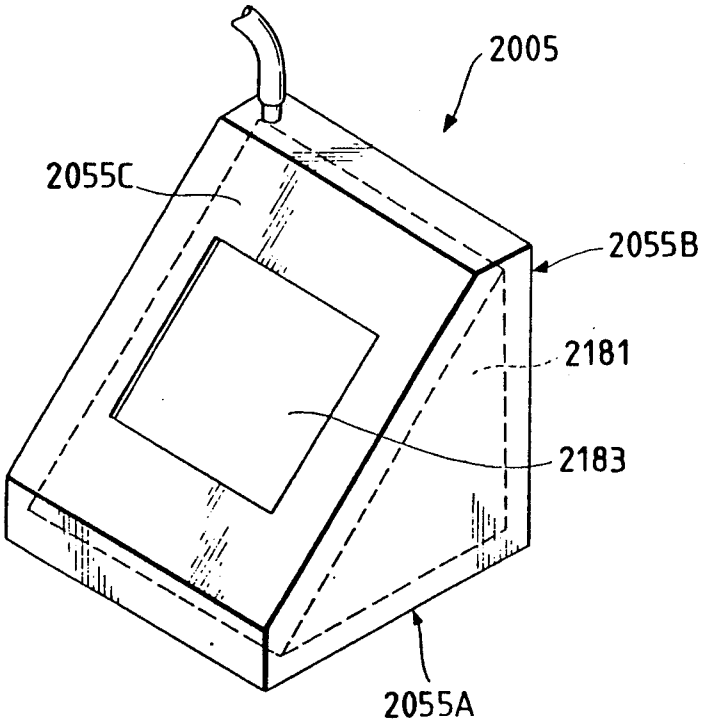
FIG. 46 is a typical perspective view of a waste ink tank for reserving the ink exhausted by the above mentioned recovery operation.

FIG. 46 shows an example of a waste ink tank 2055 according to this example in the state when a device is used.

Here, 2181 is an ink absorbing member for holding waste ink, 2055A is used as a bottom portion when the device is used (the state in FIG. 24A), while 2055B is used as a bottom portion when the device is housed as shown in FIG. 24B and transported with a grip 2006. 2055C is an inclined surface which is never placed in the vertical downward direction, and in this example, provided with a gas permeable cloth 2183 thereon. This gas permeable cloth 2183 passes the ink solvent vapor, but does not permeate the ink liquid, and more particularly, for example, a vapor road (Teijin Limited) may be used.

With the disposition of such gas permeable cloth 2183, the ink does not leak from the waste ink tank 2055, rather as in this example, by providing the gas permeable cloth 2183 on the inclined surface, the leak can be completely prevented.

Figure 47A:
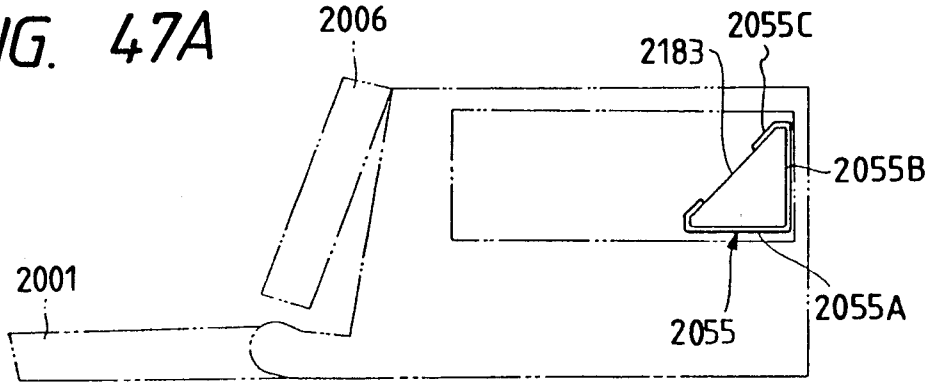
FIGS. 47A and 47B are views showing dispositions of the above mentioned waste ink tank, when a printer is in use and in storage, respectively.
Figure 47B:
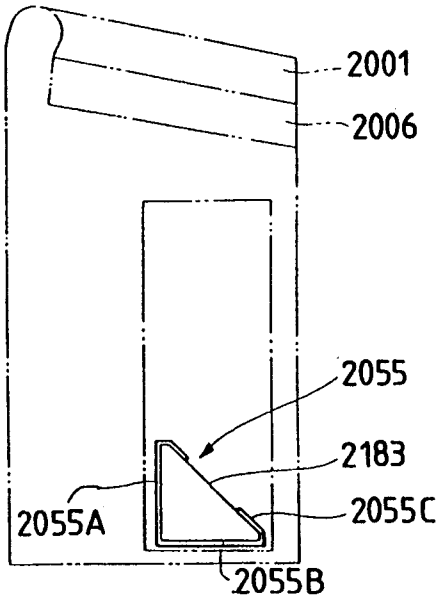

This is because as shown in FIGS. 47A and 47B, when the device is used, a portion 2055A is the bottom face, and the inclined surface 2055C is directed upwardly, but when it is housed (or transported), a portion 2055B is the bottom face, and the inclined surface is also directed upwardly. Thus, the waste ink can neither soak through the gas permeable cloth 2183, nor leak through it.

A suction recovery device of an electronic typewriter with the above construction according to this example of the invention as shown in FIGS. 13A to 13H and FIGS. 14A to 14D, can exhibit the same effect as that for a word processor of example 1.

The recording method used in this invention has an excellent effect on a recording apparatus having a recording head with the ink jet recording method, especially a method in which the state change of ink is caused by the heat energy that is transferred from means for generating the energy for the discharge of ink (e.g. electricity-heat conversion element or laser beam). With such method, a higher density and definition of recording can be accomplished.

The typical construction and principle is preferably based on basic principles as disclosed in U.S. Pat. No. 4,723,129 and U.S. Pat. No. 4,740,796 specifications. This method is applicable to both a so-called on-demand type and a continuance type, and particularly the on-demand type is more effective because by applying at least one drive signal corresponding to a recording data and causing a rapid rise of temperature exceeding that of the nuclear boiling and, to the electricity-heat conversion element disposed corresponding to a sheet and liquid path where the liquid (ink) is carried, the heat energy is generated in the electricity-heat conversion element, and causes the film boiling on the heat acting surface of the recording head, so that bubbles in the liquid (ink) can be formed corresponding one-to-one to that drive signal. With the growth and contraction of bubbles, the liquid (ink) is discharged through discharge ports to form at least one droplet. If this drive signal is pulse-shaped, the growth or contraction of bubbles can be performed immediately and appropriately, so that the discharge of liquid (ink) is more preferably accomplished with a particularly efficient response characteristic. This pulse-shaped drive signal as described in U.S. Pat. No. 4,463,359 and U.S. Pat. No. 4,345,262 specifications is appropriate. Under the condition as described in U.S. Pat. No. 4,313,124 specification which is an invention concerning the temperature-rise rate of the above mentioned heat acting surface, the more excellent recording can be performed.

The recording head in accordance with the present invention is constructed with the combination of discharge ports, liquid paths (straight or rectangular liquid paths) and electricity-heat conversion elements, or as described in U.S. Pat. No. 4,558,333 and U.S. Pat. No. 4,459,600 specifications, an arrangement in which the heat acting portion is disposed in inflection area. In addition, this invention is also effective with the construction based on Patent Laid-Open No. 59-123670 publication which discloses the use of a common slit as discharge portion for a plurality of electricity-heat conversion elements, or Patent Laid-open No. 59-138461 publication which discloses a construction in which an aperture absorbing the pressure wave of heat energy is disposed corresponding to the discharge portion. That is, the recording can be reliably and efficiently performed, according to the present invention, in whatever form the recording head may be made.

Furthermore, this invention is also effective for a full-line type recording head where the recording apparatus has a length corresponding to the maximum width of recording medium to be recorded. Such recording head is constructed in either a combination of a plurality of recording heads to fill that length, or an integrally formed recording head.

In addition, this invention is also effective for a serial-type recording head as above indicated, particularly, a recording head fixed to the body of apparatus, a replaceable chip type recording head which enables the electrical connection to the body of apparatus and the supply of ink from the body of apparatus because it is attached to the body of apparatus, or a cartridge type recording head integrally formed with the ink tank.

It is preferable that recovery means or preliminary auxiliary means for a recording head are added to the construction of a recording apparatus according to this invention, as it can make the effect of this invention more stable. More specifically, it includes capping means for the recording head, cleaning means, pressing or suction means, and preliminary heating means consisting of electricity-heat conversion elements or other heating elements or the combination of both. And the predischarge mode for discharging before the recording is effective to make a stable recording.

As to the type and number of recording heads to be attached, for example, a single type corresponding to a monochromatic ink, or a multiple type corresponding to a plurality of inks differing in color or density may be used. That is, the present invention is also quite effective not only for a recording apparatus having a recording mode based on a main color such as black, but also an apparatus having at least one of the composite color of different colors or the full color with mixed colors, with either an integrally formed recording head or a plurality of recording heads.

Furthermore, although the ink is considered as the liquid in the examples of the present invention as described above, it is also preferable that the ink stiffens below the room temperature and softens or liquefies at the room temperature, or as it is common in the ink jet method to control the temperature to maintain the viscosity of ink within a certain range for stably discharging with the temperature adjustment of ink in the range from 30° C. to 70° C., the ink will liquefy when a use recording signal is issued. In addition, the present invention is also applicable when the ink has the property of liquefying only with the application of the heat energy, such as the ink which liquefies with the application of heat energy in accordance with a record signal to discharge the liquid ink, or the ink which already begins to stiffen at the time when it arrives at a recording medium, with such a manner of preventing the rise of temperature with the heat energy by positively using it as the energy for the change of state from the solid state of ink to the liquid state, or utilizing the ink which stiffens in the shelf state in order to prevent the evaporation of ink. In this case, the ink can be provided to be opposed to electricity-heat conversion elements, in the state where it is carried in a recess or through hole of a porous sheet as liquid or solid material. The most effective method for each ink as above described in the present invention is a film boiling method as above indicated.

Further, an ink jet recording apparatus according to this invention may be used for an image output terminal in an information processing equipment such as a computer, a copying machine in combination with a reader, or a facsimile terminal equipment having the transmission and reception feature.

As described above, according to the present invention, an effective suction recovery processing and the protection of a recording head when not recording can be accomplished by assuring the suction recovery processing and the capping when not recording, even for a recording head having the discharge port formation face not parallel to a record face of recording medium and having a step near the discharge ports.

The pressure variation acting on the discharge port formation face when attaching or detaching a cap can be relieved by making an edge portion of the cap and the discharge port formation face not parallel.

Furthermore, according to the present invention, as the support mechanism for a cap can be optimized, each member can optimally perform its function, and the effect of preventing the leak of ink can be exhibited for a long term. Particularly, in the invention comprising ink suction means, the remaining ink without being sucked can be reduced due to the effect of an improved suction.

What is claimed is:

1. A suction recovery device comprising:

a cap for covering a discharge port face of a recording head, said recording head having discharge ports for discharging ink for performing recording with the discharge of the ink onto a recording medium, said cap exhausting the ink from said recording head and having an edge portion opposed and non-parallel to said discharge port face, an ink suction port, and an ink exhaust path communicating to said ink suction port;

a cap direct contact member for carrying said cap, said cap direct contact member having a guide path communicating to said exhaust path for guiding the ink in an exhaust direction;

a communicating member for communicating said exhaust path and said guide path, wherein said communicating member is disposed on a direct contact portion where said exhaust path and said guide path contact each other, at least one of said exhaust path and said guide path being an elastic path and said communicating member being carried within said elastic path; and suction means for exerting suction power on the inside of said cap through said ink suction port.

2. A suction recovery device according to claim 1, wherein said edge portion is an elastic member.

3. A suction recovery device according to claim 1, wherein a cross section of said edge portion is trapezoidal.

4. A suction recovery device according to claim 1, wherein said edge portion has irregularities.

5. A suction recovery device according to claim 1, Wherein Said recording head is such that said discharge port face for discharging said ink is not parallel to a record face of said recording medium.

6. A suction recovery device according to claim 1, wherein said communicating member is carried with a stronger pressure than a direct contact pressure between said cap and said cap direct contact member.

7. A suction recovery device according to claim 1, wherein said communicating member is provided with an end portion within said exhaust path and is positioned downward in a gravitational direction within said cap, said communicating member not contacting said capping member and located within said cap.

8. A suction recovery device according to claim 1, wherein said communicating member is an elastic member.

9. A suction recovery device according to claim 1, wherein said recording head is provided with heating elements for generating the energy with which the ink is discharged.

10. A suction recovery device according to claim 9, wherein said recording head causes a rapid state change due to film boiling in the ink by using heat energy which said heating elements generate, and discharges the ink due to the rapid change of state.

11. A suction recovery device comprising:

a cap for covering a discharge port face of a recording head, said recording head having discharge ports for discharging ink for performing recording with the discharge of the ink onto a recording medium, said cap exhausting the ink from said recording head and having an edge portion opposed and non-parallel to said discharge port face, an ink suction port, and an ink exhaust path communicating to said ink suction port;

a cap direct contact member for carrying said cap, said cap direct contact member having a guide path communicating to said exhaust path for guiding the ink in the exhaust direction;

a fitting member for communicating said exhaust path and said guide path, said fitting member being disposed on a joint portion where said exhaust path and said guide path with each other; and suction means for exerting suction power on the inside of said cap through said ink suction port.

12. A suction recovery device according to claim 11, wherein said edge portion is an elastic member.

13. A suction recovery device according to claim 11, wherein a cross section of said edge portion is trapezoidal.

14. A suction recovery device according to claim 11, wherein said edge portion has irregularities.

15. A suction recovery device according to claim 11, wherein said recording head is such that said discharge port face for discharging said ink is not parallel to a record face of said recording medium.

16. A suction recovery device according to claim 11, wherein said fitting member is provided with an end portion within said exhaust path and is positioned downward in a gravitational direction within said cap, wherein said fitting member does not contact said capping member and is located within said cap.

17. A suction recovery device according to claim 11, wherein said fitting member is a communicating member having elasticity.

18. A suction recovery device according to claim 11, wherein said recording head is provided with heating elements for generating the energy with which the ink is discharged.

19. A suction recovery device according to claim 18, wherein said recording head causes a rapid state change due to film boiling in the ink by using heat energy which said heating elements generate, and discharges the ink due to the rapid change of state.

20. A ink jet recording apparatus comprising:

a recording head for performing recording with the discharge of ink onto a recording medium;

a cap for covering a discharge port face of said recording head formed with discharge ports for discharging the ink, said cap having an edge portion opposed and non-parallel to said discharge port face, an ink suction port and an ink exhaust path communicating with said ink suction port;

a cap direct contact member for carrying said cap, said cap direct contact member having a guide path communicating with said exhaust path for guiding the ink in an exhaust direction;

a communicating member for communicating said exhaust path and said guide path, wherein said communicating member is disposed on a direct contact portion where said exhaust path and said guide path contact each other, at least one of said exhaust path and said guide path being an elastic path and said communicating member being carried within said elastic path; and suction means for exerting suction power on the inside of said cap through said ink suction port.

21. An ink jet recording apparatus according to claim 20, wherein said edge portion is an elastic member.

22. An ink jet recording apparatus according to claim 20, wherein a cross section of said edge portion is trapezoidal.

23. An ink jet recording apparatus according to claim 20, wherein said edge portion has irregularities.

24. An ink jet recording apparatus according to claim 20, wherein said recording head is such that said discharge port face for discharging the ink is not parallel to a record face of said recording medium.

25. An ink jet recording apparatus according to claim 20, wherein said communicating member is carried with a stronger pressure than a direct contact pressure between said cap and said cap direct contact member.

26. An ink jet recording apparatus according to claim 20, wherein said communicating member is provided with an end portion within said exhaust path and is positioned downward in a gravitational direction within said cap, said communicating member not contacting said capping member and located within said cap.

27. An ink jet recording apparatus according to claim 20, wherein said communicating member is an elastic member.

28. An ink jet recording apparatus according to claim 20, wherein said recording head is provided with heating elements for generating the energy with which the ink is discharged.

29. An ink jet recording apparatus according to claim 28, wherein said recording head causes a rapid state change due to film boiling in the ink by using heat energy which said heating elements generate, and discharges the ink due to the rapid change of state.

30. An ink jet recording apparatus according to claim 20, wherein said ink jet recording apparatus is a word processor.

31. An ink jet recording apparatus according to claim 20, wherein said ink jet recording apparatus is an electronic typewriter.

32. An ink jet recording apparatus comprising:

a recording head for performing recording with the discharge of ink onto a recording medium;

a cap for covering a discharge port face of said recording head formed with discharge ports for discharging the ink, said cap having an edge portion opposed and non-parallel to said discharge port face, an ink suction port and an ink exhaust path communicating with said ink suction port;

a cap direct contact member for carrying said cap, said cap direct contact member having a guide path communicating with said exhaust path for guiding the ink in an exhaust direction;

a fitting member for communicating said exhaust path and said guide path, said fitting member being disposed on a joint portion where said exhaust path and said guide path join with each other; and suction means for exerting suction power on the inside of said cap through said ink suction port.

33. An ink jet recording apparatus according to claim 32, wherein said edge portion is an elastic member.

34. An ink jet recording apparatus according to claim 32, wherein a cross section of said edge portion is trapezoidal.

35. An ink jet recording apparatus according to claim 32, wherein said edge portion has irregularities.

36. An ink jet recording apparatus according to claim 32, wherein said recording head is such that said discharge port face for discharging the ink is not parallel to a record face of said recording medium.

37. An ink jet recording apparatus according to claim 32, wherein said fitting member is provided with an end portion within said exhaust path and is positioned downward in a gravitational direction within said cap, said fitting member not contacting with capping member and located within said cap.

38. An ink jet recording apparatus according to claim 32, wherein said fitting member is a communicating member having elasticity.

39. An ink jet recording apparatus according to claim 32, wherein said recording head is provided with heating elements for generating the energy with which the ink is discharged.

40. Recording apparatus according to claim 39, wherein said recording head causes a rapid state change due to film boiling in the ink by using heat energy which said heating element generate, and discharges the ink due to the rapid change of state.

41. An ink jet recording apparatus according to claim 32, wherein said ink jet recording apparatus is a word processor.

42. An ink jet recording apparatus according to claim 32, wherein said ink jet recording apparatus is an electronic typewriter.

43. A suction recovery device comprising:

a cap for covering a discharge port face of a recording head, said recording head having discharge ports for discharging ink for performing recording with the discharge of the ink onto a recording medium, said cap exhausting the ink from said recording head and having an edge portion opposed and parallel to said discharge port face, an ink suction port, and an ink exhaust path communicating to said ink suction port;

a cap direct contact member for carrying said cap, said cap direct contact member having a guide path communicating to said exhaust path for guiding the ink in the exhaust direction;

a communicating member for communicating said exhaust path and said guide path, wherein said communicating member is disposed on a direct contact portion where said exhaust path and said guide path contact each other, at least one of said exhaust path and said guide path being an elastic path and said communicating member being carried within said elastic path; and suction means for exerting suction power on the inside of said cap through said ink suction port.

44. A suction recovery device according to claim 43, wherein said recording head is provided with heating elements for generating the energy with which the ink is discharged.

45. A suction recovery device according to claim 43, wherein said recording head causes a rapid state change due to film boiling in the ink by using heat energy which said heating elements generate, and discharges the ink due to the rapid change of state.

46. A ink jet recording apparatus comprising:

a recording head for performing recording with the discharge of ink onto a recording medium;

a cap for covering a discharge port face of said recording head formed with discharge ports for discharging the ink, said cap having an edge portion opposed and parallel to said discharge port face, an ink suction port and an ink exhaust path communicating with said ink suction port;

a cap direct contact member for carrying said cap, said cap direct contact member having a guide path communicating with said exhaust path for guiding the ink in an exhaust direction;

a communicating member for communicating said exhaust path and said guide path, wherein said communicating member is disposed on a direct contact portion where said exhaust path and said guide path contact each other, at least one of said exhaust path and said guide path being an elastic path and said communicating member being carried within said elastic path; and suction means for exerting suction power on the inside of said cap through said ink suction port.

47. An ink jet recording apparatus according to claim 46, wherein said recording head is provided with heating elements for generating the energy with which the ink is discharged.

48. An ink yet recording apparatus according to claim 46, wherein said recording head causes a rapid state change due to film boiling in the ink by using heat energy which said heating elements generate, and discharges the ink due to the rapid change of state.

49. An ink jet recording apparatus for performing recording by means of a recording head having discharge portions for discharging ink onto a recording medium, the apparatus comprising:

a cap having an exhaust path for exhausting the ink, wherein said cap is movable to cover the discharge portions;

a cap direct contact member having a guide path for communicating with said exhaust path of said cap and guiding the ink in an exhaust direction; and a communicating member for permitting the passage of ink inside thereof, at least one of said exhaust path and said guide path being an elastic path, wherein said communicating member is carried within said elastic path and is supported with a pressure by said elastic path that is greater than a pressure in a direct contact state between sad cap and said cap direct contact member.

50. An ink jet recording apparatus according to claim 49, wherein said exhaust path is elastic, said communicating member having an end portion within said exhaust path and located downward in a gravitational direction within said cap and not contacting said capping member and located within said cap.

51. An ink jet recording apparatus according to claim 49, wherein a portion of said cap for making contact with said direct contact member is elastic, and in the capping state of said recording head, a pressure is formed between said cap and said cap direct contact portion that is higher than a pressure between said connecting member and said cap direct contact member.

52. An ink jet recording apparatus according to any of claims 49 to 51, wherein said ink jet recording apparatus is provided with suction recovery means for sucking through said cap direct contact member.

53. An ink jet recording apparatus comprising:

a recording head for performing recording with the discharge of ink onto a recording medium;

a cap for covering a face of said recording head formed with discharge ports for discharging the ink, said cap having an ink suction port and an ink exhaust path communicating with said ink suction port;

suction means for exerting suction power on the inside of said cap through said ink suction port;

a cap direct contact member for carrying said cap, said cap direct contact member having a guide path communicating with said exhaust path for guiding ink in an exhaust direction; and a fitting member for communicating said exhaust path and said guide path, said fitting member being provided at a joint portion where said exhaust path and guide path are joined together.

54. An ink jet recording apparatus according to claim 53, wherein said fitting member is an elastic communicating member.

55. An ink jet recording apparatus according to claim 53, wherein said recording head is provided with heating elements for generating energy with which the ink is discharged.

56. A suction recovery device for an ink jet recording apparatus, the device comprising:

a cap for covering a face of a recording head formed with discharge ports for discharging ink for performing recording with the discharge of ink onto a recording medium, said cap having an ink suction port and an ink exhaust path communicating with said ink suction port;

suction means for exerting suction power on the inside of said cap through said ink suction port; and a cap direct contact member for carrying said cap, said cap direct contact member having a guide path communicating with said exhaust path for guiding ink in an exhaust direction; and a fitting member for communicating said exhaust path and said guide path, said fitting member being provided at a joint portion where said exhaust path and said guide path are joined together.

* * * * *

UNITED STATES PATENT AND TRADEMARK OFFICE

CERTIFICATE OF CORRECTION

PATENT NO. : 5,164,748

DATED : November 17, 1992

INVENTOR(S) : JUN KATAYANAGI, ET AL.

It is certified that error appears in the above-identified patent and that said Letters Patent is hereby corrected as shown below:

COLUMN 1

Line 61, "in" should be deleted.

COLUMN 2

Line 61, "Another," should read --Another--.
Line 63, "as" should be deleted.
Line 64, "Of" should read --of--.
Line 65, "face" should read --face,-- and "entire," should read --entire--.

COLUMN 3

Line 4, "]el" should read --jet--.

COLUMN 4

Line 59, "FIG. 35." should read --FIG. 33.--.

COLUMN 5

Line 40, "portion ]when" should read --portion 1 when--.
Line 46, "6 to 8" should read --FIGS. 6 to 8--.

COLUMN 6

Line 21, "Via" should read --via--.
Line 45, "the whole" should read --all the--.

UNITED STATES PATENT AND TRADEMARK OFFICE

CERTIFICATE OF CORRECTION

PATENT NO. : 5,164,748

DATED : November 17, 1992

INVENTOR(S) : JUN KATAYANAGI, ET AL.

It is certified that error appears in the above-identified patent and that said Letters Patent is hereby corrected as shown below:

COLUMN 7

Line 20, "view car-" should read --view of the car- --.
Line 24, "FIG. 4A 911" should read --FIG. 4A, 911--.

COLUMN 9

Line 67, "5" should read --9--.

COLUMN 10

Line 2, "One" should read --one--.

COLUMN 12

Line 2, "DC," should read --4C,--.
Line 3, "(θ=5°)" should read --(θ=5°--.
Line 11, "locking" should read --lacking--.
Line 15, "On" should read --on--.
Line 16, "Whereby" should read --whereby--.
Line 67, "With" should read --with--.

COLUMN 13

Line 1, "edge" should read --entire edge--.
Line 32, "ace" should read --face--.

COLUMN 14

Line 9, "the-" should read --the--.
Line 14, "pressure," should read --pressure--.
Line 58, "518," should read --518--.

UNITED STATES PATENT AND TRADEMARK OFFICE

CERTIFICATE OF CORRECTION

PATENT NO. : 5,164,748

DATED : November 17, 1992

INVENTOR(S) : JUN KATAYANAGI, ET AL.

It is certified that error appears in the above-identified patent and that said Letters Patent is hereby corrected as shown below:

COLUMN 15

Line 12, "the and" should read --the cap 51, and--.

COLUMN 16

Line 5, "(position 1) 1" should read --(position 1)--.

COLUMN 17

Line 3, "And" should read --and--.
Line 19, "9" should read --g--.
Line 48, "Op ®ned" should read --opened--.

COLUMN 18

Line 51, "steps" should read --steps,--.

COLUMN 20

Line 16, "device" should read --the device--.
Line 39, "device within the" should read --within the device,--.
Line 46, "5." should read --55.--.
Line 64, "FIG. 24B 2004" should read --FIG. 24B. 2004--.

COLUMN 22

Line 6, "attach" should read --attach and--.
Line 47, "is" (second occurrence) should be deleted.

UNITED STATES PATENT AND TRADEMARK OFFICE

CERTIFICATE OF CORRECTION

PATENT NO. : 5,164,748

DATED : November 17, 1992

INVENTOR(S) : JUN KATAYANAGI, ET AL.

It is certified that error appears in the above-identified patent and that said Letters Patent is hereby corrected as shown below:

COLUMN 24

Line 2, "Cartridge" should read --cartridge--.
Line 43, "604" should read --2604--.

COLUMN 27

Line 13, "45" should read --2045--.

COLUMN 28

Line 43, "Of" should read --of--.

COLUMN 30

Line 5, "333," should read --2333,--.
Line 28, "Carriage" should read --carriage--.
Line 35, "is" should be deleted.

COLUMN 31

Line 32, "25" should read --2025--.

COLUMN 32

Line 1, "2290 Therefore" should read --2290. Therefore,--.
Line 17, "25" should read --2025--.
Line 21, "ar" should read --are--.
Line 41, "25" should read --2025--.

COLUMN 33

Line 58, "a seconds" should read --α seconds--.

UNITED STATES PATENT AND TRADEMARK OFFICE

CERTIFICATE OF CORRECTION

PATENT NO. : 5,164,748

DATED : November 17, 1992

INVENTOR(S) : JUN KATAYANAGI, ET AL.

It is certified that error appears in the above-identified patent and that said Letters Patent is hereby corrected as shown below:

COLUMN 34

Line 48, "a" should read --as--.
Line 64, "63." should read --2063.--.

COLUMN 35

Line 48, "2055," should read --2059,--.

COLUMN 36

Line 35, "continuance" should read --continuous--.
Line 39, "nuclear" should read --nucleate--.

COLUMN 38

Line 66, "Wherein Said" should read --wherein said--.

COLUMN 39

Line 40, "path" should read --path join--.

COLUMN 40

Line 4, "A" should read --An--.

COLUMN 41

Line 32, "with capping mem-" should read --said cap--.
Line 33, "ber" should be deleted.
Line 41, "Recording" should read --An ink jet recording--.

UNITED STATES PATENT AND TRADEMARK OFFICE

CERTIFICATE OF CORRECTION

PATENT NO. : 5,164,748

DATED : November 17, 1992

INVENTOR(S) : JUN KATAYANAGI, ET AL.

It is certified that error appears in the above-identified patent and that said Letters Patent is hereby corrected as shown below:

COLUMN 42

Line 17, "A" should read --An--.
Line 44, "yet" should read --jet--.
Line 65, "sad" should read --said--.

Signed and Sealed this

Fourth Day of January, 1994

Bruce Lehman

*Attest:*

BRUCE LEHMAN

*Attesting Officer*

*Commissioner of Patents and Trademarks*